US008801002B2

(12) United States Patent
Adams

(10) Patent No.: US 8,801,002 B2
(45) Date of Patent: Aug. 12, 2014

(54) WEARABLE DEVICE

(76) Inventor: Roger R. Adams, Glenbrook, NV (US)

( * ) Notice: Subject to any disclaimer, the term of this patent is extended or adjusted under 35 U.S.C. 154(b) by 0 days.

(21) Appl. No.: 13/184,409

(22) Filed: Jul. 15, 2011

(65) Prior Publication Data

US 2012/0013087 A1 Jan. 19, 2012

Related U.S. Application Data

(60) Provisional application No. 61/365,229, filed on Jul. 16, 2010.

(51) Int. Cl.
*A63C 1/00* (2006.01)

(52) U.S. Cl.
USPC ..... 280/11.19; 280/11.3; 280/11.27

(58) Field of Classification Search
USPC ..... 280/11.3, 11.19, 11.27
See application file for complete search history.

(56) References Cited

U.S. PATENT DOCUMENTS

| | | | | |
|---|---|---|---|---|
| 96,117 | A | 10/1869 | Hubbard | |
| 2,430,037 | A | 11/1947 | Vincent | |
| 3,112,119 | A | 11/1963 | Sweet | |
| 3,309,098 | A | 3/1967 | Parker | |
| 4,114,295 | A | 9/1978 | Schaefer | |
| 4,185,847 | A | 1/1980 | Johnson | |
| 4,666,168 | A | 5/1987 | Hamill et al. | |
| 4,932,675 | A | 6/1990 | Olson et al. | |
| 5,305,496 | A * | 4/1994 | Gagnon et al. | 16/44 |
| 5,394,589 | A * | 3/1995 | Braeger et al. | 16/44 |
| 5,524,912 | A | 6/1996 | Laub et al. | |
| 5,609,455 | A * | 3/1997 | McKewan | 411/386 |
| 5,662,338 | A | 9/1997 | Steinhauser, Jr. | |
| 5,975,542 | A | 11/1999 | Kaufman | |
| 6,068,268 | A * | 5/2000 | Cornelius et al. | 280/11.223 |
| 6,120,038 | A | 9/2000 | Dong et al. | |
| 6,382,638 | B1 | 5/2002 | Lee | |
| D467,290 | S | 12/2002 | Chen | |
| 6,543,791 | B1 | 4/2003 | Lee | |
| 6,629,913 | B2 | 10/2003 | Chen | |
| 6,736,411 | B2 | 5/2004 | Wang et al. | |
| 6,805,363 | B2 | 10/2004 | Hernandez | |
| 6,874,795 | B2 * | 4/2005 | Sung | 280/11.223 |

(Continued)

FOREIGN PATENT DOCUMENTS

| | | |
|---|---|---|
| AU | 2002241994 A8 | 8/2002 |
| AU | 2007358721 A1 | 4/2009 |

(Continued)

OTHER PUBLICATIONS

Adams, Roger R.; U.S. Appl. No. 13/184,404, filed Jul. 15, 2011; "Wearable Device".

(Continued)

*Primary Examiner* — J. Allen Shriver, II
*Assistant Examiner* — Hilary L Johns
(74) *Attorney, Agent, or Firm* — Conley Rose, P.C.; J. Robert Brown, Jr.

(57) ABSTRACT

A suspension for a wearable device configured to selectively provide roller transportation, the suspension including an axle configured to be at least partially circumferentially restrained along a length of the axle, wherein the axle is movable about a center of rotation located along a suspension axis of the suspension that is substantially coincident with an axis of rotation of a wheel assembly carried by the axle.

21 Claims, 40 Drawing Sheets

(56) References Cited

U.S. PATENT DOCUMENTS

| | | | | |
|---|---|---|---|---|
| 6,913,272 | B2 | 7/2005 | Chang | |
| 7,306,240 | B2 | 12/2007 | Chen | |
| 7,341,261 | B2 | 3/2008 | Shing | |
| 7,377,524 | B2 | 5/2008 | Lok | |
| 7,478,803 | B2 * | 1/2009 | Lee | 267/293 |
| 7,597,334 | B2 | 10/2009 | Chen | |
| D610,643 | S | 2/2010 | Chen | |
| 7,681,895 | B2 | 3/2010 | Chen | |
| 2001/0018385 | A1 | 8/2001 | Chen | |
| 2001/0055434 | A1 * | 12/2001 | Wershe | 384/544 |
| 2002/0105152 | A1 | 8/2002 | Miller | |
| 2003/0042058 | A1 | 3/2003 | Chen | |
| 2003/0209867 | A1 | 11/2003 | Weitgasser et al. | |
| 2004/0041359 | A1 | 3/2004 | Im | |
| 2004/0140634 | A1 | 7/2004 | Chen et al. | |
| 2004/0232633 | A1 | 11/2004 | Chaput et al. | |
| 2005/0116430 | A1 | 6/2005 | Chen | |
| 2005/0151332 | A1 | 7/2005 | Chen | |
| 2005/0236783 | A1 | 10/2005 | Reid | |
| 2007/0114743 | A1 | 5/2007 | Chen | |
| 2007/0170666 | A1 | 7/2007 | Chen | |
| 2007/0170686 | A1 | 7/2007 | Chen | |
| 2007/0296164 | A1 | 12/2007 | Roderick | |
| 2008/0029985 | A1 | 2/2008 | Chen | |
| 2008/0272567 | A1 | 11/2008 | Chen | |
| 2008/0313928 | A1 | 12/2008 | Adams et al. | |
| 2009/0079147 | A1 | 3/2009 | Conners et al. | |
| 2009/0184481 | A1 | 7/2009 | Cole | |
| 2009/0273150 | A1 | 11/2009 | Kortschot | |
| 2010/0044981 | A1 | 2/2010 | Chen | |
| 2010/0109265 | A1 | 5/2010 | Sano | |

FOREIGN PATENT DOCUMENTS

| | | | |
|---|---|---|---|
| CN | 2557187 | Y | 6/2003 |
| CN | 2825025 | Y | 10/2006 |
| CN | 200966900 | Y | 10/2007 |
| CN | 101670178 | A | 3/2010 |
| DE | 3027682 | A1 | 2/1982 |
| DE | 10164797 | A1 | 12/2003 |
| DE | 202005003188 | U1 | 5/2005 |
| DE | 102006043070 | A1 | 4/2008 |
| EP | 1449569 | A2 | 8/2004 |
| EP | 1584826 | A1 * | 10/2005 |
| FR | 2870135 | A1 | 11/2005 |
| GB | 2333967 | A | 8/1999 |
| GB | 2350305 | A | 11/2000 |
| JP | 56-001685 | U | 1/1981 |
| JP | 61-29374 | A | 2/1986 |
| WO | 0027488 | A1 | 5/2000 |
| WO | 02058797 | A2 | 8/2002 |
| WO | 02058797 | A3 | 8/2002 |
| WO | 03072205 | A3 | 9/2003 |
| WO | 03087618 | A2 | 10/2003 |
| WO | 2005009557 | A2 | 2/2005 |
| WO | WO 2005009557 | A2 * | 2/2005 |
| WO | 2007030774 | A2 | 3/2007 |
| WO | 2007030774 | A3 | 3/2007 |
| WO | 2008041345 | A1 | 4/2008 |
| WO | 2009005639 | A1 | 1/2009 |
| WO | 2012009690 | A1 | 1/2012 |

OTHER PUBLICATIONS

Adams, Roger R.; U.S. Appl. No. 13/184,407, filed Jul. 15, 2011; "Wearable Device".

Adams, Roger R.; U.S. Appl. No. 13/184,412, filed Jul. 15, 2011; "Wearable Device".

PCT Invitation to Pay Additional Fees and, Where Applicable, Protest Fee, PCT Application No. PCT/US2011/044269; Oct. 7, 2011; 6 pgs.

Adams, Roger R.; U.S. Appl. No. 13/315,823, filed Dec. 9, 2011; "Wearable Device With Attachment System".

PCT International Search Report; PCT Application No. PCT/US2011/044269; Dec. 14, 2011; 12 pgs.

PCT Written Opinion of the International Searching Authority; PCT Application No. PCT/US2011/044269; Dec. 14, 2011; 10 pgs.

Skorpion Sports, Ltd.; http://www.skorpion.com; 2007-2009; 1 page.

Office Action dated Mar. 1, 2013; U.S. Appl. No. 13/184,404, filed Jul. 15, 2011; 5 pages.

Office Action dated Dec. 18, 2012; U.S. Appl. No. 13/184,407, filed Jul. 15, 2011; 28 pages.

Office Action dated Dec. 27, 2012; U.S. Appl. No. 13/184,412, filed Jul. 15, 2011; 27 pages.

Final Office Action dated May 15, 2013; U.S. Appl. No. 13/184,407, filed Jul. 15, 2011; 17 pages.

Office Action dated Mar. 27, 2013; U.S. Appl. No. 13/315,823, filed Dec. 9, 2011; 23 pages.

Notice of Allowance dated May 23, 2013; U.S. Appl. No. 13/315,823, filed Dec. 9, 2011; 9 pages.

Office Action dated May 30, 2013; U.S. Appl. No. 13/184,404, filed Jul. 15, 2011; 23 pages.

Final Office Action dated Sep. 11, 2013; U.S. Appl. No. 13/184,404, filed Jul. 15, 2011; 12 pages.

Notice of Allowance dated Sep. 3, 2013; U.S. Appl. No. 13/184,407, filed Jul. 15, 2011; 17 pages.

Advisory Action dated Sep. 11, 2013; U.S. Appl. No. 13/184,412, filed Jul. 15, 2011; 3 pages.

Advisory Action dated Jul. 17, 2013; U.S. Appl. No. 13/184,407, filed Jul. 15, 2011; 2 pages.

Final Office Action dated Jul. 3, 2013; U.S. Appl. No. 13/184,412, filed Jul. 15, 2011; 22 pages.

Advisory Action dated Nov. 14, 2013; U.S. Appl. No. 13/184,404, filed Jul. 15, 2011, 3 pages.

Office Action dated Oct. 28, 2013; U.S. Appl. No. 13/184,412, filed Jul. 15, 2011; 18 pages.

Canadian Office Action dated Mar. 10, 2014; Canadian Application No. 2,805,633; 2 pgs.

Office Action dated Mar. 20, 2014; U.S. Appl. No. 13/184,404, filed Jul. 15, 2011, 8 pages.

* cited by examiner

WEARABLE DEVICE

CROSS-REFERENCE TO RELATED APPLICATIONS

This non-provisional application claims the benefit of the earlier filed U.S. Provisional Patent Application No. 61/365,229 filed Jul. 16, 2010 and entitled "Wearable Device," which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Some wearable devices, such as shoes, may be worn on the feet of a user to protect the feet of the user while also providing an improvement in ambulatory motion. Some improvements in ambulatory motion attributable to the use of shoes may include allowing faster speeds, improved stability, and/or insulation from elements of a surface, such as a ground surface, traversed during the ambulatory motion. Other devices, such as skateboards, may incorporate roller elements that may be associated with the feet of a user to enable a user to perform ambulatory motions otherwise unavailable to the user in the absence of a device with an incorporated roller element. Further, some wearable devices, such as skates, combine features of shoes with roller elements to enable a user to perform ambulatory motions otherwise unavailable to the user in the absence of a wearable device with an incorporated roller element.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
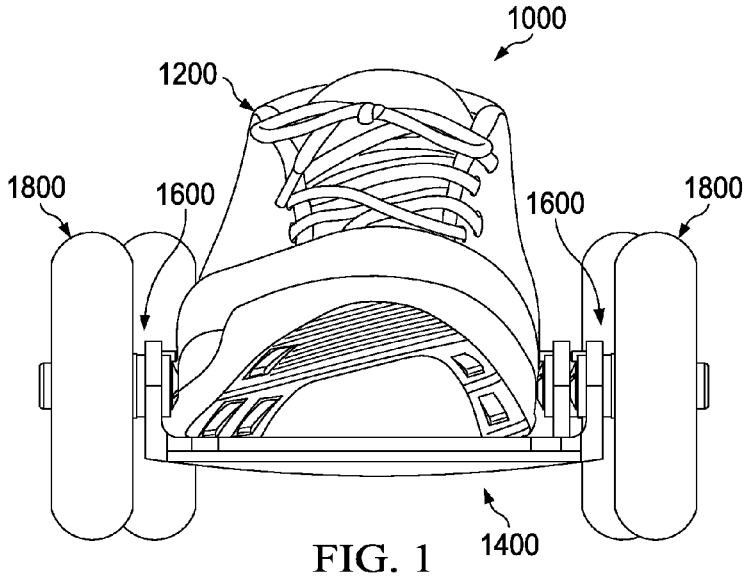
FIG. 1 is an orthogonal front view of a wearable device according to an embodiment of the disclosure.

Roger R. Adams, the sole inventor of the subject matter disclosed herein, is also the sole inventor of various patents including the previously issued U.S. Pat. No. 6,450,509 (hereinafter referred to as the '509 patent) which disclosed, inter alia, the innovative concept of providing a single wheel in the heel of a shoe. Some of the inventive concepts of the '509 patent are commercially sold under the United States trademark of "Heelys." In the present patent application, Roger R. Adams discloses a plurality of shortcomings of current roller devices and further discloses new and innovative subject matter that may be utilized to overcome the identified shortcomings as well as provide additional benefits and functionality described herein.

Some so-called "roller devices" provide features of a shoe integrated with one or more roller elements. Other roller devices may provide a means for attaching one or more roller elements to a user and/or to a shoe that may be worn by a user. In various manners, each of the above-described roller devices may be used to provide "roller transportation" in which the roller device itself, a user wearing the roller device, and/or an object and/or a user at least partially carried by the roller device is provided translational movement that is at least partially attributable to rolling one or more roller elements of the roller device. Roller transportation may be desirable for practical transportation of a user or an object carried by a roller device, recreational purposes, and/or competitive and/or sporting use of the roller device.

Roller transportation may serve a practical purpose of providing transportation of a user and/or an object carried by a roller device by accomplishing transportation of the user and/or object from a start location to an end location in a manner that is faster, requires less work, quieter, requires less supervisory attention, and/or is generally safer than other available and/or economical means of transportation. In some cases, a user may attach a roller device to the user's feet and perform roller transportation over a distance in less time than the same user could have otherwise traveled the distance without the aid of the roller device. In other cases, transportation of a user and/or object over a distance using a roller device may be accomplished using less physical work or energy. For example, a roller device may transport a user and/or an object downhill in a manner that allows a roller element of the roller device to take advantage of a gravitational potential energy of the user and/or the object to provide transportation using less physical work and/or energy. In other cases, roller transportation may provide quieter and/or smoother movement of a user and/or object due to a reduction in impact force used to effectuate translational movement of the user and/or object. In still other cases, transportation of a user and/or object may be provided in a manner that requires less supervisory attention as compared to other means of providing translational movement. For example, some roller devices may provide a resistance to allowing unintentional deviation from an initial direction of translational movement, thereby allowing the movement to occur with a reduced need for concern and/or oversight over iterative course corrections during the translational movement. In yet other cases, roller transportation may provide safer translational movement by generally maintaining a greater number of points of contact with the surface being traversed as opposed to alternative means of translational movement such as walking and/or running in which points of contact with the surface being traversed are cyclically established and eliminated. In other words, some forms of roller transportation may provide periods of translational movement, for example, but not limited to, so-called "coasting" during which a user may retain a broader base of support that may utilize multiple points of contact associated with each foot of the user and the ground surface being traversed. For example, in some cases, a user may traverse a ground surface by coasting without removing his feet from the ground surface. In such cases, in some embodiments, the user may accordingly generally maintain, for example, but not limited to, eight points of contact with the ground surface, four points of contact associated with each foot. During such coasting using some embodiments of roller devices disclosed herein, the user is not required to generally remove contact between either of his feet and the ground surface (the above-described cyclically established and eliminated points of contact) to continue traversing the ground surface. Further, roller transportation may provide an economic efficiency insofar as, for example, roller devices may be worn by wait staff at a restaurant to more quickly and/or efficiently service customers.

Roller devices may further provide roller transportation as a source of recreational transportation. For some users, roller transportation may be preferred over walking, running, and/or other means of translational movement so that a user of a roller device may enjoy easily traveling along a sidewalk, boardwalk, and/or a scenic route. Such recreational transportation, in some cases, may be accomplished through the use of so-called "traditional quad-type roller skates" and/or so-called "in-line skates". For other users, roller transportation made available by roller devices may present an attractive means of transportation where the skill required to use the roller device may be increasingly acquired as a skill that may be competitively pitted against another user's skill in roller transportation. For example, some users may enjoy speed racing using the roller devices, performing so-called "tricks" using the roller devices, and/or participating in competitions based on performing artistic body movements using the roller devices. It will be appreciated that, in some cases, commercial venues such as roller rinks and/or so-called "skate parks" may provide convenient locations for recreational and/or competitive roller transportation events. Further, the use of roller transportation may be employed as one of many components of a sport, such as the sport of so-called "roller derby".

While there are many roller devices that are wearable by a user and/or attachable to a user and/or a shoe of a user, much room for improvement remains. Some roller devices provide a user with a higher center of gravity that may lead to a higher risk and/or perceived higher risk of injury if the user were to fall. Similarly, roller devices that cause a user to have a higher center of gravity may increase a nervousness and/or anxiety of a user due to the perceived higher center of gravity and/or relative increased distance from the ground and/or surface being traversed. Some roller devices, such as in-line skates, may be considered by some users as being difficult to use and/or difficult to maneuver, uncomfortable for recreation, and/or not cool or fashionable. Still further, some roller devices, such as traditional quad-style skates, may be considered by some users as being too heavy, too slow, and/or too prone to result in a crash and/or fall in response to encountering common transportation obstacles. Further yet, some users may believe that durable, comfortable, acceptable performance, and/or aesthetically attractive roller devices are prohibitively expensive.

The systems and devices of this disclosure, in some embodiments, overcome one or more of the above problems related to roller transportation as well as other unlisted problems with conventional roller transportation devices. In some embodiments of this disclosure, a wearable device, such as, but not limited to, a skate, may be provided that combines the provision of a very low center of gravity for the skate and/or the user while also associating a unique independent suspension to one or more of the wheel assemblies of the skate. In some embodiments, the combined features may allow even an inexperienced skater to quickly learn to skate, in some cases, as a result of enjoying the lower center of gravity and the stability and maneuverability provided by the application of the independent suspensions. Still further, in some embodiments, because the skate comprises an aesthetically desirable shoe portion that is much more visually prominent than other mechanical components of the skate, the user can skate while maintaining a desired sense of fashion. In some embodiments, the skate may be a low profile skate that hugs closely to the ground without sacrificing skating performance or style.

In some embodiments of the wearable devices disclosed herein, such as, but not limited to, wearable devices 1000, 3000, the wearable devices 1000, 3000 may provide users of all skill levels of roller transportation and/or experience levels of roller transportation with a variety of features unavailable to a user in a single roller device previous to provision of the embodiments of this disclosure. For example, in some cases, an inexperienced and/or relatively unskilled roller device user may use wearable devices 1000, 3000 disclosed herein to obtain roller transportation skills and/or otherwise perform roller transportation with increased confidence as a result of a combination of the features disclosed herein. Particularly, in some cases, the improved lower centers of gravity, broader base of support relative to the ground surface 1008, and/or increased resistance to catastrophic falls related to encountering everyday roller transportation obstacles may convince an otherwise tepid user of roller devices that the wearable devices 1000, 3000 are safer and/or more enjoyable to use than other available roller devices. As described above, the lower centers of gravity may be, in some embodiments, attributable to the locations of clearance planes 1002, foot interface surfaces 1006, axes of rotation 1808, and/or other features of the wearable devices relative to each other and/or relative to the ground 1008. The broader base of support may be, in some embodiments, attributable to the relative locations of wheel assemblies 1800 and attachment systems 2000, 3006, 3120. Further, the increased resistance to falls may be, in some embodiments, at least partially attributable to the relative locations of one or more of the cavity axes 1412, suspension axes 1602, and the axes of rotation 1808 to each other. Still further, the increased resistance to falls and/or generally more enjoyable use of roller devices may be at least partially attributable to the overall nature of the substantially independent suspensions 1600 and/or the nature in which the floating axles 1652 rotate about the centers of rotation 1654. In some embodiments of the wearable devices 1000, 3000, the provision of wheel assemblies 1800 each having a separate axle and/or suspension 1600 may provide benefits over traditional roller devices comprising shared axle arrangements. By not requiring shared axle arrangements, the present invention and some embodiments of the wearable devices 1000, 3000 may provide forward/rearward offsetting of generally left/right opposing wheel assemblies 1800, the wheel assemblies 1800 may be associated with independent suspensions 1600, and the axes of rotation 1800 may be higher than the foot interface surface 1006 and/or the user's foot, each of these features contributing to a smoother, more stable, lower center of gravity roller device and allowing for improved roller transportation.

Still further, users having higher levels of skill in using roller devices and/or professional roller device users may enjoy the same features described above to achieve other performance related improvements in roller transportation using the roller devices and/or wearable devices 1000, 3000 disclosed herein. For example, the roller devices and/or wearable devices 1000, 3000 disclosed herein may enable a user to achieve, for example, but not limited to, higher rates of acceleration and/or deceleration, higher velocities, increased turning velocities and/or decreased turning radii, greater stability when performing tricks and/or jumps relative to the ground surface 1008 and/or other objects, and/or an increased ability for the user to withstand destabilizing forces applied to the user's body while the user is performing roller transportation. For example, a user may perform jam skating (in some cases, a combination of dance, gymnastics, and skating) using wearable devices 1000, 3000 and the components of the wearable devices 1000, 3000 may be specially selected to provide increased flexibility, shock absorption, and/or static stability to support successful body movements of a jam skater. In other embodiments, a wearable devices 1000, 3000 may be configured for use in sports, such as, but not limited to, roller derby sports in which competitors travel around a continuous loop track that is sometimes inclined and where direction of travel is sometimes generally limited to repetitive clockwise, or alternatively, counterclockwise travel. In some cases, wearable devices 1000, 3000 may comprise components configured to accommodate the above-described direction of travel along a track and/or an incline of a track by altering component geometry and/or component material composition differently in a left-right direction of a wearable device. Such alternative configurations may improve component life, increase user comfort, and/or otherwise provide superior turning and/or speed capabilities as compared to a roller device 1000, 3000 that is primarily configured for traversing a substantially flat and/or straight support surface.

In general, the roller devices and/or wearable devices 1000, 3000 disclosed herein may be well suited for wide acceptance by experienced and inexperienced roller device users alike. In some cases, the roller devices and/or wearable devices 1000, 3000 disclosed herein may provide roller device users with an otherwise unavailable form of exercise and/or recreation. In other cases, the roller devices and/or wearable devices 1000, 3000 disclosed herein may provide a sufficient increase in performance and/or desirable tangible physical and/or emotional sensations (for example due to one or more or combinations of the following characteristics: sensations at least partially attributable to the lower centers of gravity, the broad base of support, independent type suspension, off centered and/or staggered wheel placement, wheels and/or tires that are generally shaped as taller and narrower, athletic type shoe configuration, and/or a general increase in comfort and/or smooth ride) that infrequent or experienced users of roller devices may, of their own volition and in view of the availability of the roller devices and/or wearable devices 1000, 3000 disclosed herein, increase the frequency and/or duration of their participation in roller transportation activities.

Referring now to FIGS. 3-13, a preferred embodiment of a wearable device 3000 and compatible optional components and/or accessories are shown. The wearable device 3000 comprises a preferred attachment system 3006 (see FIGS. 3-8). FIGS. 9-13 disclose optional components and/or accessories compatible with attachment system 3006. To gain a full understanding of the wearable device 3000 and its compatible components and/or accessories, it is suggested that the detailed discussion of the wearable device 1000 first be reviewed in detail. Accordingly, the following discussion of the wearable device 1000 is provided below in advance of the detailed discussion of the wearable device 3000.

Accordingly, the discussion below and associated illustrative figures initially concentrate in great detail on the wearable device 1000. Most generally, the wearable device 1000 will be discussed below, first, as a whole to explain the major components of the wearable device 1000 and the most basic functionality of the wearable device 1000. Subsequently, the major components of the wearable device 1000 will be discussed individually in greater detail. Still later, additional functionality of the wearable device 1000 will be discussed prior to discussions of many methods of operating and/or using the wearable device 1000 and other systems.

This disclosure is organized to provide an understanding of the above-listed systems and methods through a step-wise detailed discussion of an embodiment of a wearable device 1000 according to the present disclosure. It will be appreciated that the discussion of the wearable device 1000 does not proscribe the entire disclosure, but rather, serves as a specific embodiment of a system according to the disclosure against which many systems and methods of this disclosure may be relatively discussed. For example, in one embodiment discussed in great detail, a wearable device 1000 comprising features of a shoe associated with roller elements is disclosed. In some embodiments, the wearable device 1000 may generally comprise what may be described as a shoe removably attached to a frame. In some embodiments, the frame may serve to join the shoe to one or more roller elements. Further, in some embodiments of the wearable device 1000, one or more of the roller elements may be attached to the frame via a suspension. It will be appreciated the inventive aspects of the systems and methods disclose herein are not limited to merely the sum of all of the parts of the embodiments disclosed, but rather, the inventive nature of some embodiments may additionally be accounted for by the methods in which the component parts of the embodiments interact relative to each other.

Referring now to FIGS. 1, 2, and 14-19, an embodiment of a wearable device 1000 is shown in a fully assembled state. As shown, the wearable device 1000 is generally well suited for use in conjunction with a right foot of a human user. Accordingly, as a matter of convention for use herein, the wearable device 1000 is described below using the hypothetical perspective of a human user who is wearing the wearable device 1000 on his right foot, standing upright on his own two feet, feet laterally spread about shoulder width apart, and is looking down toward the wearable device 1000 from a position vertically above the wearable device 1000 (i.e., a so-called "dorsal" view of the wearable device 1000). As such, relative positional terms such as above, below, forward, backward, leftward, and rightward (and their commonly understood equivalents) should be interpreted considering the above-described hypothetical perspective so that: above generally means vertically higher and/or vertically closer to the eyes of a user in the above-described hypothetical position, below generally means vertically lower and/or vertically further from the eyes of a user in the above-described hypothetical position, forward generally means relatively further in an anterior direction of the user, backward generally means relatively further in a posterior direction of the user, leftward (or inner) generally means closer to a centerline of the user's body, and rightward (or outer) generally means further away from the centerline of the user's body. Further, the term, "surface," may be used to describe a three-dimensional space curve. It will be appreciated that some of the surfaces described in this disclosure may be associated with physical components that are flexible and/or compressible in response to exposure to forces anticipated during so-called normal use of the physical components. Therefore, unless otherwise specified, the term, "surface," should be interpreted as generally defining a variable space curve boundary (i.e., due to flexure and/or compression) of a physical component rather than representing a fixed-shape space curve.

Wearable device 1000 may be described as a wearable roller device configurable to selectively provide roller transportation. Most generally, wearable device 1000 comprises a shoe 1200, a frame 1400 configured for selective attachment to the shoe 1200, and a plurality of suspensions 1600 selectively configurable to attach a plurality of wheel assemblies 1800 to the frame 1400. In a broad sense, the wearable device 1000 may accept a foot of a user of the wearable device 1000 into the shoe 1200 and the wearable device 1000 may provide roller transportation to a user in response to rotation of one or more of the wheel assemblies 1800. Although only one shoe 1200 is shown, this disclosure anticipates that a second shoe for a user's left foot may be worn concurrently while the user wears the shoe 1200 on the user's right foot. In some embodiments, the second shoe may be configured to appropriately accommodate typical anatomical differences between the user's left foot and the user's right foot. Still further, the second shoe may, in some embodiments, be associated with a second frame (in some embodiments, similarly configured to appropriately accommodate typical anatomical differences between the user's left foot and the user's right foot) and/or a second plurality of wheel assemblies 1800, and/or a second plurality of suspensions 1600.

Figure 2:
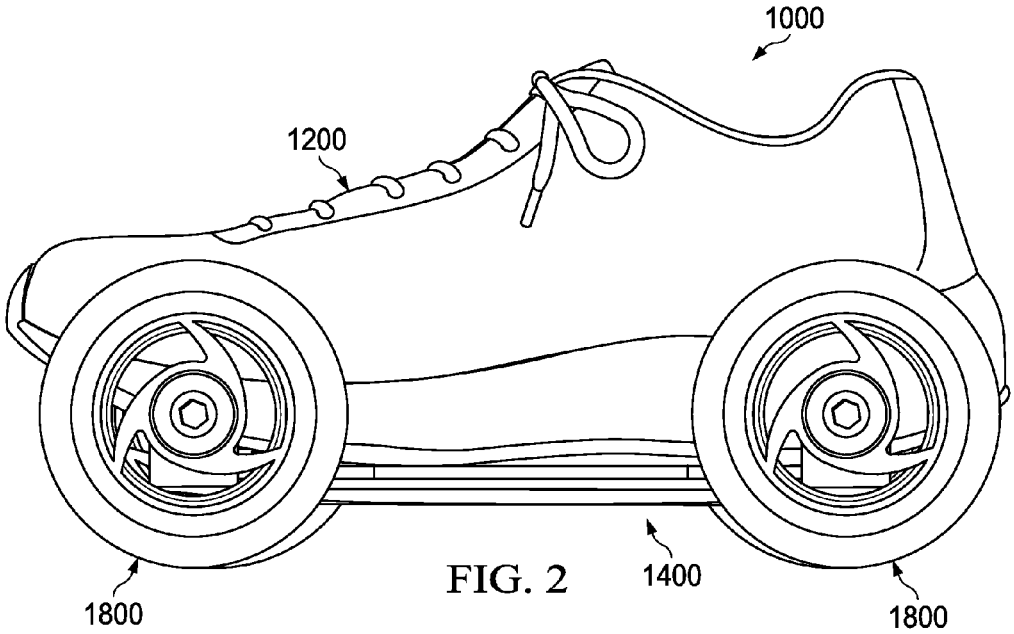
FIG. 2 is an orthogonal left view of the wearable device according to FIG. 1.

In this embodiment, the shoe 1200 comprises an upper 1202, a sole 1204, and a heel counter 1206. The upper 1202 is generally more flexible than the sole 1204 and comprises a toebox 1208 to contain and/or protect toes of a user. The upper 1202 also comprises a vamp 1210 and a tongue 1212 configured to selectively cover a medial portion of the user's foot. The vamp 1210 and the tongue 1212 may selectively be restrained in position relative to the user's foot through the use of laces 1214 and/or an optional strap 1216. In this embodiment, the strap 1216 comprises a hook and loop type fastener material configured for selective attachment to compatible hook and loop type fastener material of an optional strap landing 1218. The strap 1216 and strap landing 1218 are not included in some embodiments and wearable device 1000 is shown in FIGS. 1 and 2 without the strap 1216 and the strap landing 1218. In this embodiment, the tongue 1212 may further be positionally restrained by elastomeric tongue restrainer 1220 (see FIG. 35).

The sole 1204 comprises a removable insole 1222 that may contact a bottom of the user's foot and/or sock worn on the user's foot. The sole 1204 further comprises an outsole 1224 that generally serves as a lowest portion of the shoe 1200. The sole 1204 additionally comprises midsole 1226 generally sandwiched between the removable insole 1222 and the outsole 1224. The midsole 1226 may comprise material and/or structural elements selected to provide a balance between support, stability, and cushioning. The outsole 1224 may generally be more resistant to wear and/or abrasion since the outsole 1224 may, in some embodiments, selectively contact a ground surface. The outsole 1224 may further comprise tread protrusions 1228 that may extend downward from a primary tread surface 1230.

The sole 1204 may further comprise an optional sole cavity 1232, in this embodiment, represented generally as a portion of the sole 1204 with a reduced amount of midsole 1226 above the outsole 1224. In some embodiments, the sole cavity 1232, may be located elsewhere within the sole 1204 and/or may be provided with a pressurized fluid and/or interchangeable insert, each of which may change one or more of the support, stability, and cushioning provided by the sole 1204. The sole cavity 1232 is not included in some embodiments and wearable device 1000 is shown in FIGS. 1 and 2 without the sole cavity 1232. In some embodiments, sole 1204 may be described as comprising a front sole 1234 and a rear sole 1236 connected by an intermediate sole 1238. While the intermediate sole 1238 generally comprises only small portions of outsole 1224, in other embodiments, a sole 1204 may an intermediate sole 1238 comprising no outsole 1224 which may cause the sole 1204 to appear as comprising primarily a front sole 1234 and a rear sole 1236. Still further, a front portion of the sole 1204 may comprise a relatively thicker mass of material near the front of the shoe 1200, which may serve as a so-called front bumper 1246. In some embodiments, the front bumper 1246 may comprise material different from material of the outsole 1224.

The heel counter 1206 of the shoe 1200 may be provided to wrap around the back of a user's heel to stabilize the heel and/or aid in motion control. The heel counter 1206 may comprise ergonomic features to prevent uncomfortable interference with the user's foot and/or ankle. For example, in some embodiments, the heel counter 1206 may comprise an inner ankle profile 1240, an outer ankle profile 1242, and/or an achilles tendon profile 1244. Profiles 1240, 1242, and 1244 may allow a user's foot to move and/or rotate about the ankle with a reduced chance of causing blistering and/or other pressure injury to the user's foot. The profiles 1240, 1242, and 1244 may also prevent blistering and/or other injury that may otherwise result from varying degrees of foot and/or ankle displacement relative to the shoe 1200 during use of the wearable device 1000.

In FIGS. 1, 2, and 14-19, the shoe 1200 is generally attached to the frame 1400. The frame 1400 may be generalized as comprising an interface 1402 for attachment to the shoe 1200. The interface 1402 may be described as comprising a generally centrally located trunk 1404 from which a plurality of branches 1406 each extend slightly beyond an outer profile 1248 of the sole 1204 as viewed from above. From the distal ends of each branch 1406, in this embodiment, somewhat pillow block housing shaped suspension blocks 1408 extend vertically upward alongside the shoe 1200. In this embodiment, each suspension block 1408 comprises a suspension cavity 1410 (see FIG. 32) formed substantially as a through hole. Each suspension cavity 1410 may comprise a cavity axis 1412 that generally represents a central axis of the suspension cavity 1410. In some embodiments, as will be discussed in great detail below, each suspension cavity 1410 may independently carry a suspension 1600.

In some embodiments, the components of suspensions 1600 may be substantially disposed along a suspension axis 1602. In some embodiments, dependent upon the magnitude and direction of forces applied to the wearable device 1000 as discussed in greater detail below, the suspension axes 1602 may lie substantially coaxial with the respective associated cavity axes 1412.

In some embodiments, each suspension 1600 may independently connect a wheel assembly 1800 to a suspension block 1408. Most generally, each wheel assembly 1800 may comprise a substantially cylindrical wheel hub 1802 that is substantially circumferentially enveloped by a tire 1804. In some embodiments, each wheel hub 1802 may comprise a substantially central bore 1806 that, in some embodiments, is a through hole extending through the wheel hub 1802. In some embodiments, each wheel assembly 1800 may comprise an axis of rotation 1808 that generally represents a central axis of the bore 1806. Wheel assemblies 1800 may generally be configured for rotation about their respective axes of rotation 1808, which in some embodiments, may provide the above-described rotational transportation. Accordingly, the wheel assemblies 1800 may be referred to as the so-called roller elements that, in some embodiments, may generally enable the wearable device 1000 to provide the above-described roller transportation. In some embodiments, dependent upon the magnitude and direction of forces applied to the wearable device 1000 as discussed in greater detail below, the axes of rotation 1808 may lie substantially coaxial with their respective associated suspension axes 1602 and/or cavity axes 1412. In some embodiments, the tire 1804 may comprise a generally commercially available tire that has been altered through the reduction of a leftward/rightward thickness of the tire 1804 in a localized manner that may leave a central neck and/or support hub of tire material.

FIGS. 1, 2, and 14-19 show the wearable device 1000 in a substantially "unloaded state". FIGS. 1 and 2 provide substantially the same view as FIGS. 16 and 18, respectively, but are provided with fewer reference numbers to provide clearer views of the wearable device 1000. The unloaded state may generally be defined as a state in which the wearable device 1000 maintains a physical orientation, shape, and/or form that is (1) primarily the result of forces attributable to the gravitational weight of the elements of the wearable device 1000 and/or (2) primarily the result of mechanical biasing of the elements of the wearable device 1000 without continued application of external forces. In other words, the unloaded state of the wearable device 1000 may be described as the physical state in which the wearable device 1000 persists absent the application of external forces and absent substantial changes to the wearable device 1000 due to previous use, wear, and/or breakage.

The wearable device 1000 may be described as comprising a plurality of reference planes and/or surfaces that may vary in position based on whether the wearable device 1000 is in the above-described unloaded state. In some cases, the wearable device 1000 may be in a "loaded state" where external forces (excepting gravitational forces) are applied to the wearable device 1000. In other cases, the wearable device 1000 may be in a "used state" in which a physical orientation, shape, and/or form of the wearable device 1000 varies from the unloaded state due to previous use, wear, and/or breakage. In still other cases, the wearable device 1000 may be in both the loaded state and the used state simultaneously. Accordingly, reference planes and/or surfaces may vary greatly in position in response to the magnitude and direction of external forces applied to the wearable device 1000 and/or in response to previous use, wear, and/or breakage. Unless otherwise specified, the term, "ground," may be used to signify a substantially planar surface upon which the wearable device 1000 may rest and/or over which the wearable device 1000 may be translationally moved. In some cases, the translational movement may be attributable to rotating one or more of the wheel assemblies 1800 while substantially prohibiting sliding of the wheel assemblies 1800 relative to the ground.

In some embodiments, the wearable device 1000 in an unloaded state may comprise a clearance plane 1002 that is substantially parallel to the ground and coincident with a lowest portion of the wearable device 1000 (excepting the wheel assembly 1800). Most generally, the distance between the clearance plane 1002 and the ground may be generalized as a minimum clearance distance of the wearable device 1000. In FIGS. 1, 2, and 14-19, the clearance plane 1002 lies generally coincident with a lowest portion of the frame 1400. In some embodiments, the wearable device 1000 in an unloaded state may comprise a rotation plane 1004 that is substantially parallel to the ground and coincident one or more axes of rotation 1808 of the wearable device 1000. In FIGS. 1, 2, and 14-19, the rotation plane 1004 lies coincident with all four axes of rotation 1808. In some embodiments, the wearable device 1000 may comprise a foot interface surface 1006 which may be defined as the surface against which a bottom of a foot of a user generally contacts when the user's foot is generally inserted into the shoe 1200 in substantially the same manner as the user's foot would normally be inserted into a conventional shoe substantially similar to shoe 1200 for the purpose of standing, walking, and/or running. In FIGS. 1, 2, and 14-19, the foot interface surface 1006 may generally be described as being substantially coincident with an uppermost surface of the insole 1222.

The above-described reference planes and surfaces are useful in explaining how, in some embodiments, the wearable device 1000 may be configured to provide roller transportation while also providing a reduced space and/or distance between the ground and the foot interface surface 1006. Because the foot interface surface 1006 is a substantially complicated space curve, such reduced space and/or vertical distance between the ground and the foot interface surface 1006 may be more easily conceptualized as reducing one or more of: a maximum vertical distance between the ground and the foot interface surface 1006, an average and/or integrated vertical distance between the ground and the foot interface surface 1006, and a volume of space between the ground and the foot interface surface 1006. Further, each of the above-described reduced spaces and/or vertical distances, when evaluating the wearable device 1000 in a loaded state, may be measured as further reduced by accounting for only the portions of the foot interface surface 1006 that are in actual contact with the bottom of the user's foot. At least partially as a result of reducing the above-described spaces and/or vertical distances, in some embodiments, the wearable device may provide a vertically lower center of gravity of the wearable device 1000 itself. Similarly, and perhaps in some embodiments more importantly, the wearable device 1000 may provide a user who is wearing the wearable device 1000 a vertically lower center of gravity of the user, for example, as compared to the centers of gravity provided by other roller devices that provide roller elements such as wheel assemblies and/or tires entirely below at least a portion of a foot interface surface of the other roller devices.

In FIGS. 1, 2, and 14-19, the above-described reduced spaces and/or vertical distances may be chosen generally as a compromise of factors including a desired minimum clearance distance of the wearable device 1000, a desired overall wheel assembly 1800 diameter, desired sole 1204 properties, a desired orientation of the foot interface surface 1006 relative to the ground, a desired vertical distance of the center of gravity of the wearable device 1000 relative to the ground, and a desired vertical distance of the center of gravity of a user wearing the wearable device 1000 relative to the ground. As an extreme example, in some embodiments, a wearable device 1000 may be provided with negligible clearance distance, very small overall wheel assembly 1800 diameter, little or no sole 1204 thickness, and a substantially planar foot interface surface 1006. It will be appreciated that while such an embodiment is contemplated by this disclosure as being capable of providing very low centers of gravity (for each of the wearable device 1000 itself and the user of the wearable device 1000), some practical applications of the wearable device 1000 may require at least some variance from one or more the above-listed substantially minimalized example design parameter sets.

Most generally, FIGS. 1, 2, and 14-19 show a wearable device 1000 well suited for being worn by a user on the user's right foot. It will be appreciated that a substantially similar wearable device may be provided substantially as a mirror image of the wearable device 1000 (the mirror image being generated relative to a midline plane of the user). Of course, the mirror image version of the wearable device 1000 may be well suited for being worn by a user on the user's left foot. Accordingly, this disclosure provides a plurality of embodiments of wearable devices so that a user of the wearable devices may wear wearable devices on each of the user's feet to selectively provide the user with roller transportation and where each of the worn wearable devices substantially comprises the features of wearable device 1000.

In some embodiments, a wearable device 1000, in the unloaded state, may comprise one or more so-called translation planes 1010. In the embodiment shown in FIGS. 1, 2, and 14-19, each wheel assembly 1800 is associated with a separate translation plane 1010. In some embodiments, each separate translation plane 1010 may be substantially orthogonal to the ground 1008, substantially parallel to other translation planes 1010 of the wearable device 1000, and may extend generally in a planar manner in forward, rearward, upward, and downward directions. In some embodiments, one or more of the translation planes 1010 may lie substantially orthogonal to one or more of the cavity axes 1412, the suspension axes 1602, and/or the axes of rotation 1808. In some embodiments, one or more of the translation planes 1010 may substantially bisect one or more of the wheel assemblies 1800. For example, in some embodiments, a translation plane 1010 may vertically bisect a tire 1804 and/or a wheel hub 1802. In such embodiments where a wearable device 1000 is substantially in an unloaded state, the above-described provision of multiple translation planes 1010 associated with wheel assemblies 1800 may, in response to a forward or rearward perturbation of the wearable device 1000, provide translational movement of the wearable device 1000 in a forward or rearward direction, respectively. The direction of the translational movement may be substantially aligned with the forward and rearward extension directions of the one or more translation planes 1010. In some embodiments, the provision of multiple wheel assemblies 1800 being associated with parallel translation planes 1010 may provide easy straight path translational movement of the wearable device 1000 at least while the wearable device 1000 is in an unloaded state.

Referring now to FIGS. 20-24, an embodiment of the frame 1400 is shown in greater detail and as removed from the shoe 1200. As more clearly shown, the frame 1400 comprises the interface 1402 that generally serves to selectively join one or more of the wheel assemblies 1800 to the shoe 1200 via one or more of the suspensions 1600. In some embodiments, the interface 1402 may refer to substantially only the portions of the frame 1400 necessary to adequately transfer forces between the wheel assemblies 1800 connected to the frame 1400 and shoe 1200 connected to the frame 1400. In other words, in some cases, the frame 1400 may comprise features and/or materials in excess of those required to sufficiently perform the above-described transfer of forces between the shoe 1200 and the one or more wheel assemblies 1800. In the embodiment shown, the frame 1400, as viewed from above and/or below, generally comprises an X-shaped profile comprising a trunk 1404 that is generally centrally located and serves to join each of the four shown branches 1406 that extend from the trunk 1404. In this embodiment, the trunk 1404 may comprise a hypothetical midline plane 1414 that is substantially perpendicular to the ground 1008 but may not be substantially parallel to one or more of the translation planes 1010. Put another way, in the embodiment shown in FIGS. 20-24, the trunk 1404 may lie generally askew as compared to the forward/rearward direction of the wearable device 1000. More particularly, it is most clearly shown in FIG. 21 that the trunk 1404 may extend slightly increasingly in a rightward direction along the length of the frame 1400 from back to front of the frame 1400.

Figure 21:
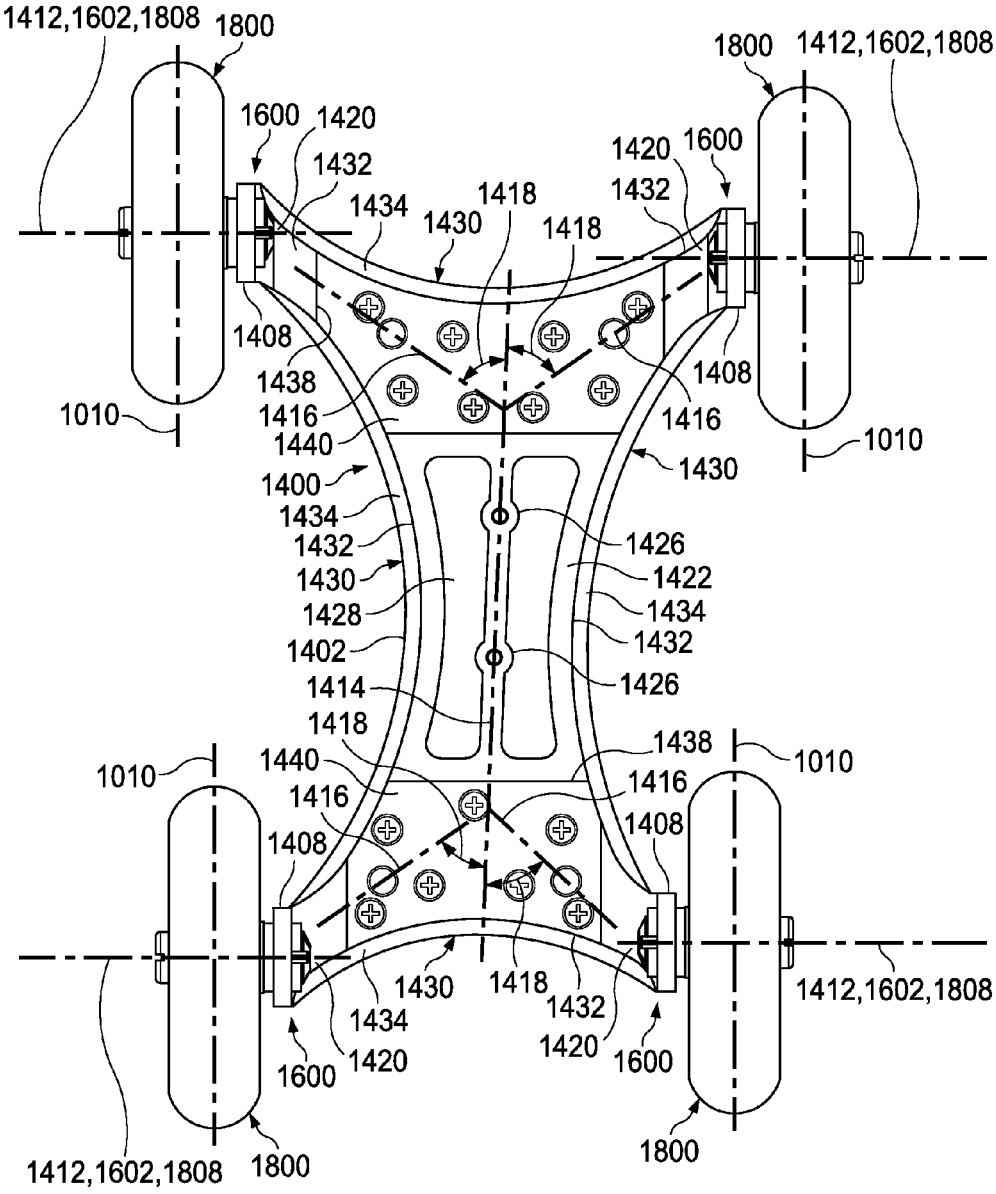
FIG. 21 is an orthogonal top view of the frame of FIG. 20.
Figure 22:
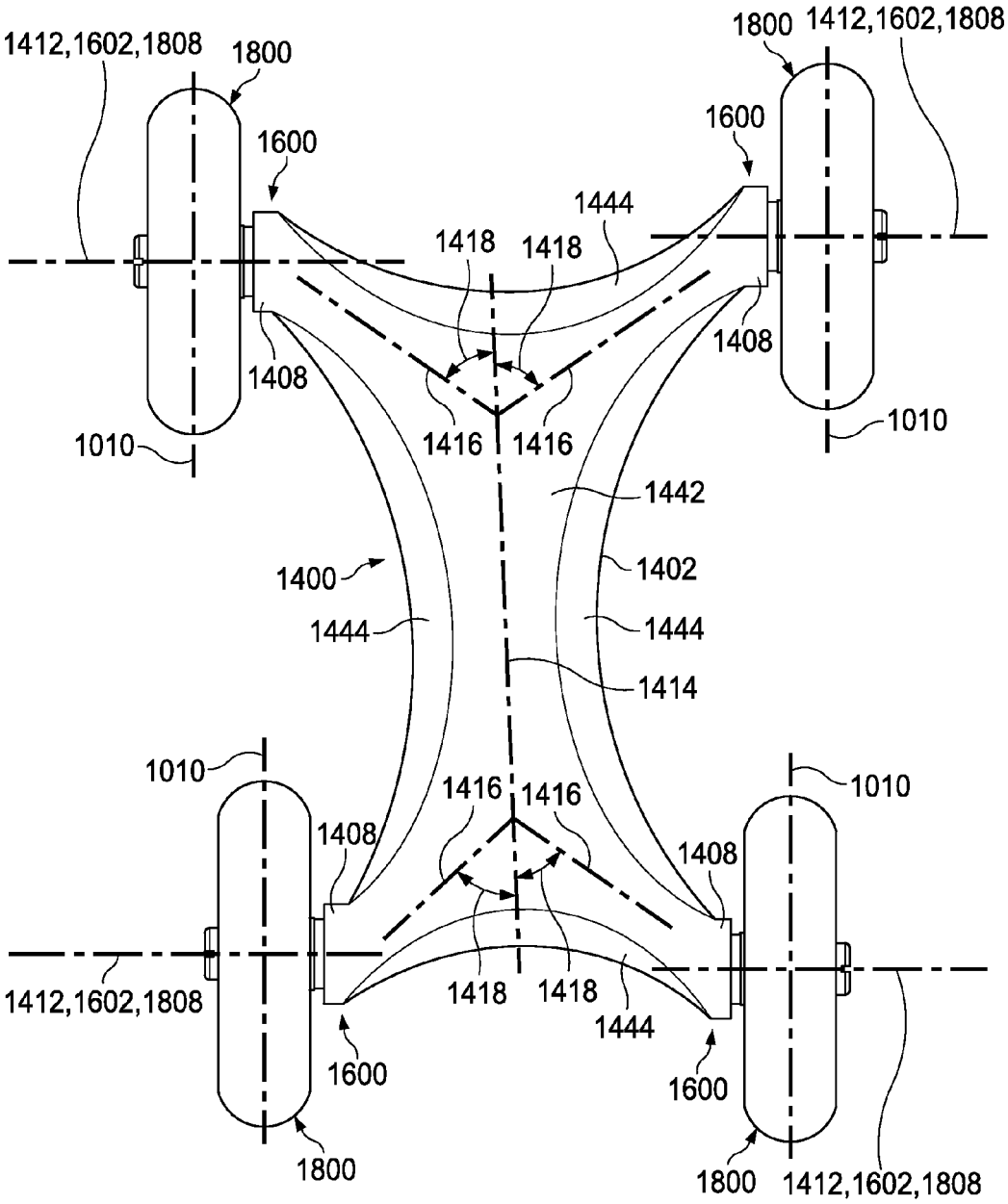
FIG. 22 is an orthogonal bottom view of the frame of FIG. 20.
Figure 23:
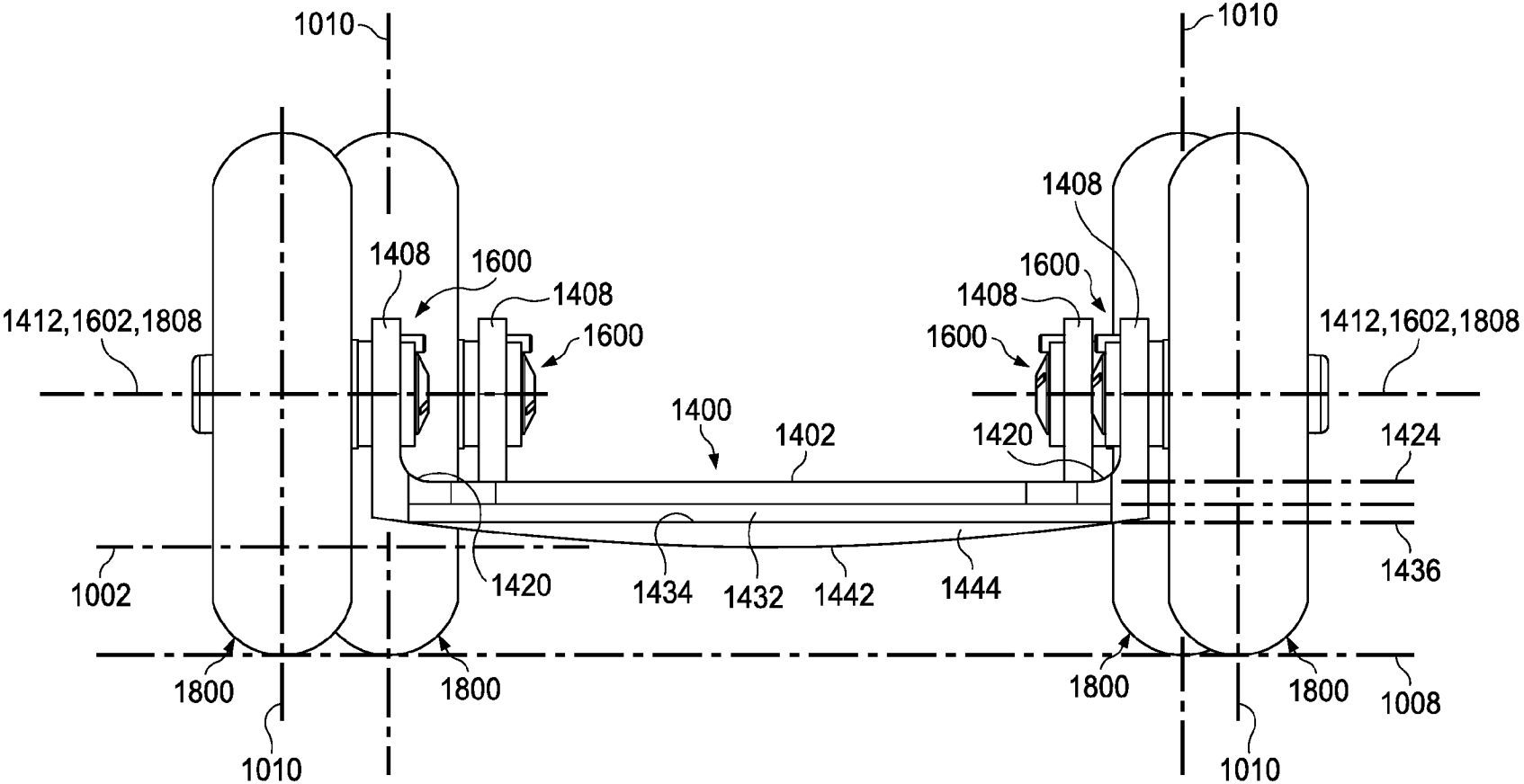
FIG. 23 is an orthogonal front view of the frame of FIG. 20.
Figure 24:
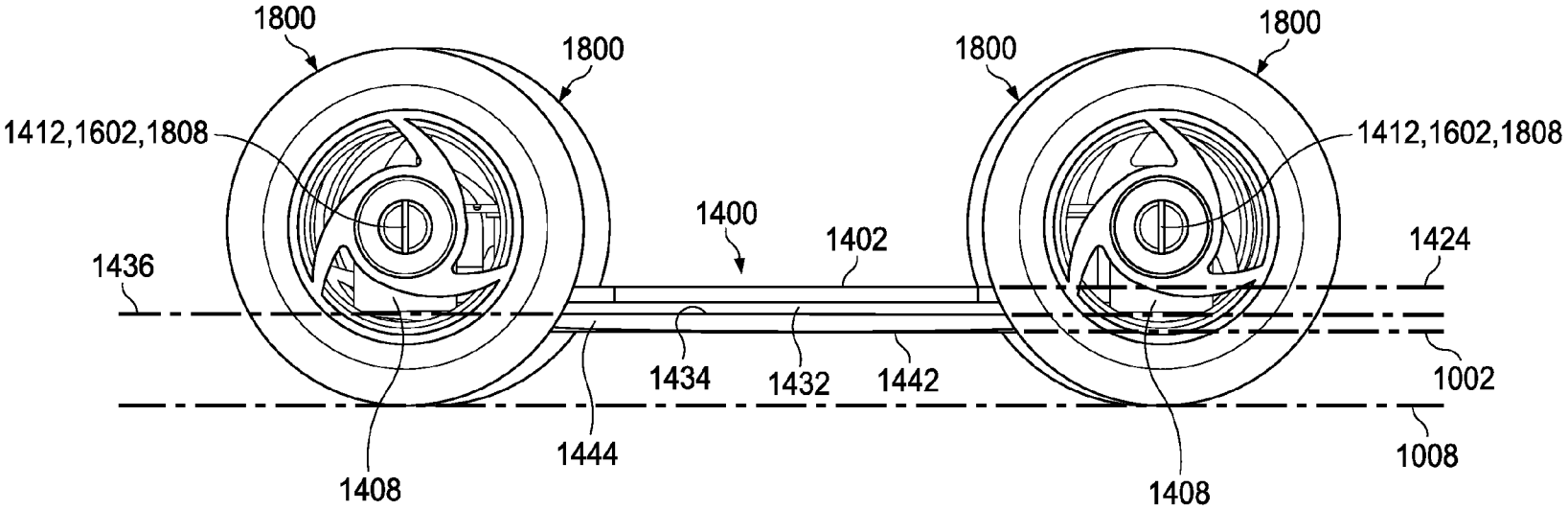
FIG. 24 is an orthogonal side view of the frame of FIG. 20.

In some embodiments, the branches 1406 may extend, as viewed from above and below, from the trunk 1404 to form the distal ends of the above-described X-shaped profile. In some embodiments, the branches 1406 may each comprise a hypothetical branch midline plane 1416 that is substantially perpendicular to the ground 1008 and that generally intersects the trunk midline plane 1414 with an outer angle 1418. In some embodiments, each outer angle 1418 may comprise a different value which may indicate that one or more of the branches 1406 are not similarly angled toward the trunk midline plane 1414. Considering the above-described variation in outer angle 1418 values and considering that each branch may comprise a different overall length, it follows that the distal ends of each branch 1406 may be generally offset from the trunk midline plane 1414 by a distance that is different from the offset distances of the distal ends of other branches 1406. In the frame 1400 shown in FIGS. 20-24, each overall branch 1406 length is different from the other overall branch 1406 lengths. More particularly, and as best shown in FIG. 21, the overall branch 1406 lengths may be listed in order of increasing overall branch 1406 length as rear-right branch 1406 (the shortest), rear-left branch 1406, front-right branch 1406, and front-left branch 1406 (the longest). Overall branch 1406 lengths may be generalized, in some embodiments, as being proportionally related to a distance measured between the trunk midline plane 1414 and an interface between the branch 1406 and the suspension block 1408 of a branch 1406.

In some embodiments, the suspension blocks 1408 of a frame 1400 may comprise a substantially block-shaped vertical extension rising from an associated branch 1406. In the embodiment shown in FIGS. 20-24, an uppermost surface of the suspension blocks 1408 comprise a substantially semicircular profile. In some embodiments, the semicircular profile of the suspension blocks 1408 may be substantially concentrically aligned with associated cavity axes 1412.

In some embodiments, structurally supportive webs 1420 may be used to join the suspension blocks 1408 to the associated branches 1406 in a manner that bolsters a stiffness of the connection and/or increases a service life of the wearable device 1000 by increasing a resistance of the frame 1400 to fatigue failure. The webs 1420 of the embodiment shown are substantially shaped as wedge like portions of material connected between the suspension blocks 1408 and an upper interface surface 1422 that generally spans uppermost portions of the trunk 1404 and the branches 1406 substantially coincident with what may be referred to as an uppermost interface plane 1424. In some embodiments, the upper interface surface 1422 and/or the uppermost interface plane 1424 may comprise the portion of the trunk 1404 and/or branches 1406 that extend vertically highest and/or into a vertically highest contact between the shoe 1200 and the interface 1402, trunk 1404, and/or branches 1406. In some embodiments, a thickness and/or shape of the webs 1420 may be selected in response to a length and/or a cross-sectional shape and/or thickness of a branch 1406.

The interface 1402, the trunk 1404, and/or the branches 1406 may comprise features primarily attributable to the existence of indentions and/or concavities formed into the frame 1400. In some embodiments, the frame 1400 may comprise piece mounts 1426 that may serve to receive fasteners (i.e., in some embodiments, threaded fasteners such as screws) and/or other physical retaining devices useful for holding the frame 1400 during manufacturing and/or other handling of the frame 1400. In some embodiments, the piece mounts 1426 may lie substantially along the trunk midline plane 1414. In some embodiments, the frame 1400 may comprise mass reduction cavities 1428 formed in one or more of the interface 1402, the trunk 1404, and/or the branches 1406. In some embodiments, mass reduction cavities 1428 may be formed substantially along a length of the trunk 1404 and/or at least partially parallel to the trunk midline plane 1414. In some embodiments, reducing the overall mass of the frame 1400 may provide a wearable device 1000 with a lower weight and/or lower associated cost.

In some embodiments, the frame 1400 may comprise so-called outer profile steps 1430 along an outer perimeter of the frame 1400 as viewed from above. In some embodiments, each outer profile step 1430 may comprise a generally vertically upright wall 1432 and an associated ledge 1434. In some embodiments, the upright walls 1432 may follow a curvilinear path (for example, when viewed from above) while each of the ledges 1434 may lie substantially flat and/or parallel and/or substantially coincident with a ledge plane 1436 that is substantially parallel to the ground 1008 and/or substantially parallel to the uppermost interface plane 1424.

In some embodiments, the frame 1400 may comprise plate indentions 1438 formed in the interface 1402, the trunk 1404, and/or one or more of the branches 1406. The plate indentions 1438 may, in some embodiments, provide a recess of the frame 1400 into which one or more cover plates 1440 may be at least partially received. In some embodiments, an uppermost surface of a cover plate 1440 may lie substantially parallel with the uppermost interface plane 1424. Accordingly, in some embodiments, an uppermost surface of the cover plate 1440 may contact the shoe 1200 in a manner substantially similar to the manner in which upper interface surface 1422 may contact the shoe 1200. As discussed in greater detail below, the cover plate 1440 may selectively retain elements of an attachment system 2000 that, most generally, may provide selective attachment and/or detachment of the shoe 1200 relative to the frame 1400.

In some embodiments, an interface bottom surface 1442 may generally comprise bottom surfaces of the trunk 1404 and/or one or more bottom surfaces of the branches 1406. In some embodiments the interface bottom surface 1442 may generally comprise a convex surface extending downward toward the ground 1008. In some embodiments, a lowermost portion of the interface bottom surface 1442 may lie coincident with the clearance plane 1002. In some embodiments, the interface bottom surface 1442 may be joined to one or more of the outer profile steps 1430 by one or more transition surfaces 1444. In some embodiments the transition surfaces 1444 may form crenellation-like concave indentions spanning between the interface bottom surface 1442 to one or more ledges 1434.

In some embodiments, including the embodiment shown, the frame 1400 may comprise an overall shape and/or may locate the interface 1402, the trunk 1404, and/or the branches 1406 in a manner well suited for supporting the weight of a user of the wearable device 1000 and/or for transferring forces between the wearable device 1000 and the ground 1008 and/or any other suitable surface or object. For example, in some embodiments, the branches 1406 may be positioned so that when the frame 1400 is attached to the shoe 1200 and when a user's foot is properly inserted into the shoe 1200, the branches 1406 may each be associated with portions of the user's foot that may likely be used to transfer forces to the wearable device 1000.

In the embodiment shown, a portion of the front-left branch 1406 of the frame 1400 may be located below a primary point of force transfer of a user's foot. In particular, a portion of the front-left branch 1406 may be located, for example, but not limited to, below and/or in the vicinity of a distal portion of the innermost metatarsal bone of the user's foot, a proximal portion of the innermost proximal phalanges bone of the user's foot, and/or a portion of the joint between innermost metatarsal bone of the user's foot and the innermost proximal phalanges bone of the user's foot. Similarly a portion of the front-right branch 1406 may be located, for example, but not limited to, below and/or in the vicinity of a distal portion of the outermost metatarsal bone of the user's foot, a proximal portion of the outermost proximal phalanges bone of the user's foot, and/or a portion of the joint between the outermost metatarsal bone of the user's foot and the outermost proximal phalanges bone of the user's foot. Put another way, the front-left branch 1406 may be located below a left portion of the so-called "ball" of the user's foot. Similarly, the front-right branch 1406 may be located below a right portion of the ball of the user's foot. Further, in the embodiment shown, a portion of the rear-left branch 1406 of the frame 1400 may be located below, in the vicinity of, and/or adjacent to an inner portion of the calcaneus bone and/or so-called "heel" bone of the user's foot as viewed from above. Similarly, in the embodiment shown, a portion of the rear-right branch 1406 of the frame 1400 may be located below, in the vicinity of, and/or adjacent to an outer portion of the calcaneus and/or heel bone of the user's foot as viewed from above. It will be appreciated that the above-described locations of the features of the frame 1400 relative to a user's foot that is inserted into the shoe 1200 that is connected to the frame 1400 may provide improved and/or efficient force transfer paths for forces that may be transferred between the user's foot and the wheel assemblies 1800.

In some embodiments, because the suspension blocks 1408 are substantially carried by the branches 1406, it follows that the forward/rearward directionality locations of suspension blocks 1408 relative to each other is dependent upon the physical layout of the branches 1406. In the embodiment shown, the suspension blocks 1408 and more particularly the cavity axes 1412 of the suspension cavities 1410 may not be aligned in a conventional manner. For example, in the embodiment shown, the front-left cavity axis 1412 is not aligned with the front-right cavity axis 1412. Instead, the front-left cavity axis 1412 is located relatively forward of the front-right cavity axis 1412. Further, in the embodiment shown, the rear-left cavity axis 1412 is located relatively rearward of the rear-right cavity axis 1412. Nonetheless, in this embodiment, while the front cavity axes 1412 are not aligned in the forward/rearward directionality and while the rear cavity axes 1412 are not aligned in the forward/rearward directionality, all four cavity axes 1412 lie substantially coincident with the above-described rotation plane 1004 while the wearable device 1000 is in an unloaded state.

Further, in the embodiment shown, the suspensions 1600 associated with each of the four branches 1406 are substantially similar and the wheel assemblies 1800 associated with each of the four branches 1406 are substantially similar. Accordingly, and because the suspension blocks 1408 are substantially carried by the branches 1406, it follows that the leftward/rightward directionality locations of translation planes 1010 relative to each other is dependent upon the physical layout of the branches 1406. In the embodiment shown, the front-left translation plane 1010 is not aligned with and/or coplanar with the rear-left translation plane 1010. Instead, the front-left translation plane 1010 is located relatively leftward of the rear-left translation plane 1010. Further, in the embodiment shown, the front-right translation plane 1010 is not aligned with and/or coplanar with the rear-right translation plane 1010. Instead, the front-right translation plane 1010 is located relatively rightward of the rear-right translation plane 1010. Further, in the embodiment shown, the front translation planes 1010 are separated by a separation distance greater than the separation distance between the rear translation planes 1010. Also in this embodiment, the rear translation planes 1010 may be bounded by the front-left translation plane 1010 on the left and bounded by the front-right translation plane 1010 on the right. In some embodiments, such an arrangement may lead to a wider and/or more stable set of front force transfer paths (via the front wheel assemblies 1800) between the wearable device 1000 and a ground as compared to the set of rear force transfer paths (via the rear wheel assemblies 1800). In this embodiment, while the left translation planes 1010 are not coplanar with each other and while the right translation planes 1010 are not coplanar with each other, all four translation planes 1010 are substantially parallel to each other while the wearable device 1000 is in an unloaded state.

In some embodiments, one or more of the cavity axes 1412, suspension axes 1602, and/or axes of rotation 1808 may project through a user's foot that is properly inserted into the shoe 1200. However, in alternative embodiments, one or more of the cavity axes 1412, suspension axes 1602, and/or axes of rotation 1808 may not project through a user's foot that is properly inserted into the shoe 1200. In some embodiments, one of the above-described axes 1412, 1602, 1808 projecting through a user's foot may be a function of a wearable device 1000 having a so-called low profile that is not prevented from allowing an inserted foot of a user to be closer to the ground 1008 than one or more of the axes 1412, 1602, 1808. Accordingly, in cases where one or more of the axes 1412, 1602, 1808 project through a user's foot while the wearable device 1000 is in an unloaded state, it is clear that the one or more of the axes 1412, 1602, 1808 projecting through the user's foot must also project through the foot interface surface 1006. Of course, in some embodiments, one or more of the axes 1412, 1602, 1808 may not project through the foot interface surface 1006 while the wearable device 1000 is in an unloaded state but in those same embodiments, placing the wearable device 1000 in a loaded and/or used state may cause one or more of the axes 1412, 1602, 1808 to project through the foot interface surface 1006. Such projection through the foot interface surface 1006 may be attributable to flexure and/or compression of one or more component of the wearable device 1000. In alternative embodiments, a leftward/rightward location of one or more translation planes 1010 and/or an upward/downward location of one or more cavity axes 1412, suspension axes 1602, and/or axes of rotation 1808 may depend on selected design parameters of the wearable device 1000. For example, altering an overall diameter of a wheel assembly 1800 may affect a vertical location of a multitude of the components of the wearable device 1000 as well as a potential vertical location of a user's foot that is inserted into the shoe 1200. Of course, in some embodiments, the effect of such increases in a wheel assembly 1800 overall diameter may be reduced by vertically adjusting the location and/or shape of other components of the wearable device 1000. For example, in a case where a larger overall diameter of a wheel assembly 1800 is used, while in some cases the associated axis of rotation may not be unchanged, the vertical locations of a substantial remainder of the wearable device 1000 may be maintained by for example, but not limited to, vertically elongating an associated suspension block 1408 to lower the other portions of the wearable device 1000. As such, in some alternative embodiments, wheel assemblies 1800 having different overall diameters may be used on a single wearable device 1000 in a manner that provides various axis of rotation 1808 heights while still providing a low profile wearable device 1000 allows low centers of gravity for the wearable devices 1000 and for a user of the wearable devices 1000.

Referring back to FIGS. 1, 2, and 14-19, in some embodiments, each of the wheel assemblies 1800 and/or components of the wheel assemblies 1800 may be substantially equidistantly offset in a leftward/rightward direction from one or more of an associated suspension block 1408 and/or a nearest portion of a sole outer profile 1248. In other words, in some embodiments, each wheel assembly 1800 and/or tire 1804 may be located relative to the shoe 1200 in manner that closely tracks the shape of the sole outer profile 1248 so that the wheel assemblies 1800 and/or tires 1804 may provide stable force transfer paths without unnecessarily extending away from the sole outer profile 1248. Of course, the distance by which the wheel assemblies 1800 and/or tires 1804 may be offset from the sole outer profile 1248 may be selected in response to physical dimensions and/or material properties of the suspensions 1600 described in greater detail below.

In still further alternative embodiments, the frame 1400 and/or the interface 1402 may be provided as multiple components. For example, in some embodiments, the functionality of the frame 1400 shown in FIGS. 20-24 may be provided using a front frame and a rear frame. In some embodiments, the front frame may comprise structures suitable for providing the force transfer functionality of the front branches 1406 while the rear frame may comprise structures suitable for providing force transfer functionality of the rear branches 1406. In other embodiments, the functionality of the frame 1400 shown in FIGS. 20-24 may be provided using a left frame and a right frame. In some embodiments, the left frame may comprise structures suitable for providing the force transfer functionality of the left branches 1406 while the right frame may comprise structures suitable for providing force transfer functionality of the right branches 1406.

In yet further alternative embodiments, independent frames may be provided for use in association with each wheel assembly 1800. In other words, in some embodiments the frame 1400 shown in FIGS. 20-24 may be replaced by four individual frames and/or interfaces 1402 that each individually provides a force transfer path between the shoe 1200 and the associated wheel assembly 1800. It will be understood that, in some embodiments where the functionality of frame 1400 is provided by multiple separate components, maintaining an overall strength and/or stability of the wearable device 1000 may require additional structural and/or stiffening components to be integrated with the shoe 1200. Alternatively, the shoe 1200 may be sufficiently structurally altered and/or integrally enhanced to provide a suitable force transfer directly to associated wheel assemblies 1800 without a need for an external and/or removable frame 1400 and/or a functionally equivalent collection of components.

It will be appreciated that, in some embodiments, the frame 1400 shown in FIGS. 20-24 may be provided with a first set of physical frame 1400 dimensions that may be substantially optimized for use in association with a shoe 1200 having a first set of physical shoe 1200 dimensions. For example, the frame 1400 may be optimized for use in association with a shoe 1200 substantially dimension as a so-called "US woman's size 9" shoe. In some embodiments, the frame 1400 optimized for the size 9 shoe 1200 may alternatively be used in association with shoes dimensioned larger, smaller, and/or irregularly compared to the US woman's size 9 shoe dimensional standard. Accordingly, will be appreciated that a frame 1400 may be useful in conjunction with various sizes of shoes 1200 so that frames 1400 may be used by different users having various sizes of feet. Put another way, a single frame 1400 having substantially preset and/or adjustable overall dimensions may be configured for association with and/or use with any of a wide range of shoe 1200 sizes so that the frame 1400 may serve as a so-called "one size fits all" frame 1400 insofar as the frame 1400 may accommodate the many variously sized and/or shaped alternative embodiments of shoes 1200. In some cases, providing such a one size fits all frame 1400 may reduce a cost and/or difficulty of providing roller transportation to multiple users having different sized feet. For example, in cases where a frame 1400 is configured to accommodate a plurality of sizes and/or shapes of shoes 1200, costs associated with machine tooling, frame 1400 engineering and/or design costs, and/or other overall wearable device 1000 manufacturing costs may be reduced by leveraging the economies of scale provided by using the single frame 1400 with the multiple sizes, shapes, and/or types of shoes 1200. Of course, some consideration may be given to stability, comfort, aesthetic appearance, fit, wearability, and/or other performance factors of any proposed combination of a frame 1400 and a shoe 1200 that is not optimized for use with the frame 1400. In some embodiments, the shoe 1200 may be a so-called tennis shoe, a running shoe, a high top shoe, a cross-trainer shoe, a boot, a component of waders, or any other shoe and the type of shoe 1200 may be selected by a user based on aesthetic, biomechanical, economic, and/or activity specific reasons or based on any other reason. Further, in some embodiments, a shoe may be provided that comprises a running shoe upper combined with a midsole and/or sole of another type of shoe, such as a relatively heavier duty shoe than a running shoe.

Figure 31:
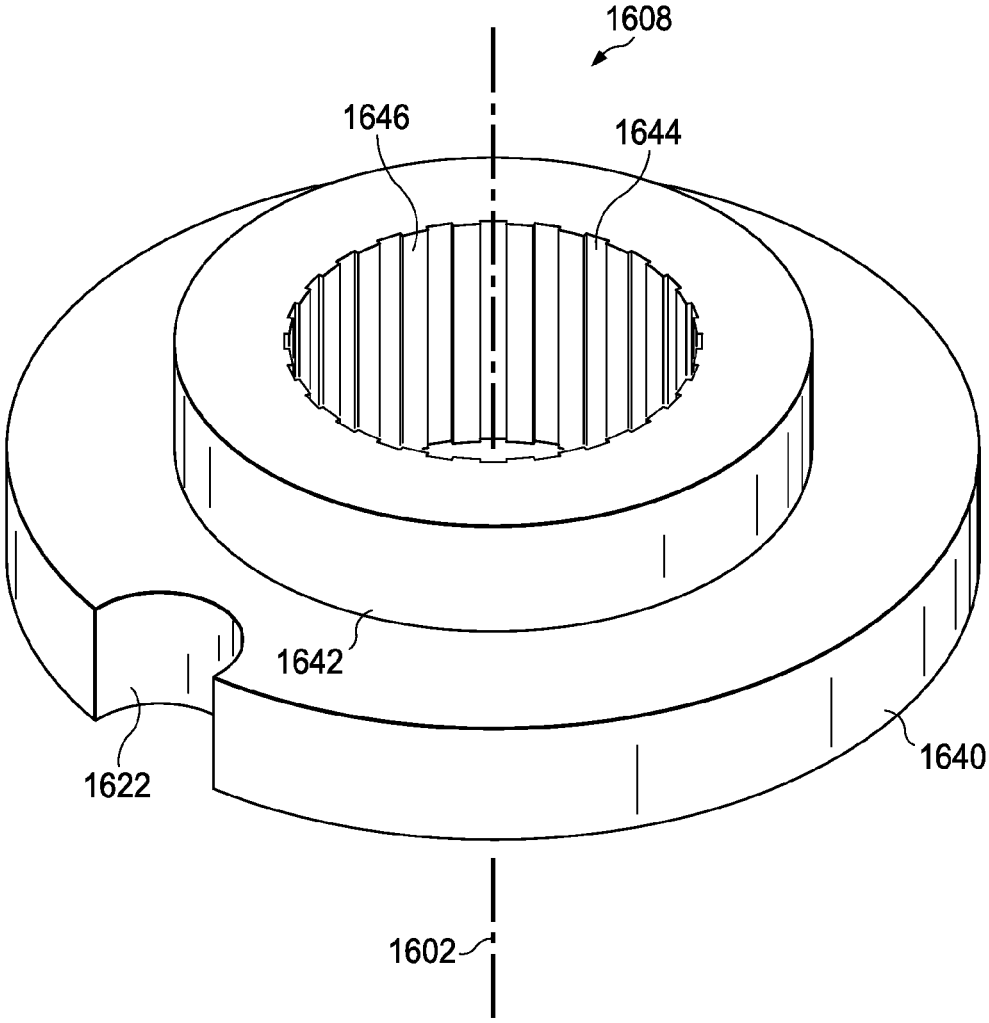
FIG. 31 is an oblique view of an inner tophat of the suspension of FIG. 25.
Figure 32:
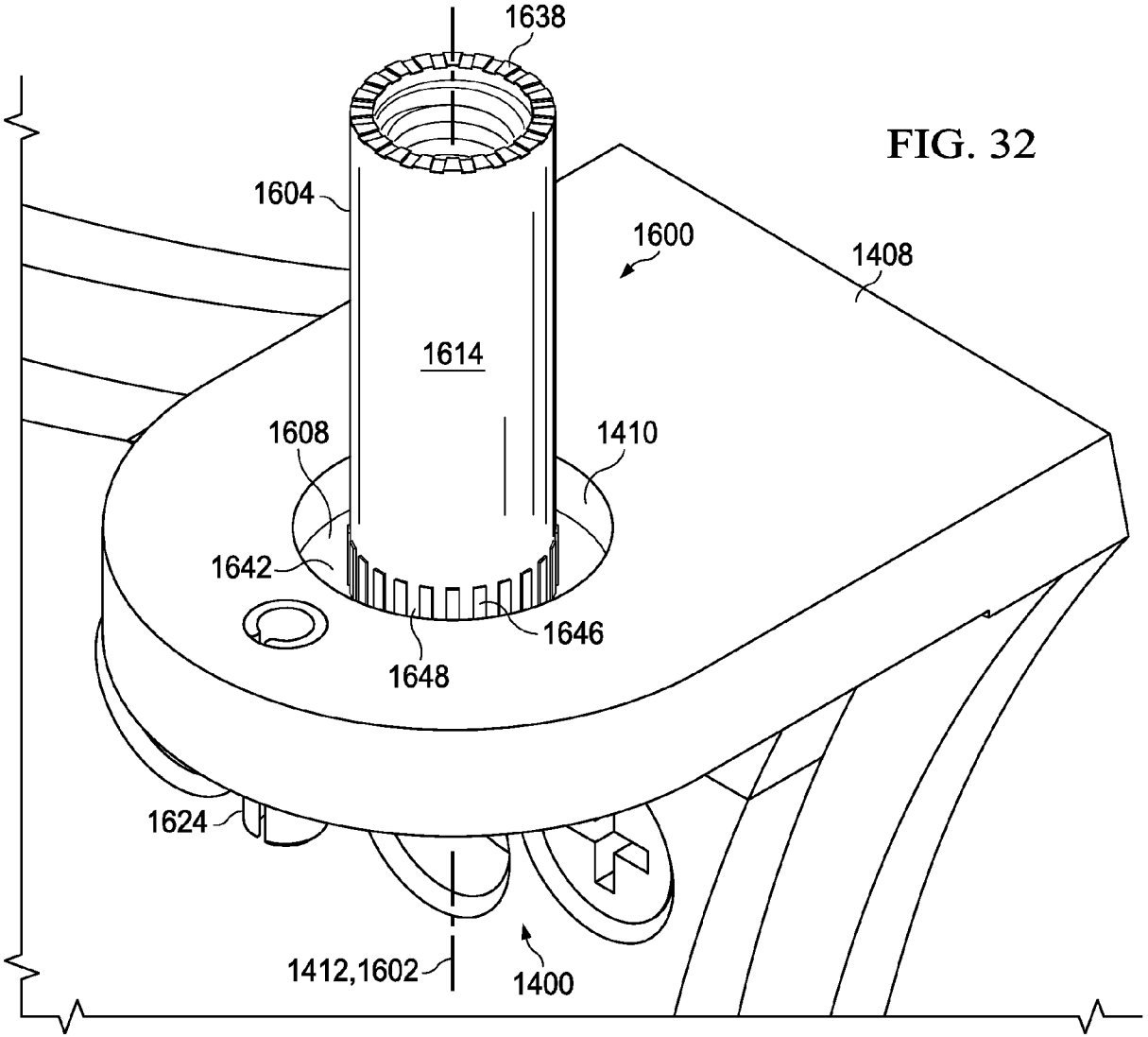
FIG. 32 is an oblique outer view of the suspension of FIG. 25 with an outer tophat removed.
Figure 33:
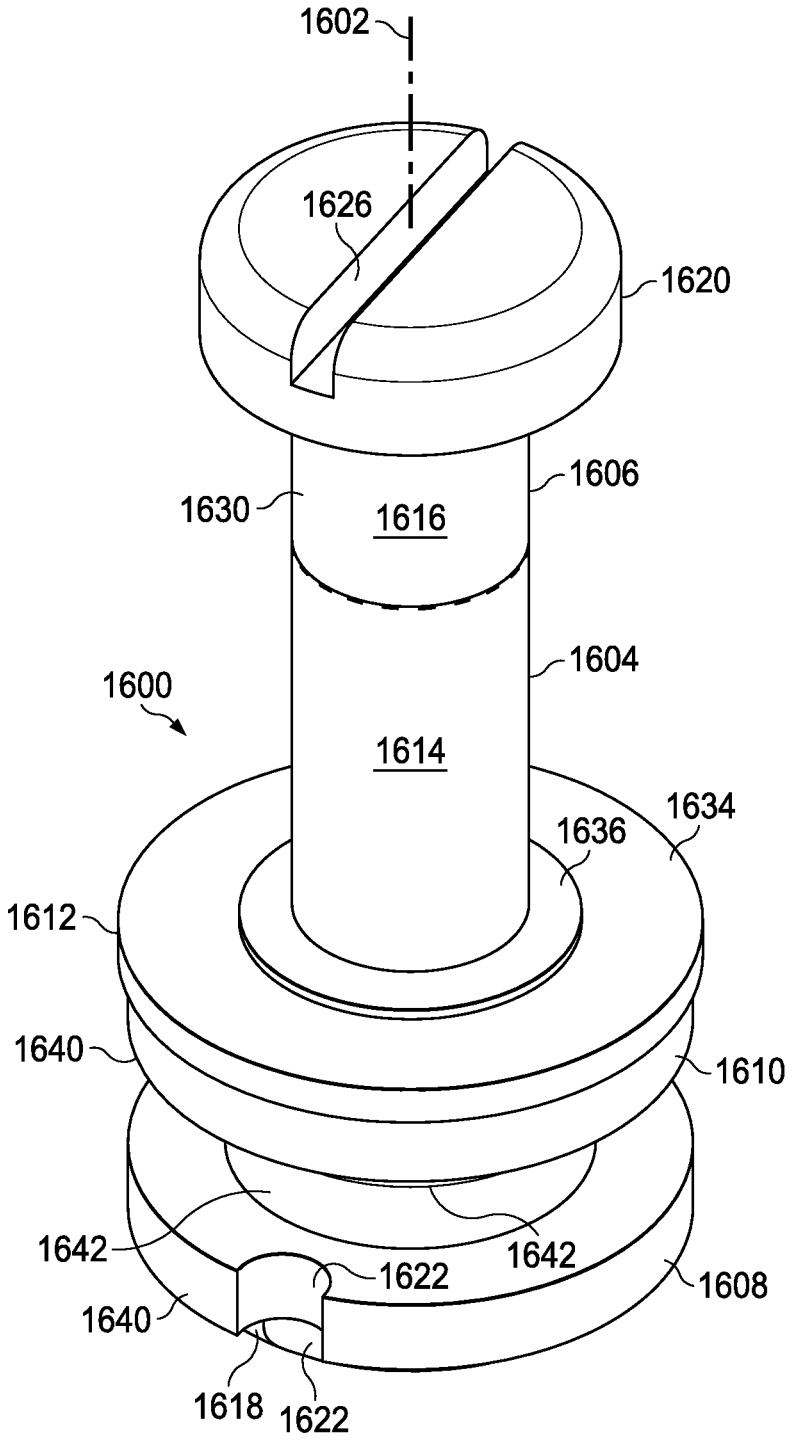
FIG. 33 is an oblique outer view of the suspension of FIG. 25.

Referring now to FIGS. 25-33, the suspension 1600 and wheel assembly 1800 are described in greater detail below. Most generally, suspension 1600 comprises a female axle bolt 1604, a male axle bolt 1606, an inner tophat 1608, an outer tophat 1610, and a suspension spacer 1612. In some embodiments, each of the female axle bolt 1604, male axle bolt 1606, inner tophat 1608, outer tophat 1610, and suspension spacer 1612 may substantially lie coaxial with the previously described suspension axis 1602, at least while the wearable device 1000 and the suspension 1600 are in an unloaded state. Briefly referring particularly to FIG. 33, the suspension 1600 is shown assembled separate from the wearable device 1000 and more specifically is shown assembled in a manner unrestrained by a suspension cavity 1410 and without carrying an associated wheel assembly 1800. FIG. 33 clearly shows the relative layout of the component parts of the suspension 1600 and particularly shows that a portion of the male axle bolt 1606 is received within a portion of the female axle bolt 1604. FIG. 33 also shows that when the suspension 1600 is assembled, the inner tophat 1608, the outer tophat 1610, and the suspension spacer 1612 are effectively captured, in that order, along a substantially cylindrical female bearing surface 1614 of the female axle bolt 1604. FIG. 33 further shows that a remaining portion of the female bearing surface 1614 and a substantially cylindrical male bearing surface 1616 are well suited to carry a wheel assembly 1800 as will be explained in greater detail below.

Figure 25:
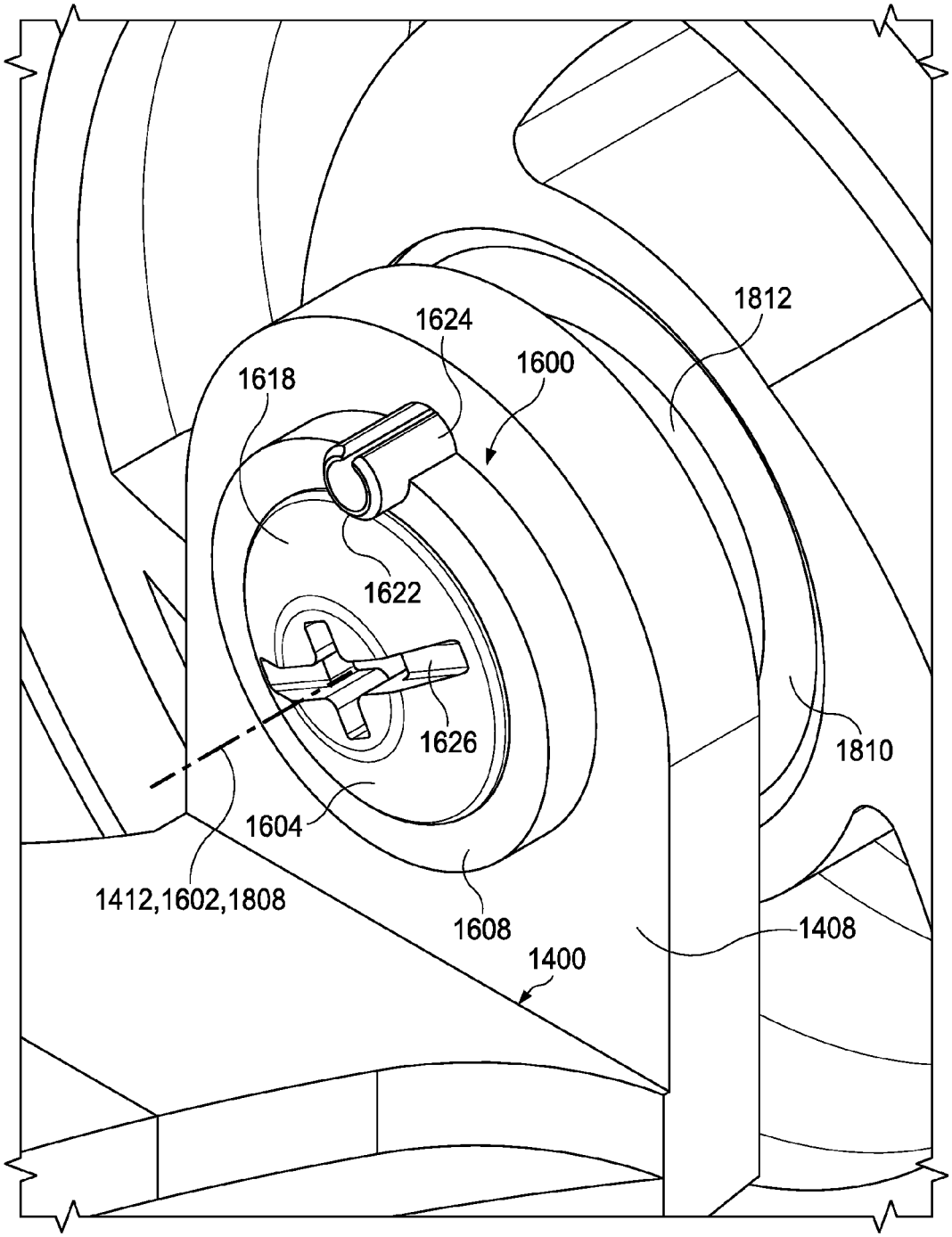
FIG. 25 is an oblique interior view of a suspension of the wearable device of FIG. 1 installed on the frame of FIG. 20.
Figure 26:
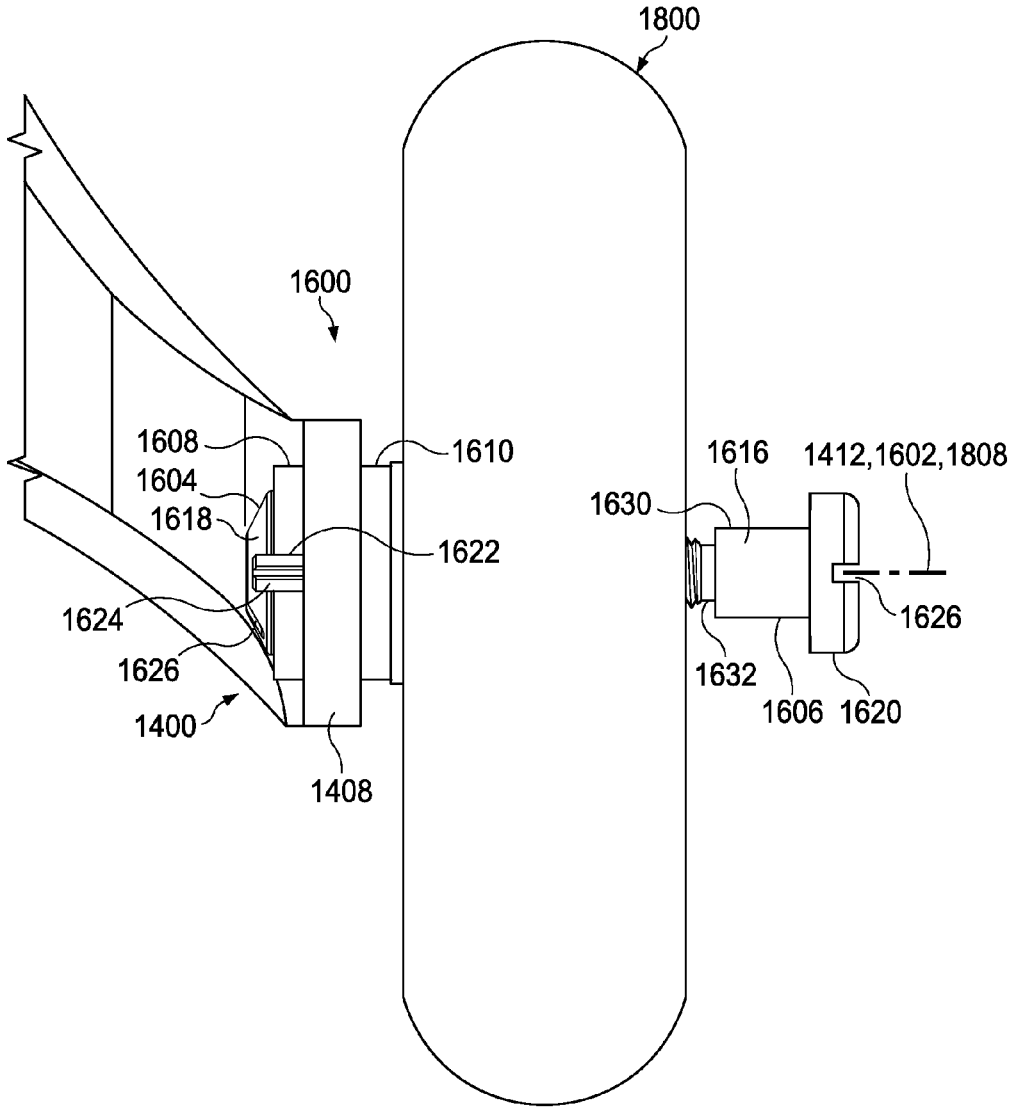
FIG. 26 is an orthogonal top view of the suspension of FIG. 25 with a male axle screw partially removed.

Referring now to FIG. 25, an inside view of the suspension 1600 reveals that when suspension 1600 is a fully installed configuration, a female head 1618 of the female axle bolt 1604 captures a portion of the inner tophat 1608 between the female head 1618 and an inner surface of the suspension block 1408. FIG. 25 further shows that the female head 1618 and the inner tophat 1608 may comprise pin notches 1622 for receiving a pin 1624. Female head 1618 comprises a Philips type impression for receiving a Philips type screwdriver head and the female head 1618 further comprises an elongated slot 1626 well suited for receiving a coin or other freely available tool for rotating and/or preventing rotation of the female axle bolt 1604. However, in alternative embodiments, the female head may comprise a hex head or any other suitable feature. The pin 1624 may be received by into a pinhole 1628 formed in the suspension block 1408. The pinhole 1628 may comprise a through hole extending from the inner surface of the suspension block 1408 to an opposite outer surface of the suspension block 1408. In alternative embodiments, the pinhole 1628 may be located differently and/or may not extend fully through the suspension block 1408 will nonetheless providing a receptacle for the pin 1624.

In still other alternative embodiments, the use of the pin 1624 and/or the pinhole 1628 may be functionally replaced by including additional structural features on the frame 1400. For example, a ledge, wall, protrusion or other structural element may be integrally formed into the frame 1400, for example, but not limited to, formed in the suspension block 1408 to provide a stop against which one or more of the edges of the pin notches 1622 and/or otherwise flattened portions of the suspension elements may interfere with upon their rotation about the suspension axis 1602. In some alternative embodiments, the somewhat circular pin notches 1622 may be replaced by a simple flattened portion, in some embodiments accomplished by simply grinding an edge of the female head 1618. Such a flattened portion may then be selectively inserted along the suspension axis 1602 into the suspension cavity 1410 in a manner so that the flat portion of the female head 1618 substantially prevents rotation of the female axle bolt 1604 in response to its rotation being obstructed by the integral formation provided on the frame 1400. Of course, in further alternative embodiments, the above-described obstructing geometries may comprise more complicated geometries, such as, but not limited to, hex shapes and/or any other suitable geometries for limiting rotation of the suspension elements.

Figure 27:
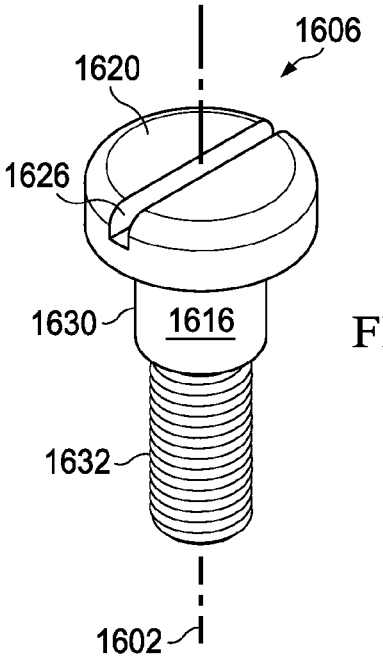
FIG. 27 is an oblique view of the male axle screw of the suspension of FIG. 25.

FIG. 27 is an oblique view of the male axle bolt 1606 as removed from the suspension 1600. The male axle bolt 1606 comprises the above-described male head 1620, a male bearing surface 1616 that defines an exterior of a male shaft 1630 extending from the male head 1620, and a threaded finger extending 1632 extending from male shaft 1630. Once the male axle bolt 1606 is fully removed from the suspension 1600, the wheel assembly 1800 that is normally carried by the female bearing surface 1614 and the male bearing surface 1616 (when the suspension 1600 is fully installed) may be removed from the suspension 1600 and fully separated from the wearable device 1000. At least in some embodiments, the male axle bolt 1606 shown may be constructed by altering a standard bolt, such as, but not limited to, a metric 6 mm square head bolt, to reduce the lengthwise outreach and/or profile of the head of the commercially available bolt. Male axle bolt 1606 may comprise an elongated slot 1626 in some embodiments, alternative embodiments may comprise a hex head or any other suitable feature.

Figure 28:
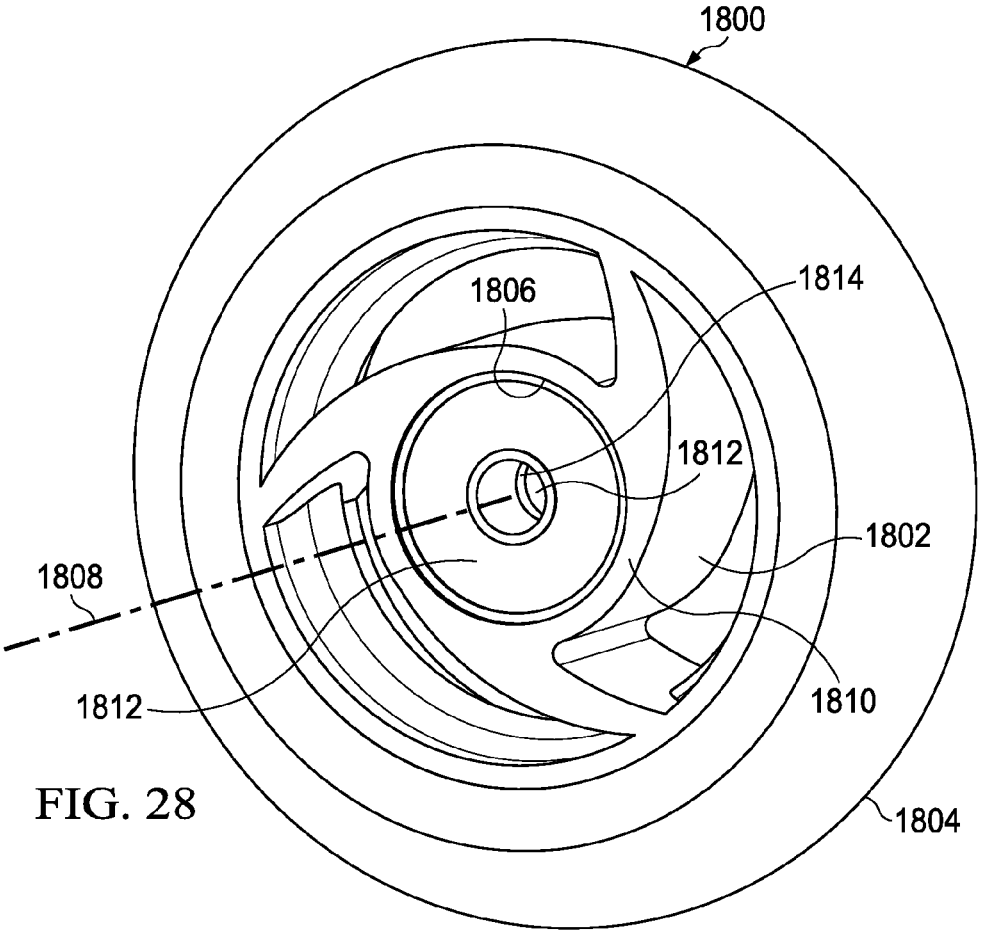
FIG. 28 is an oblique view of a wheel assembly of the wearable device of FIG. 1.

FIG. 28 is an oblique inner view of the wheel assembly 1800 shown as being fully removed from the remainder of the wearable device 1000. The wheel assembly 1800 comprises the previously described wheel hub 1802, tire 1804, and bore 1806 of the wheel hub 1802. As noted before, each of the wheel hub 1802, tire 1804, and bore 1806 may lie substantially along an axis of rotation 1808 of the wheel assembly 1800. In some embodiments, the wheel hub 1802 and tire 1804 may be commercially available and may be modified by creating the bore 1806 by enlarging an already existing smaller bore of the wheel hub 1802. In some embodiments, a friction reducing coating 1810 may be applied to an inner surface of the wheel hub 1802 to reduce friction generated by incidental and/or consistent rotary contact between the wheel hub 1802 and the suspension spacer 1612. In some embodiments, the coating 1810 may comprise polytetrafluoroethylene (PTFE) and/or any other suitable friction reducing material and/or chemical composition. In alternative embodiments, the wheel hub 1802 itself may be impregnated with alloys and/or other materials to provide a similar reduction in friction. Most generally, the bore 1806 houses two bearings 1812, one bearing 1812 substantially adjacent an outer edge of the bore 1806 and the other bearing 1812 substantially adjacent an inner edge of the bore 1806. A bearing spacer 1814 is disposed within the bore 1806 and between the inner races of the bearings 1812. Of course the bearing spacer 1814 comprises a substantially annular shape and has a central bore configured to the female bearing surface 1614 and/or the male bearing surface 1616 therein.

Figure 29:
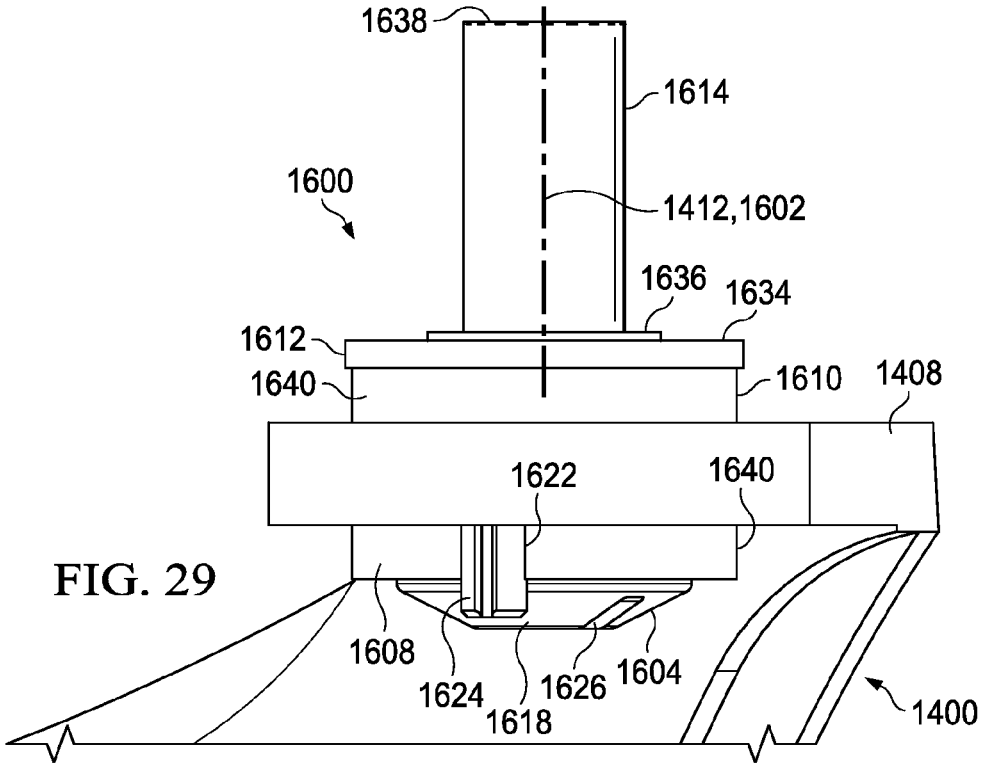
FIG. 29 is an orthogonal top view of the suspension of FIG. 25 with the wheel assembly of FIG. 1 removed.

Referring now to FIG. 29, an orthogonal top view of the suspension 1600 is shown with the male axle bolt 1606 removed and with the wheel assembly 1800 removed from the suspension 1600. With the wheel assembly 1800 removed, the suspension spacer 1612 is shown as comprising a substantially annular washer-like shape having a thinner hub ring 1634 and a relatively thicker inner race ring 1636. An inner side of the suspension spacer 1612 a substantially flat and contacts a substantially flat outer side of the outer tophat 1610. An outer side of the hub ring 1634 is sized for and well suited for abutment against an inner face of an inner race of the inner bearing 1812. In view of the above-described suspension 1600 and wheel assembly 1800, it will be appreciated that when the suspension 1600 is fully installed and the wheel assembly 1800 is installed on the suspension 1600, with sufficient tightening of the female axle bolt 1604 relative to the male axle bolt 1606, the male head 1620 and the inner race ring 1636 may tightly capture the inner races of bearings 1812 and the bearing spacer 1814. As a result, in some embodiments, rotation of one or more of the suspension spacer 1612, the inner races of the bearings 1812, and the bearing spacer 1814 relative to the female bearing surface 1614 and/or the male bearing surface 1616 may be greatly reduced and/or eliminated. Accordingly, rotation of the wheel hub 1802 and the tire 1804 about the axis of rotation 1808 may primarily occur as a result of the outer races of the bearings 1812 remaining free to rotate relative to the inner races of the bearings 1812.

Figure 30:
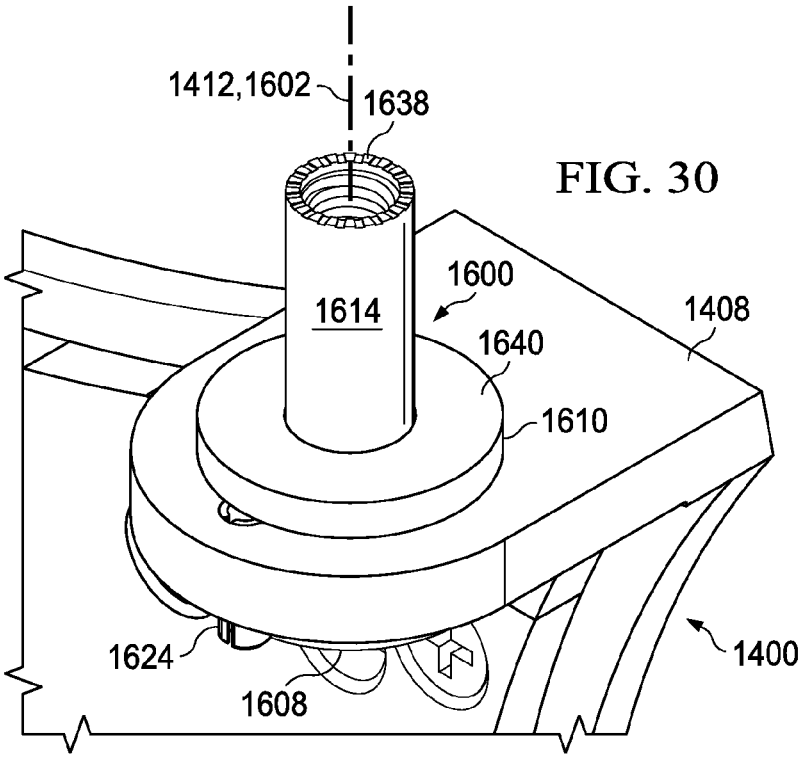
FIG. 30 is an oblique outer view of the suspension of FIG. 25 with a suspension spacer removed.

Referring now to FIG. 30, an oblique view of the suspension 1600 is shown with the male axle bolt 1606 removed, with the wheel assembly 1800 removed from the suspension 1600, and with the suspension spacer 1612 removed from the suspension 1600. FIG. 30 reveals that female axle bolt 1604 comprises a knurled interface 1638 that comprises a primary contact between the female axle bolt 1604 and an inner surface of the male shaft 1630. It will be appreciated that during installation of the suspension 1600, the pin 1624 may contribute to preventing rotation of the female axle bolt 1604 and the integrally knurled interface 1638 may provide a retaining mechanism for maintaining an angular position of the male axle bolt 1606 relative to the female axle bolt 1604 without the need for additional components such as, but not limited to, spider washers, adhesives, bonding agents, and/or other mechanisms for maintaining a tight screw connection.

Referring now to FIG. 31, an oblique outer view of the inner tophat 1608 is shown. The inner tophat 1608 and shape substantially similar to the suspension spacer 1612 insofar as the inner tophat 1608 comprises a substantially annular washer-like shape having a thinner exterior ring 1640 and a relatively thicker interior ring 1642. The exterior ring 1640 is termed such because the exterior ring 1640, in a fully installed position, remains substantially exterior to the suspension cavity 1410. The interior ring 1642 is termed such because the interior ring 1642, in a fully installed position, is disposed substantially within the suspension cavity 1410 and around the female bearing surface 1614. FIG. 31 further shows that a tophat interior bore 1644 may comprise an angular array of lengthwise ridges 1646 that are substantially formed in conformation with substantially similar ridges 1646 of a base 1648 of the female axle bolt 1604. The base 1648 generally extends from the female head 1618 through the suspension cavity 1410 to terminate at the female bearing surface 1614. It will be appreciated that the ridges 1646 of the inner tophat 1608 may not initially be formed into the inner tophat 1608, but rather, the ridges 1646 of the inner tophat 1608 may be a result of material deformation of the inner tophat in response to the inner tophat 1608 being forced between into the suspension cavity 1410 between the cavity wall and the ridges 1646 of the base 1648 of the female axle bolt 1604. It will further be appreciated that the outer tophat 1610 is substantially similar to the inner tophat 1608 with the exception that the outer tophat 1610 comprises no pin notch 1622.

Referring now to FIG. 32, an oblique view of the suspension 1600 is shown without the male axle bolt 1606, the wheel assembly 1800, the suspension spacer 1612, and the outer tophat 1610. FIG. 32 more clearly shows the knurled interface 1638 and the ridges 1646 on the base 1648 of the female axle bolt 1604. FIG. 32 also shows that the inner tophat 1608, and particularly the interior ring 1642 of the inner tophat 1608 is located between the surface of the suspension cavity 1410 and the base 1648. FIG. 32 also clearly show that the pin hole 1628 may extend through the suspension block 1408 to an outer surface of the suspension block 1408. Still further, FIG. 32 clearly illustrates that at least a portion of the female axle bolt 1604, at least a portion radially inward from the female bearing surface 1614, is configured to receive a threaded finger 1632 into a similarly threaded receptacle 1653 of the female axle bolt 1604.

Figure 34:
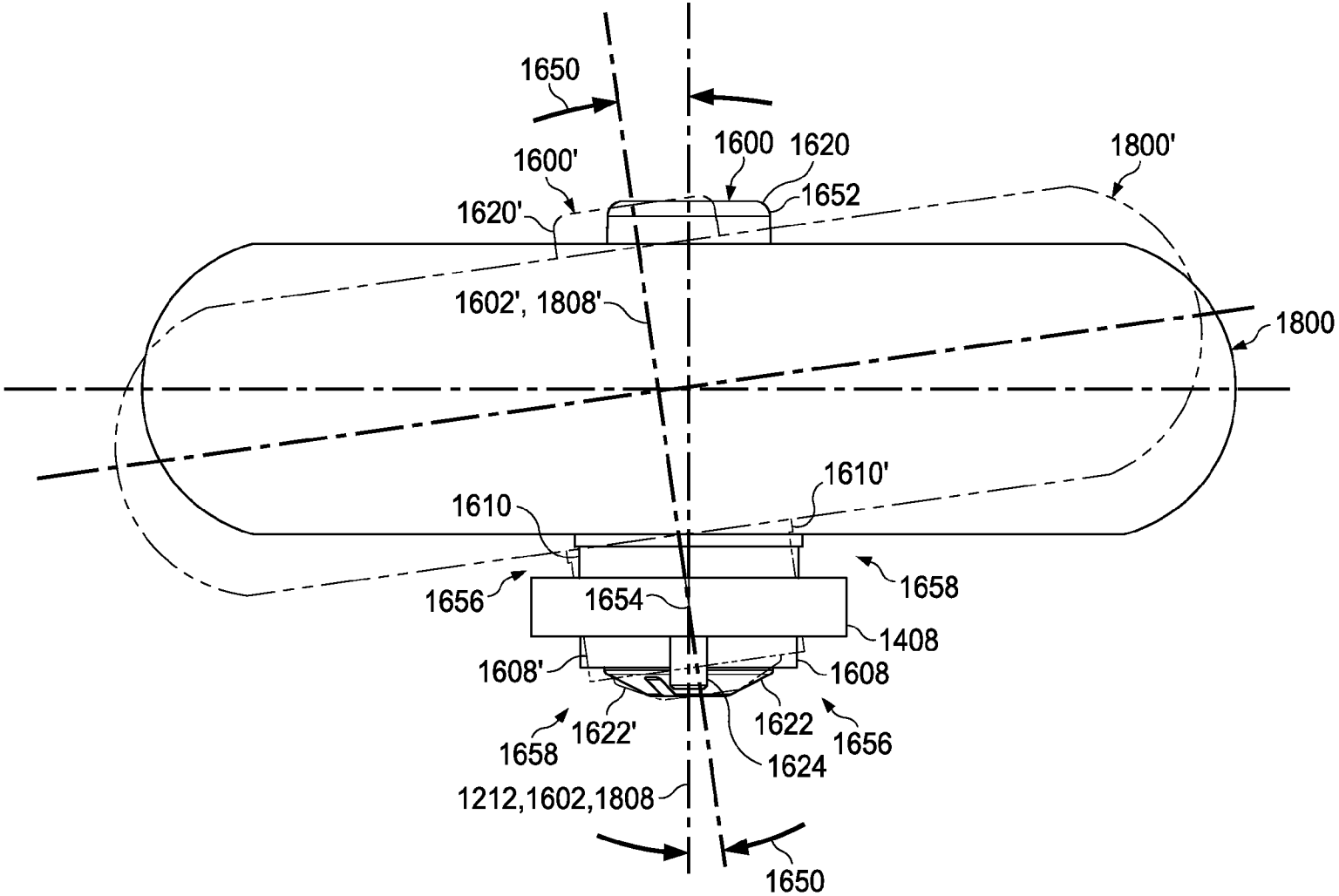
FIG. 34 is a schematic view showing the suspension of FIG. 25 in each of an unloaded state and a loaded and/or used state.

Referring now to FIG. 34, a simplified schematic diagram of the suspension 1600 and wheel assembly 1800 are shown in both a first unloaded state and second (in phantom lines) in a loaded state and/or in a used state. FIG. 34 illustrates the operation of the suspension 1600. Particularly, when suspension 1600 is in an unloaded state, the material of the flexible and/or compressible and/or elastically shearable inner tophat 1608 and outer tophat 1610 rest while maintaining their substantially annularly symmetrical forms. In the unloaded state, the cavity axis 1412, the suspension axis 1602, and the axis of rotation 1808 lie substantially coaxial with each other. However, when the suspension 1600 is perturbed from the unloaded state, one or more of the inner tophat 1608 and the outer tophat 1610 may deform, thereby allowing the suspension axis 1602 and the axis of rotation 1808 to deviation from being coaxial with the cavity axis 1412. In some cases, the suspension axis 1602 and the axis of rotation 1808 may be perturbed away from the cavity axis 1412 by a perturbation angle 1650 (as viewed from above, for example) to respective suspension axis 1602' and to axis of rotation 1808' locations. The female axle bolt 1604 and the male axle bolt 1606 are effectively primarily constrained by the suspension block 1408, and generally are sufficiently rigidly connected to each other to form a singular so-called "floating axle" 1652. In other words, the mechanical freedom primarily allowed to the floating axle 1652 is to allow the opposing ends of the floating axle 1652 to orbit about a center of rotation 1654 in response to the above-described perturbations. The center of rotation 1654 may, in this embodiment, be located generally along the cavity axis 1412 near a midpoint along the length between the outer surface of the outer tophat 1610 and the inner surface of the inner tophat 1608.

As shown in FIG. 34, if the floating axle 1652 is sufficiently perturbed, the malleable and/or otherwise compressible inner tophat 1608 and outer tophat 1610 may deform to take the shape represented by perturbed inner tophat 1608' and perturbed outer tophat 1610'. Of course, since the tophats 1608, 1610 are generally constrained by female head 1618, suspension block 1408, and suspension spacer 1612, and floating axle 1652, movement of the floating axle 1652 may result in compression zones 1656 and/or extrusion and/or extrusion zones 1658 where the tophats 1608', 1610' are deformed to compensate for the movement of the floating axle 1652. By providing such a suspension 1600 for association with each wheel assembly 1800, the wearable device 1000 may be described as comprising multiple so-called fully independent suspensions 1600. While each suspension 1600 may not be fully isolated from all perturbations received from other suspensions 1600, the disclosed suspension 1600 may provide for substantially localized absorption of perturbations to the associated wheel assembly 1800. In the embodiment disclosed in FIG. 34, the wheel assembly may be generally secured relative to the frame 1400 and/or the shoe 1200 but for the above-described rotation of the wheel hub 1802 and tire 1804 about the axis of rotation and but for the above-described orbital movement of the entire wheel assembly 1800 about an associated center of rotation 1654.

Most generally, the above-described wearable device 1000 may provide biomechanically and/or ergonomically sensible force transfer between a user and the ground 1008 by, in some embodiments, transferring forces through transfer paths selected in response to the size and/or anatomy of a user's foot (i.e., the location and relative spacing of the branches 1406, wheel assemblies 1800, etc.). The wearable device 1000 may also provide a user with a low profile (close to the ground 1008) transportation solution that provides a desirable amount of ground clearance without causing the wearable device 1000 and/or the user of the wearable device 1000 to have an undesirably vertically high center of gravity. Still further, in response to the above-described physical layout of the frame 1400, everyday roller transportation obstacles, such as, but not limited to, raised cracks in sidewalks, may prevent less danger to the user of a wearable device 1000. As an example, consider a user of the wearable device 1000 travelling in a first direction along the ground 1008. If the user approaches a raised sidewalk crack that is substantially perpendicular to the user's established direction of travel, the user may feel less of an impact and/or may have a greater amount of time to react to the crack because the front-left tire 1804 may encounter the crack prior to the other tires 1804. In other words, not only may the somewhat staggered and/or non-uniform arrangement of wheel assemblies 1800 provide ergonomic and/or more efficient force transfer between the user and the ground 1008, the same physical layout may additionally insulate the user from encountering common roller transportation obstacles with unnecessarily high impedance forces relative to the user's direction of travel.

Of course, in alternative embodiments, one or more of the female axle bolt 1604 and/or the male axle bolt 1606 may be attached to the frame 1400 and/or the shoe 1200 in a cantilever manner that may relocate the center of rotation 1654 to near the point of substantially rigid attachment to the frame 1400 and/or the shoe 1200. In further alternative embodiments, the floating axle 1652 may be restrained nearer a midpoint along a length of the floating axle 1652 and/or the floating axle 1652 may be duplicatively constrained by adding a cantilever type connection to an end of the floating axle 1652 as an additional constraint to the flexible constraint shown in FIG. 34. Still further, in alternative embodiments, an axle substantially similar to the floating axle 1652 may be constrained twice or more along its length by similar tophat 1608, 1610 and suspension block 1408 constraints. In such embodiments, the suspensions may resemble the use of multiple so-called pillow block type arrangements.

Referring now to FIGS. 35-43, an attachment system 2000 for selectively joining the shoe 1200 to the frame 1400 is shown. It will be appreciated that, in some embodiments, a user may desire to, on the one hand, use the wearable device 1000 for roller transportation. On the other hand, the same user may on occasion prefer to use the shoe 1200 substantially as a conventional shoe and not in conjunction with producing roller transportation. Accordingly, this disclosure provides the attachment system 2000 for allowing selective removal of the shoe 1200 from the frame 1400 as well as allowing selective attachment of the shoe 1200 to the frame 1400.

Figure 35:
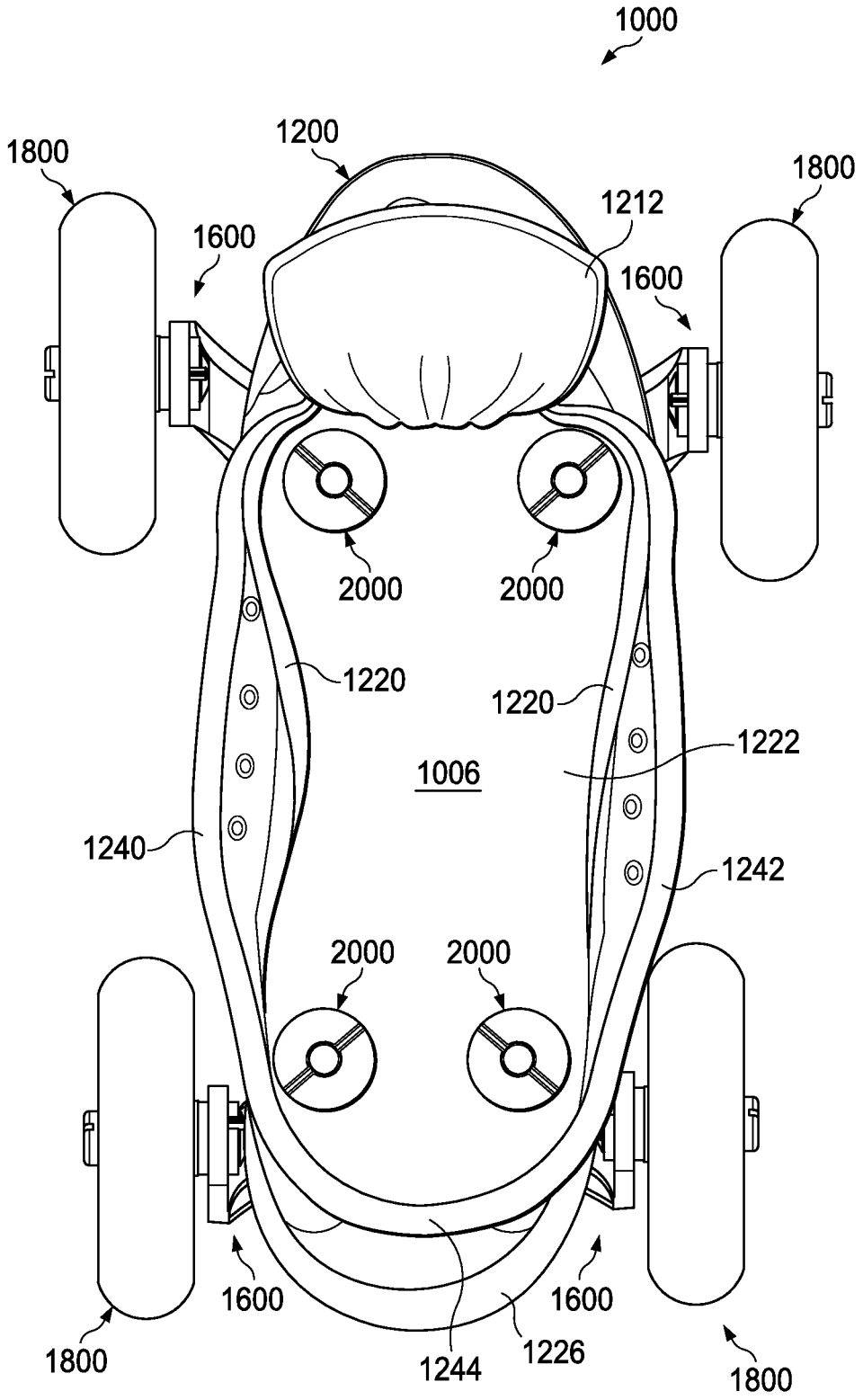
FIG. 35 is an oblique top view showing the interior of a shoe of the wearable device of FIG. 1 that houses a portion of an attachment system of the wearable device of FIG. 1.

Referring to FIG. 35, an inside view of the shoe 1200 is shown. The shoe 1200 is attached to the frame 1400 using four attachment systems 2000. Most generally, each attachment system 2000 comprises a stud 2002 that may be selectively retained relative to the frame 1400 through the use of a biased retainer 2004. The studs 2002 generally extend through the sole 1204 of the shoe 1200 and into a portion of the frame 1400. As such, FIG. 35 shows stud heads 2006 lying substantially flush with and/or imposing a compression force on the insole 1222. In some embodiments, a rotational movement of each stud 2002 may affect whether the stud 2002 is retained or is released by the biased retainer 2004. In some embodiments, the studs may be rotated by approximately one quarter and/or one half turn using simple tools such as, but not limited to, a coin and/or a screwdriver to effectuate the rotational movement of the stud 2002.

Figure 36:
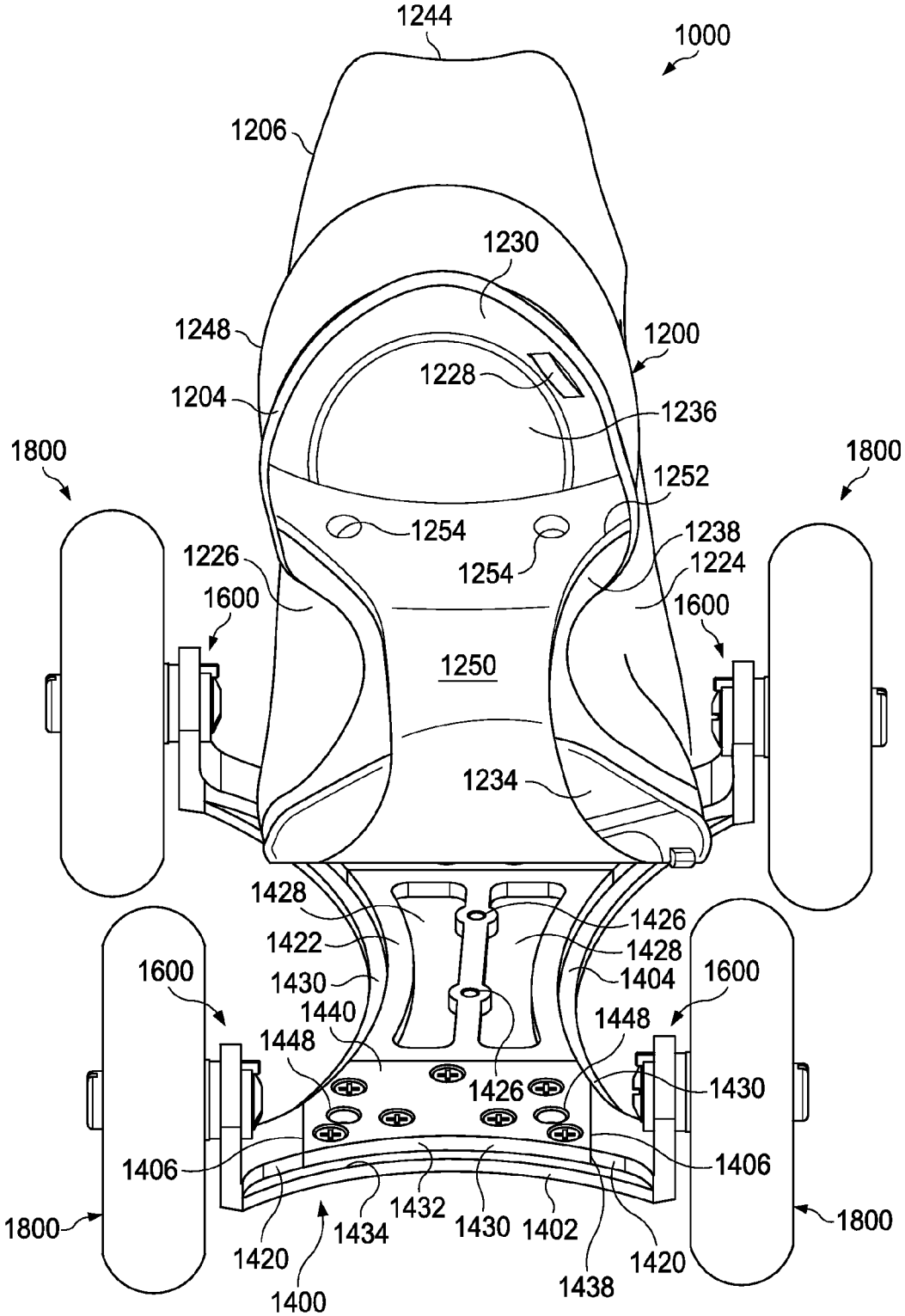
FIG. 36 is an oblique rear view of a shoe of the wearable device of FIG. 1 partially separated from the frame of the wearable device of FIG. 1.

Referring now to FIG. 36, the wearable device 1000 is shown with the shoe 1200 partially removed from the frame 1400. More specifically, two attachment systems 2000 are shown as having been disabled and/or unactivated insofar as the studs 2002 of the disabled and/or unactivated attachment systems 2000 are removed from the sole 1204 and are not retained by retainers 2004. FIG. 36 further shows that the sole 1204 may comprise a sole cutout profile 1252. In some embodiments the sole cutout profile 1252 may substantially conform to the outer profile steps 1430 of the frame 1400. In such embodiments, while the shoe 1200 is assembled to the frame 1400, a sole interface surface 1250 may substantially abut at least a portion of the upper interface surface 1422 of the frame 1400. In such embodiments, a portion of the remaining primary tread surface 1230 may substantially abut at least a portion of the ledges 1434 of the outer profile steps 1430. In a manner described above, when the shoe 1200 is attached to the frame 1400, some embodiments effectively embed a portion of the frame 1400 within the sole 1204. As a result, in some embodiments, the wearable device 1000 and/or a user of the wearable device 1000 may benefit by achieving lower centers of gravity and/or a more aesthetic appearance of the wearable device 1000.

Figure 37:
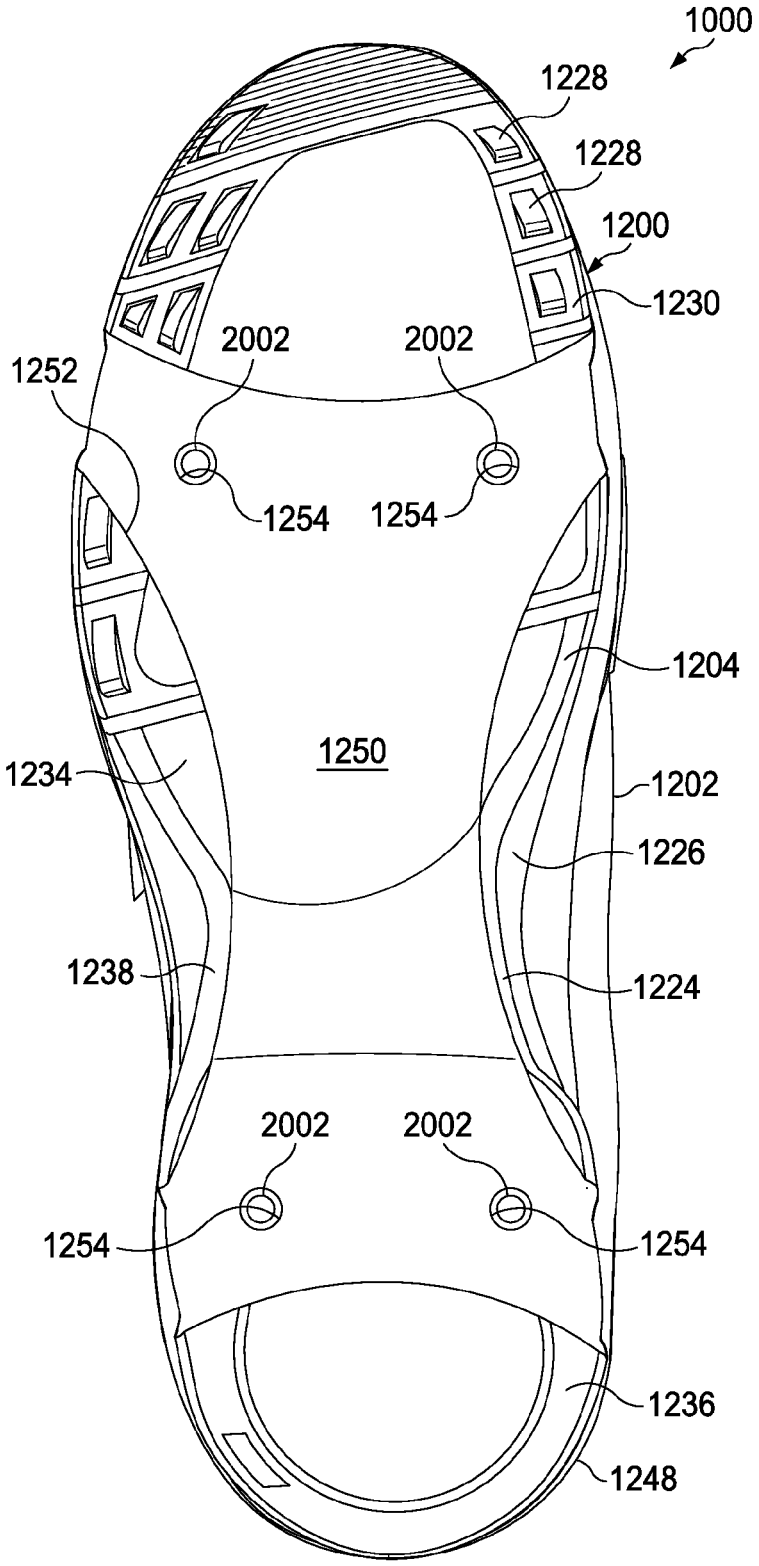
FIG. 37 is an orthogonal bottom view of the shoe of the wearable device of FIG. 1.

Referring now to FIG. 37, an orthogonal bottom view of the shoe 1200 that is fully removed from the frame 1400 is shown with studs 2002 extending through sole holes 1254 of the sole 1204. In this embodiment, four attachment systems 2000 are provided in a somewhat rectilinear and/or somewhat rectangular layout. However, in other embodiments, more or fewer than four attachment systems 2000 may be used so that the attachment systems 2000 generally lie in any other closed polygonal manner, self-intersecting polygonal manner, and/or curved path manner. Further, in some embodiments, attachment systems 2000 may be distributed in any other suitable layout, such as, but not limited to, plurality of attachment systems 2000 being linearly associated with a trunk midline plane 1414. In this embodiment, the attachment systems 2000 generally each lie along separate branch midline planes 1416, thereby providing a broad base of support and/or widely separated force transfer paths.

Figure 38:
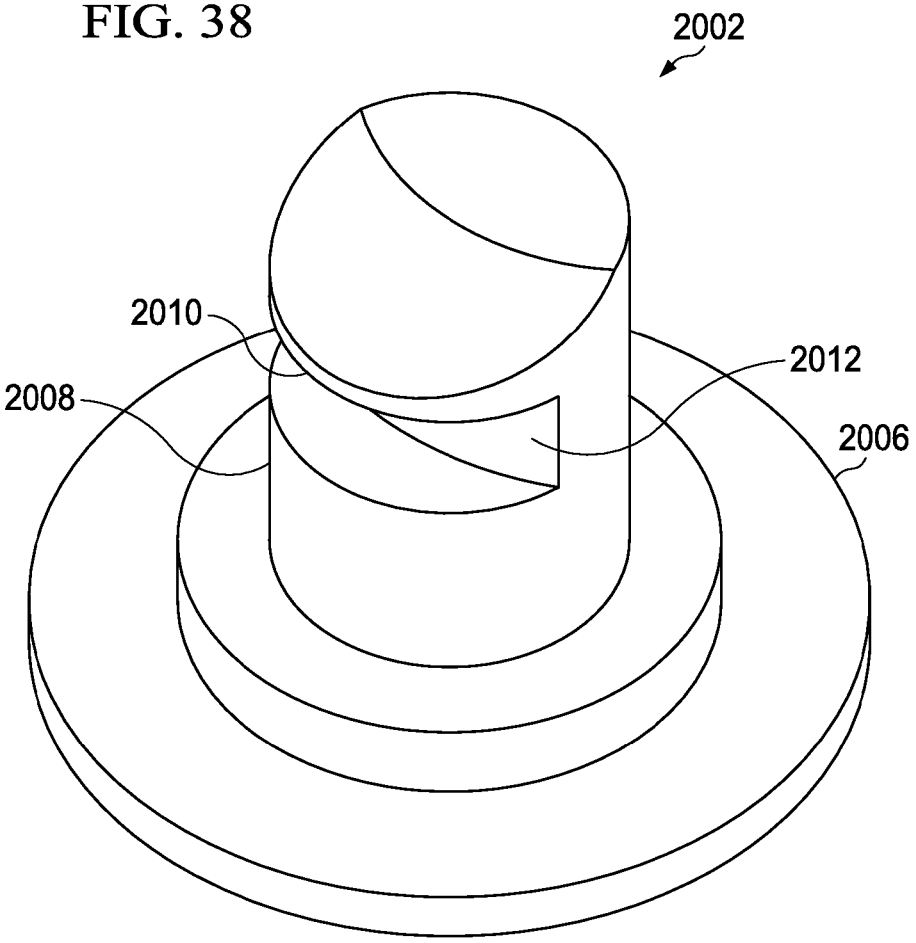
FIG. 38 is an oblique view of a stud of the attachment system of the wearable device of FIG. 1.

Referring now to FIG. 38, an oblique view of a stud 2002 is provided. Each stud 2002 comprises a stud head 2006, connected to a stud shaft 2008 that terminates with a hook 2010. Each stud shaft 2008 may comprise a cam indention 2012 between the stud shaft 2008 and the hook 2010.

Figure 39:
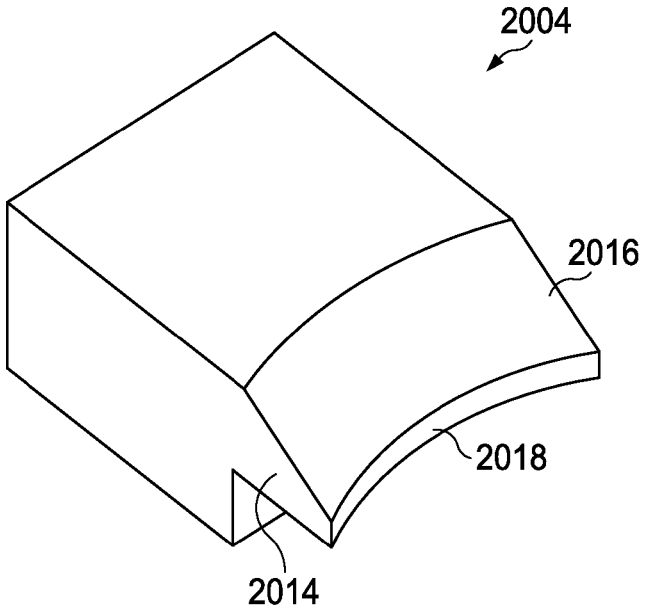
FIG. 39 is an oblique view of a retainer of the attachment system of the wearable device of FIG. 1.

Referring now to FIG. 39, an oblique view of a retainer 2004 is provided. Each retainer 2004 is substantially box shaped and comprises a generally crenellated projection 2014. The crenellated projection 2014 may comprise a curved transition surface 2016 and a substantially upright (when installed) projection wall 2018.

Figure 40:
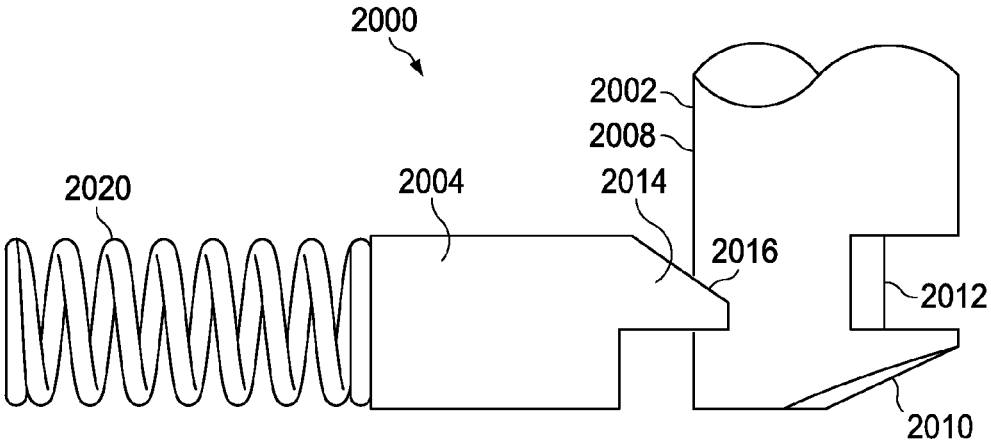
FIG. 40 is an orthogonal view showing components of the attachment system of the wearable device of FIG. 1 in an unretained configuration.
Figure 41:
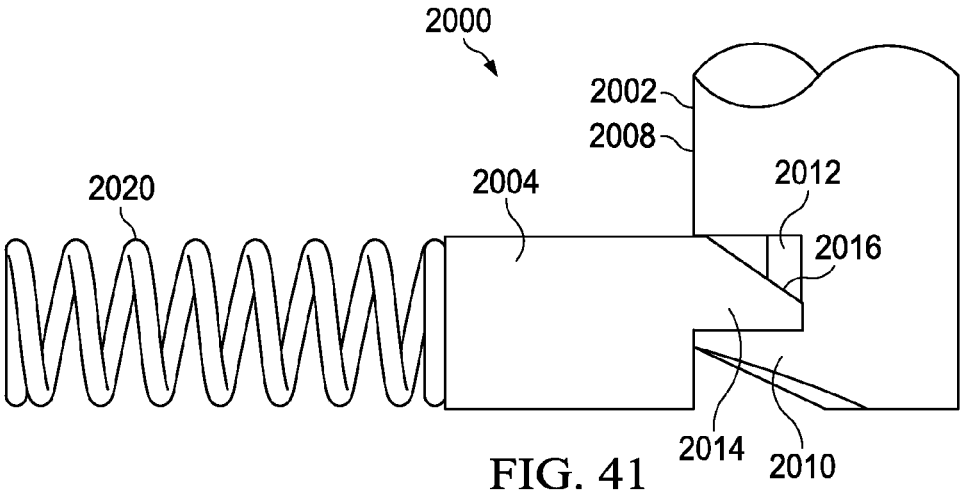
FIG. 41 is an orthogonal view showing components of the attachment system of the wearable device of FIG. 1 in a retained configuration.
Figure 42:
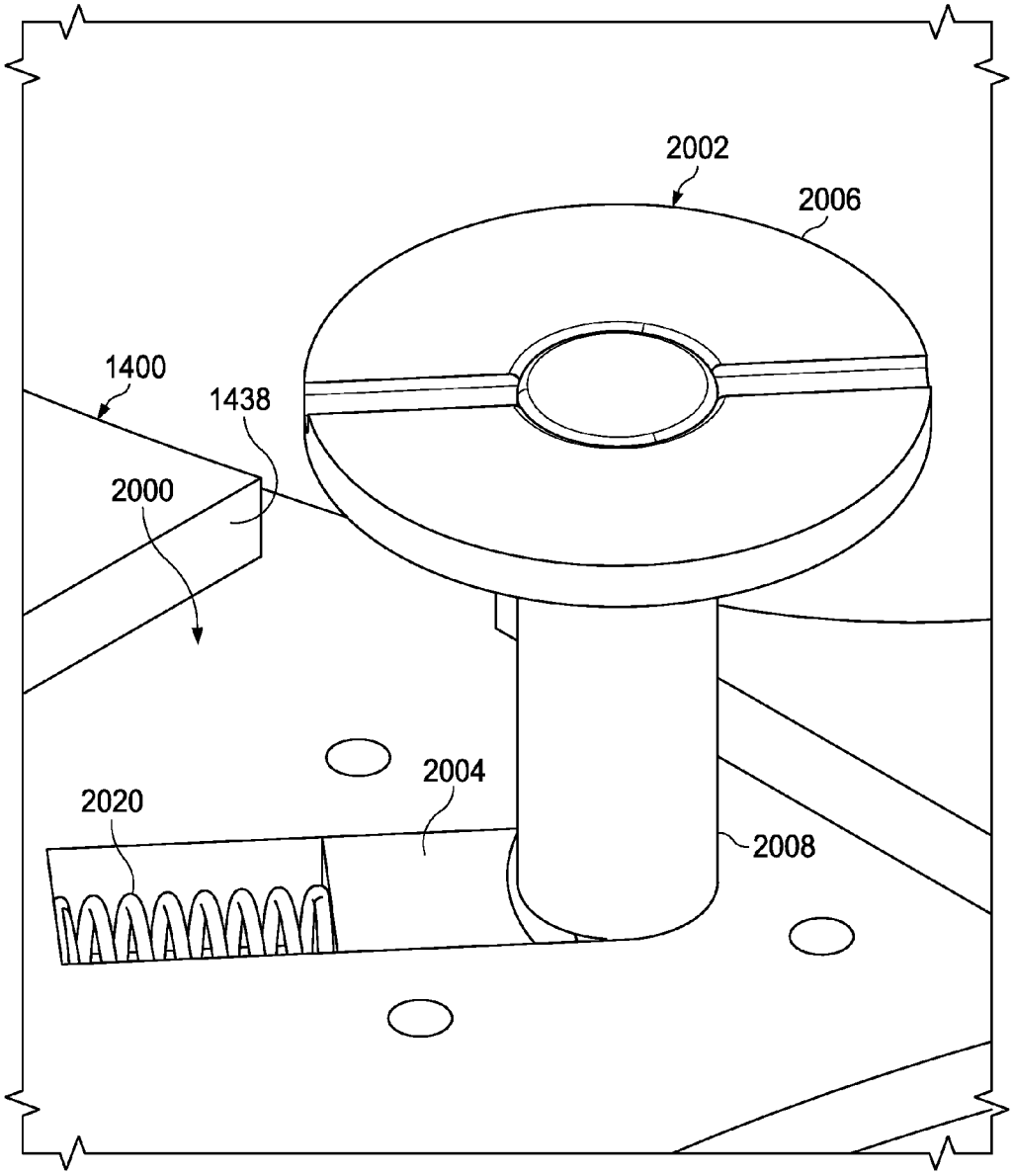
FIG. 42 is an oblique view of a retained stud of the attachment system of the wearable device of FIG. 1.
Figure 43:
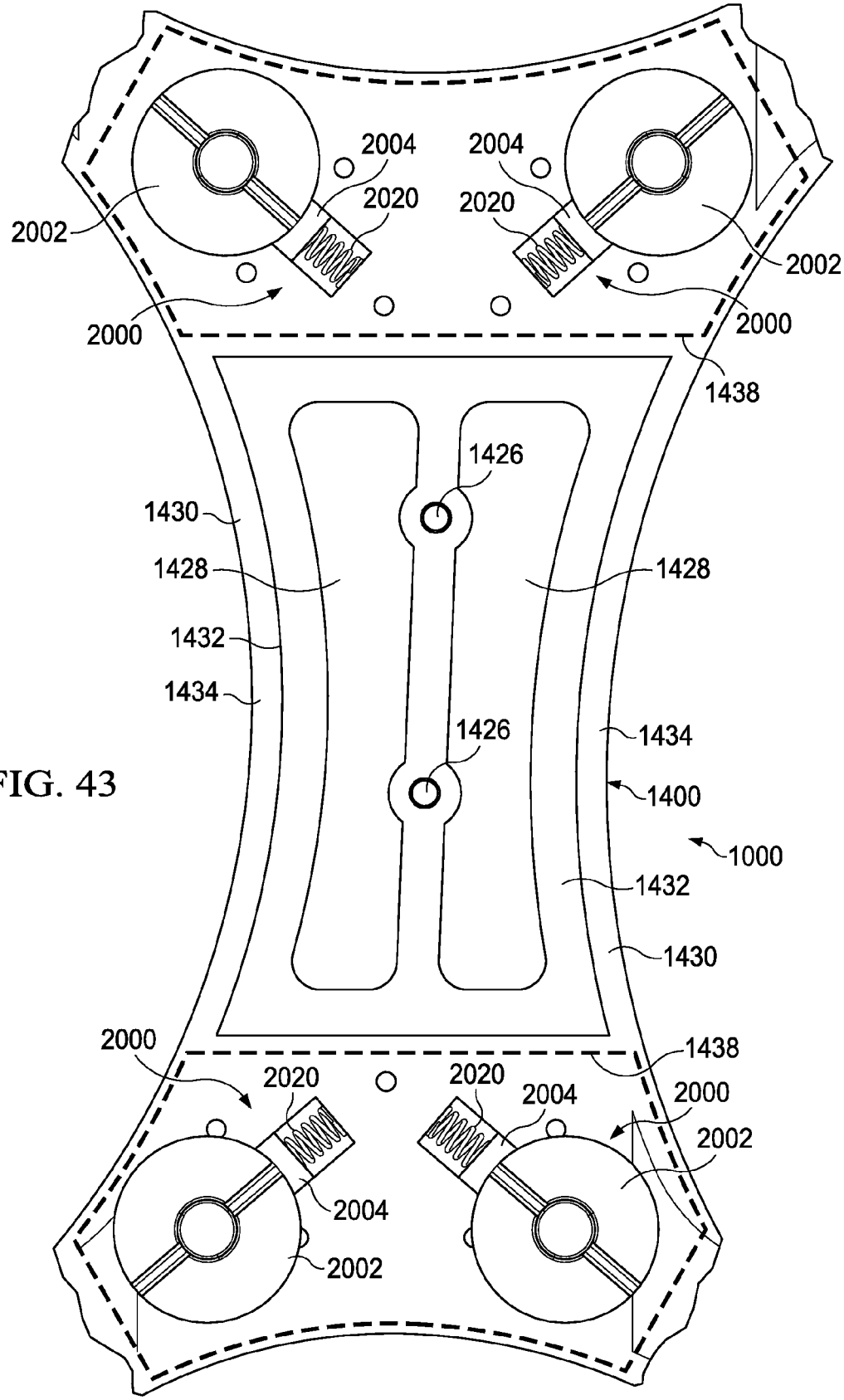
FIG. 43 is an orthogonal top view of all studs of the attachment system of the wearable device of FIG. 1 in a retained configuration.

Referring now to FIGS. 40-43, an orthogonal side view of a stud 2002 position in inserted but unlocked position is shown. With reference to FIGS. 42 and 43, it will be appreciated that retainers 2004 may be received within retainer channels 1446 of the frame 1400. Further, a spring 2020 may also be disposed within the retainer channels 1446 and may be used to bias the retainers 2004 within retainer channels 1446. As shown, cover plates 1440 may be used to retain the retainers 2004 and associated springs 2020 within the retainer channels 1446. Of course, for each attachment system 2000 covered by a cover plate 1440, the cover plate 1440 includes a stud aperture 1448 to allow the stud to access the retainer channel 1446 through the cover plate 1440. In particular, each cover plate 1440 is configured to retain the springs 2020 and the retainers 2004 of two attachment systems 2000. As shown, the cover plates 1440 may comprise countersunk apertures for receiving fasteners, such as, but not limited to, screws for fastening the cover plates 1440 to the frame 1400, and more particularly to substantially fill the plate indentions 1438.

As shown in FIG. 40, a stud 2002 may be considered in an unsecured and/or unretained position relative to the retainer 2004 even though the retainer 2004 is in contact with the stud shaft 2008. Such is the case because the projection 2014 of the retainer is not positioned relative to the stud 2002 to prevent vertical movement of the stud 2002.

Referring now to FIG. 41, the stud 2002 may be considered in a secured and/or retained position relative to the retainer 2004 because the retainer 2004 is positioned relative to the stud 2002 to prevent vertical movement of the stud 2002. As shown in FIG. 41, vertical movement of the stud 2002 may be prevented by the retainer 2004 because the hook 2010 is at least partially in position underneath the projection 2014 so that any upward movement of the stud 2002 is interfered with by obstruction of the hook 2010 by the projection 2014. In some embodiments, the stud 2002 may be removed from such a secured and/or retained position first by rotating the stud 2002 about its lengthwise axis by about one quarter turn so that the projection wall 2018 is contacting a portion of the stud shaft 2008 that is not shaped as a cam surface and/or that is not able to hook onto the projection 2014.

Referring now to FIG. 42, an oblique close up view of an attachment system is shown with the stud 2002 being retained to the frame 1400 by a retainer 2004. Referring now to FIG. 43, an orthogonal top view of four attachment systems 2000 is shown. The studs 2002 of each of the four attachment systems 2000 are shown as being retained by associated retainers 2004. In some cases where a shoe 1200 is removed from a frame 1400, one or more sole plugs may be use to plug the stud apertures 1448 and/or a sole insert may be removably attached to the outsole 1224 to fill the spaced defined by the sole cutout profile 1252 and the associated removed material.

In alternative embodiments of the wearable device 1000, alternative systems for selectively attaching the shoe 1200 to the frame 1400 may be provided. In some embodiments, the alternative attachment systems may comprise one or more push-buttons that may be configured to release one or more of the studs 2002 from associated retainers 2004 and/or their functional equivalents. In some embodiments, such push-buttons may be configured to release one or both of the front attachment points. In other embodiments, a single push-button may be configured to release all attachment points between the shoe 1200 and the frame 1400. Similarly, one or more rotatable elements may be configured to release one or more of the studs 2002 from associated retainers 2004 and/or their functional equivalents. For example, in some embodiments, a rotatable element may be associated with sliding bars configured to selectively engage the retainers 2004 in a manner that allows selective release of the studs 2002 in response to a rotational movement of the rotatable element. In some embodiments, one or more of the rotatable elements and/or the push-buttons may be conveniently carried within one or more of the trunk 1404 of the frame, the intermediate sole 1238 of the shoe, and/or any other suitable conveniently accessible portion of the wearable device 1000.

This disclosure further provides methods of performing roller transportation using the above-described wearable device 1000 embodiments and the many disclosed alternative embodiments. A first method of performing roller transportation may comprise a user first inserting his foot into a shoe 1200 of a wearable device 1000. In some methods, the user may insert each of his feet into an appropriately designed and/or physically dimensioned shoe 1200 of a wearable device so that the user is wearing two wearable devices 1000. In some embodiments, a user may desire to generate translational movement over the ground in a first direction. Accordingly, in some embodiments, the user may begin moving forward using a so-called "toe start" and/or so-called "sprint start" where the user proceeds to accelerate forward by walking and/or running substantially using the toes and/or balls of the user's feet. In some cases, the above-described toe start and/or sprint start may comprise the user contacting at least a portion of the front sole 1234 with the ground 1008 so that force may be transferred between the user and the ground 1008. As the user, in some cases, has reached a desired forward velocity, the user may thereafter convert from the toe start mode of transportation to a roller transportation type of transportation in which one or more of the wheel assemblies 1800 are used to traverse the ground 1008 as a result of the one or more tires 1804 contacting the ground for a period of time while the tire 1804 also rotates about an axis of rotation 1808.

In some embodiments, the above-described toe start may ensure that even while the user is accelerating using the above-described running action, the user's foot and/or ankle is flexed within a substantially normal range of motion for running. In some embodiments, allowing for such natural movement to accelerate the user may prevent injury and or allow greater acceleration as compared to other devices that may require toe starts outside the normal physiological range of motion. The above-described natural range of user physiological motion may, in some embodiments, be attributable to the wearable device 1000 providing the foot interface surface 1006 to remain relatively close to the ground 1008 during the toe start. In some embodiments, the toe start may be performed by lifting the rear tires 1804 from the ground 1008 and rotating the wearable device 1000 forward about one or more of the front axes of rotation 1808 until the front sole 1234 engages the ground 1008. With the front sole 1234 engaged with the ground, the user may transfer force to the ground 1008 directly through the sole 1204 in much the same manner the user would normally accelerate during regular running or walking. It will be appreciated that the user may effectively maintain, and in some cases even lower, centers of gravity during the above-described toe start.

In other embodiments, roller transportation may be accomplished using so-called "in-line skating methods" and/or so-called ice skating methods in which a user positions himself in a so-called "duck foot stance" where force is transferred from the user to the ground 1008 while ensuring the translation planes 1010 are not substantially parallel to the direction of the force applied to the ground (ignoring the vertical component of any force vectors). From such a stance, a user may either push against the ground to increase velocity and/or may push against the ground to start moving from a rest position.

In other embodiments, a velocity of roller transportation may be reduced and/or stopped by any one of dragging one or more tires 1804 against the ground 1008, dragging a portion of the sole 1204 against the ground 1008, and/or gradually coasting to a lower velocity as a result of naturally occurring friction forces attributable either to fluid flow resistance against the user and/or the wearable device 1000 and/or attributable to frictional forces resulting from relative movement of the components of the wearable device 1000 relative to other components of the wearable device 1000. In some embodiments, the wearable device 1000 may be decelerated in response to the user shifting a center of gravity or otherwise causing the wearable device to lift the front tires 1804 from the ground 1008, rotating the wearable device 1000 about one or more of the rear axes of rotation 1808, and engaging the rear sole 1236 with the ground 1008. This method of deceleration may be referred to as a heel stop. Another method of decelerating the wearable device 1000 may comprise the user reversing a direction of travel so that the user is travelling backward and thereafter shifting a center of gravity or otherwise causing the wearable device 1000 to lift the rear tires 1804 from the ground, rotating the wearable device 1000 about one or more of the front axes of rotation 1808, and engaging the front sole 1234 with the ground 1008. Of course, the above-described methods of accelerating and decelerating are only examples of how the wearable device 1000 may be operated and/or used and the wearable device 1000 is not limited to use in those manners only.

Alternative embodiments of the wearable device 1000 above may comprise materials and/or components selected and/or designed in response to a desired use of the wearable device 1000. For example, it may be desirable for a recreational and/or less experienced user of a wearable device 1000 to use a wearable device comprising tires 1804 constructed of about 80 to about 84 durometer material rating, for example, but not limited to, an 82A durometer rating material. In alternative embodiments, a material comprising a durometer rating of about 25 A or lower may be utilized but, in some embodiments, low durometer materials may result in system instability or so-called "high speed wobble" as a result of insufficient system stiffness. In some embodiments, a professional user of a wearable device 1000 may prefer tires 1804 constructed of a material having about a 90-92 durometer rating.

Similarly, it may be desirable for a recreational and/or less experienced user of a wearable device 1000 to use a wearable device comprising tires having a diameter of about 80 mm to about 84 mm in diameter while a professional and/or more experienced user of a wearable device may prefer a larger diameter tire of up to about 120 mm or even more in order to achieve desired speeds. Still further, it may be desirable for a recreational and/or less experienced user of a wearable device 1000 to use a standard and/or typical so-called "608 skate bearing" to serve as bearing 1812 while a professional and/or more experienced user of a wearable device 1000 may prefer to use bearing comprising ceramic or other specialized materials that reduce friction loss and/or provide other improvements over the standard 608 bearings. It will be appreciated that overall tire 1804 diameters may be selected from even less than 60 mm to above 120 mm and that tire 1804 durometer ratings may be selected from less than a rating of 25 A to above a rating of 95 A.

While some embodiments of a wearable device 1000 may comprise particular material used to form the various components of the device, alternative materials and/or compositions may be substituted. In some embodiments, one or more of the suspension spacer 1612, the bearing spacer 1814, and the frame 1400 may comprise so-called 6061-T6 aluminum. In other embodiments, one or more of the female axle bolt 1604 and the male axle bolt 1606 may comprise so-called 18-8 stainless steel. In still other embodiments, one or more of the inner tophat 1608 and the outer tophat 1610 may comprise a urethane material that may be generated using raw material supplied by BF Goodrich Company and which material may be used to generate materials comprising at least some material similarity to so-called polyurethane 95 A. In other embodiments, the frame 1400 and/or other components of the wearable device 1000 may comprise cast aluminum, plastic, resin, urethane, polyurethane, and/or any other suitable material.

In alternative embodiments, different types of shoes may be used. For example, heavy duty leather boots with uppers that extend above the ankle of a user may be used to provide increased support and/or increased force transfer. In some cases, such increased strength shoes may be preferred by professional and/or more skilled users of roller transportation devices such as wearable device 1000. In other embodiments, only partial shoes (i.e., only a heel portion, only a toe portion, or only straps and/or laces emulating a shoe) may be used to connect the user's foot to the wearable device 1000. In some embodiments, sole plugs may be provided to fill sole holes 1254 when studs 2002 are not inserted therethrough. Additionally, some embodiments may provide access holes formed in the upper 1202 to allow access to the frontward located rivets, mounting bolts, or studs 2002. Still further, in some embodiments, a conventional shoe may simply be strapped atop a frame 1400 rather than including the above-described attachment system 2000. In some embodiments, a side portion of the sole 1204 may be recessed to accept a portion of the frame 1400, the suspension 1600, and/or the wheel assembly 1800.

In yet other embodiments, the frame 1400 may comprise a plurality of adjustable components. For example, a frame 1400 may comprise an adjustable length trunk 1404, branch 1406, and/or suspension block 1408. Still further, in some embodiments, the outer angle 1418 at which the trunk and branches interface with each other may be adjustable. In other embodiments, the frame may comprise flexible components that provide additional mechanical suspension of the wheel assemblies 1800. Further, in other embodiments, more or fewer than four wheel assemblies 1800 may be used and the relative location, size, and force transfer capabilities of the wheel assemblies 1800 may be varied.

Figure 44:
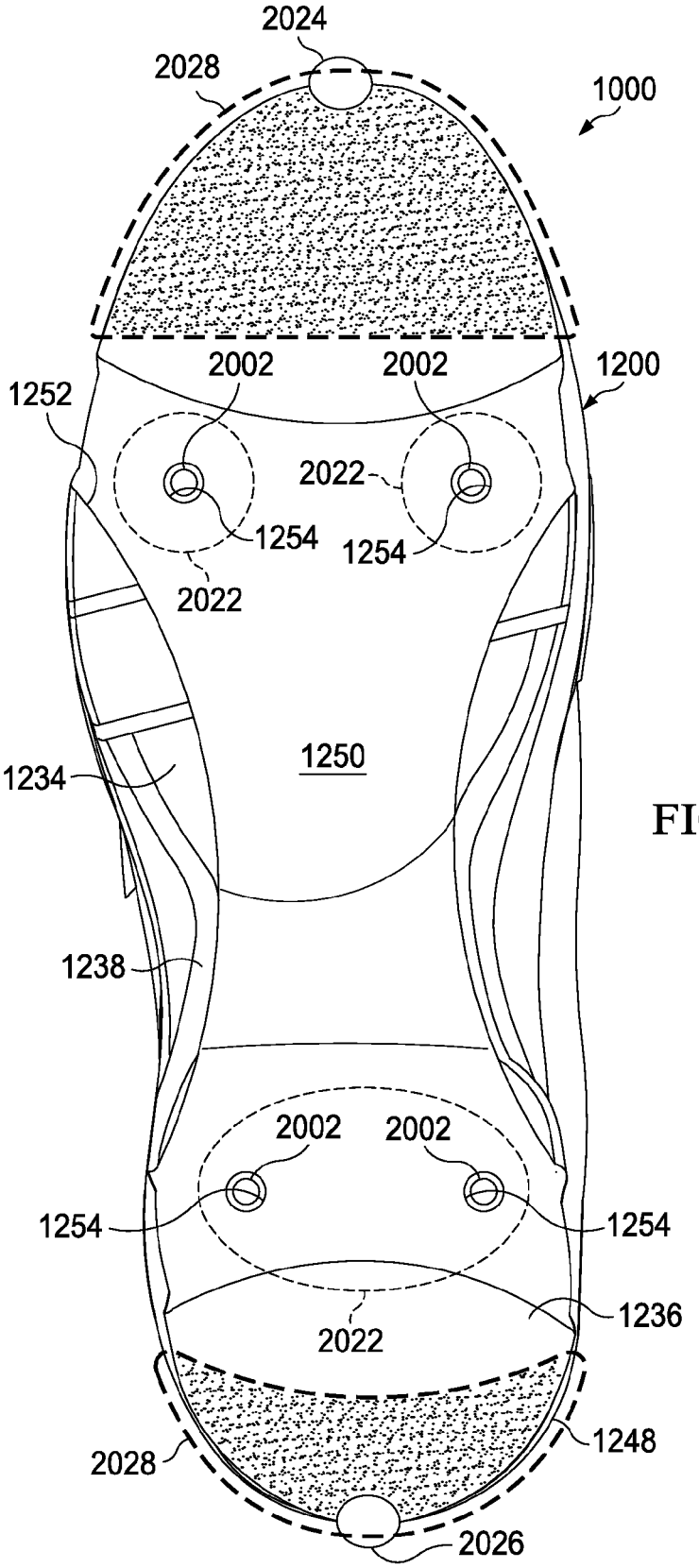
FIG. 44 is an orthogonal bottom view of the shoe of the wearable device of FIG. 1.

Referring now to FIG. 44, a simplified orthogonal bottom view of the shoe 1200 that is fully removed from the frame 1400 is shown with studs 2002 extending through sole holes 1254 of the sole 1204. FIG. 44 shows that stud plates 2022 may be embedded within the sole 1204 to provide increased stability for the studs 2002. In some embodiments, the stud plates 2022 may be embedded within the sole 1204 between the outsole 1224 and the midsole 1226, however, in other embodiments, the stud plates 2022 may be located in any other suitable portion of the sole 1204 and/or shoe 1200. In some embodiments, a separate stud plate 2022 may be provided for each of the front located studs 2002 while a single stud plate 2022 may be used in association with both of the rear studs 2002. Of course, in further alternative embodiments, each stud 2002 may be provided a separate stud plate 2022. The stud plates 2022 may contribute to an overall strength with which the frame 1400 is connected to the shoe 1200, thereby preventing inadvertent separation of the frame 1400 and the shoe 1200 during vigorous use of the wearable device 1000. While the stud plates 2022 are shown as comprising a particular shape, the stud plates may alternatively comprise rectilinear, polygonal, and or any shape. In some embodiments, the stud plates 2022 may comprise metal, plastic, resin, urethane, polyurethane, and/or any other material suitable to provide the above-described strengthening. In some cases, providing the separate and unattached front stud plates 2022 may allow for increased flexibility of the front sole 1234 which may further provide for easier force transfer to the front wheels in a selective manner to allow easier turning and/or steering in response to the user leaning and/or shifting a center of gravity. Similarly, the provision of separate front stud plates 2022 may allow for increased lateral (non-vertical) force transfer through the front studs during such steering and/or turning and/or during motions used to generate acceleration or deceleration.

FIG. 44 further shows that a wearable device 1000 may comprise integral and/or removable front wear pads 2024 and/or rear wear pads 2026. The front wear pads 2024 and rear wear pads 2026 may be optional and may comprise wear resistant materials that may be useful in providing increased and/or decreased frictional interaction with the ground 1008. In some embodiments, the frictional characteristics of the wear pads 2024 and 2026 may be chosen to provide greater friction than other components of the sole 1204 while in other embodiments, the wear pads 2024 and/or 2026 may provide a decreased friction as compared to the friction provided by the sole 1204. In some cases, the wear pads 2024 and 2026 may be provided as throw away or sacrificial components used to prolong the useful life of the shoe 1200. In alternative embodiments, wear pads may be provided in any suitable shape, material composition, and or location on the wearable device 1000 so as to provide desired improved acceleration capability, deceleration capability, wear resistance, and/or protection of the wearable device 1000 and/or the environment in which the wearable device 1000 may be used. While the wear pads 2024 and 2026 are shown in FIG. 44 as being provided on and/or carried by sole 1204, in alternative embodiments, wear pads 2024 and/or 2026 may be configured for selective attachment to the frame 1400 and/or other portions of the shoe 1200.

Additionally, abrasion zones 2028 may be provided in the shoe 1200. In some embodiments, abrasion zones 2028 may comprise materials having relatively higher abrasion resistance as compared to other portions of the shoe 1200 and particularly as compared to other portions of the sole 1204. In some embodiments, abrasion zones 2028 may be provided at one or more of the front portion of the front sole 1234 and at the rear portion of the rear sole 1236. The material of the abrasion zone may be substantially similar to aircraft tire material and/or any other suitable high abrasion resistant material. In some embodiments, the abrasion resistant material may be selected as a so-called "non-marking" material to prevent the ground 1008 from being marked or otherwise discolored or damaged in response to interaction with the abrasion zones 2028.

Figure 45:
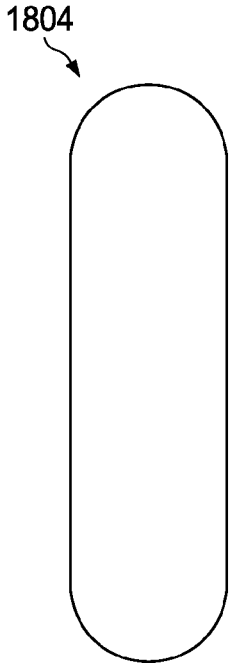
FIG. 45 is an orthogonal front view of a tire of the wearable device of FIG. 1.
Figure 46:
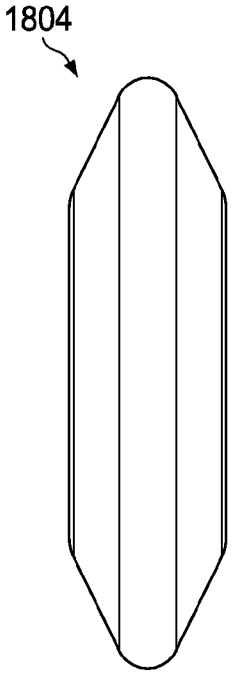
FIG. 46 is an orthogonal front view of an alternative tire for the wearable device of FIG. 1.

Referring now to FIGS. 45 and 46, two variants of tires 1804 are shown. FIG. 45 shows that a tire 1804 may comprise a substantially gradually rounded profile for interfacing the ground 1008. FIG. 46, as compared relatively to FIG. 45, shows that a tire 1804 may comprise a sharper and/or more pointed profile for interfacing the ground 1008. It will be appreciated that variation of the tire profile, much like in the variation of motorcycle and/or bicycle tire profiles, may greatly contribute to the stability and/or the maneuverability of the wearable device 1000. For example, a beginner user of a wearable device may prefer the tire 1804 of FIG. 45 over the tire 1804 of FIG. 46. In some embodiments, the tire 1804 of FIG. 45 may provide more stability and more gradual turning in response to the user shifting a center of gravity. However, the tire 1804 of FIG. 45, as compared to the tire 1804 of FIG. 46 may limit the responsiveness and sharpness with which the user may turn and/or steer the wearable device 1000 in response to shifting a center of gravity. Accordingly, in some cases, a professional and/or more experienced wearable device 1000 user may prefer the tire 1804 of FIG. 46 over the tire 1804 of FIG. 45 to allow greater control and quicker response to such efforts to turn or otherwise maneuver the wearable device 1000. It will be appreciated that, in some embodiments, the tires 1804 and/or the wheel assemblies 1800 may comprise any type of wheel and/or tire. However, selection of the wheels and/or tires may affect performance characteristics of a wearable device 1000. As an example, some relatively taller and narrower skate wheels and/or tires, such as those often associated with in-line skates, may allow an increased ability to achieve higher speeds as compared to shorter and wider wheels and/or tires, such as those often associated with quad roller skates and skateboards. On the other hand, the shorter, wider wheels and/or tires may provide improved stability as compared to the taller, narrower wheels and/or tires. In some embodiments, tires 1804 may comprise a height significantly greater than a side to side thickness of the tires 1804. In some embodiments, the taller, narrower skate wheel and/or tire may be modified for use in association with the wearable device 1000. For example, a side wall and/or a side to side thickness of a wheel may be reduced to accommodate the geometry of the suspension 1600. Taller wheels and/or tires 1804 may provide improved speed capabilities and/or improved turning capabilities as compared to standard shorter, wider wheels. Nonetheless, in some embodiments, shorter, wider wheels and/or skateboard wheels may be used as a component of wheel assemblies 1800. Further, alternative wheel and/or tire types may be used in association with wheel assemblies 1800. For example, so-called balloon tires, so-called off-road tires, pneumatic tires, and/or any other suitable tire and/or wheel may be incorporated into wheel assemblies 1800. No matter what type of wheel and/or tire 1804 is used, consideration must be given to whether the side to side width of the wheel and/or tire 1804 may undesirably contribute to interference between a wearable device 1000 worn on a left foot of a user and a separate wearable device 1000 worn on a right foot of a user.

Figure 47:
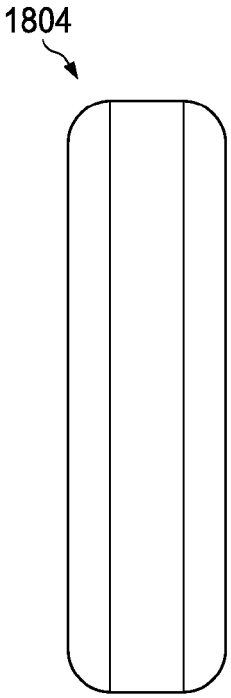
FIG. 47 is an orthogonal front view of another alternative tire for the wearable device of FIG. 1.

Referring now to FIG. 47, a tire 1804 is shown as comprising a relatively flat ground contact profile (as compared to the tires 1804 of FIGS. 45 and 46). The tire 1804 of FIG. 47 may provide increased stability and/or traction but may lower an ease with which higher velocities may be accomplished as compared to the tires 1804 of FIGS. 45 and 46. In some embodiments, the tire 1804 of FIG. 47 may be well suited for an inexperienced user of wearable devices 1000 or for a user who may want to purposefully limit the accomplishment of high velocities and/or inadvertent turning.

Figure 3:
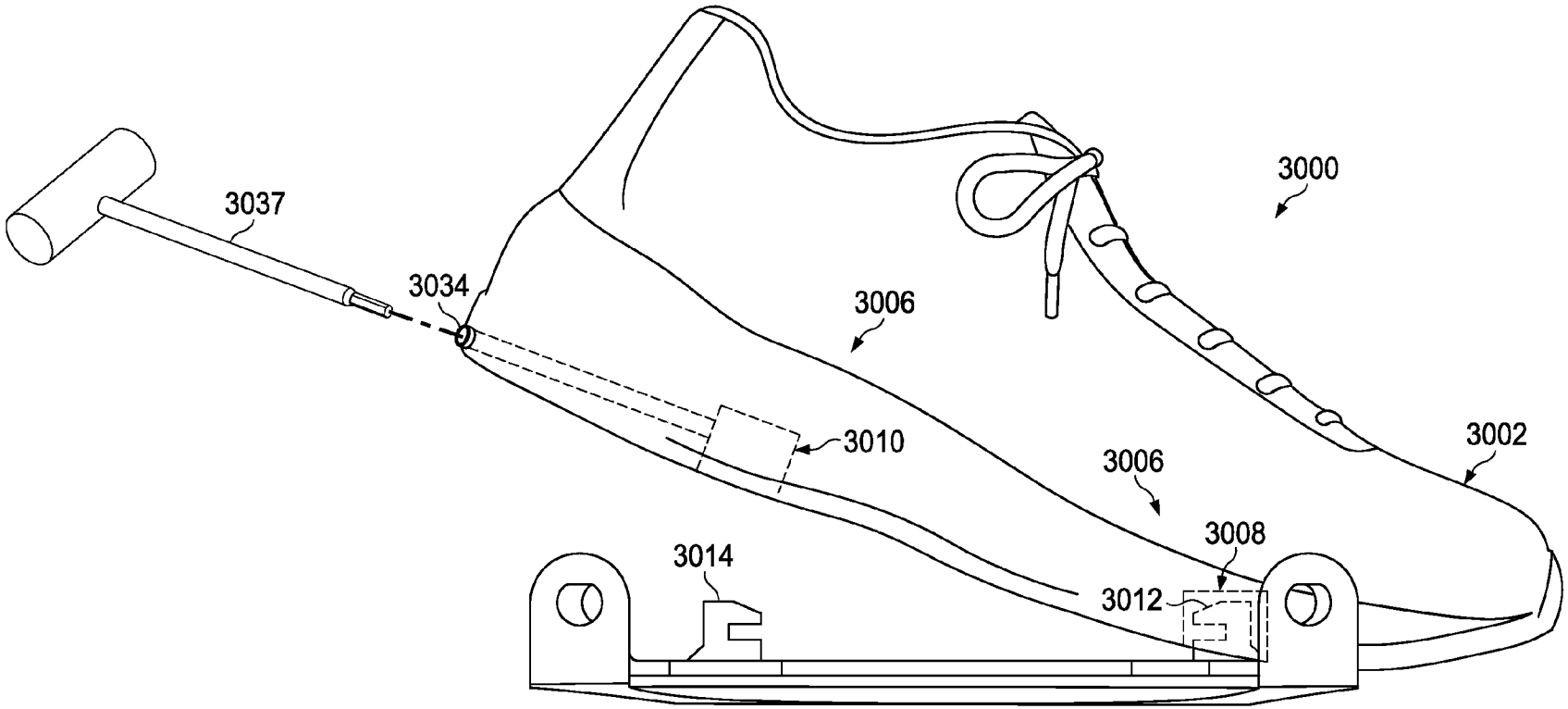
FIG. 3 is a partial orthogonal side view of another wearable device in a partially disassembled state according to an embodiment of the disclosure.
Figure 4:
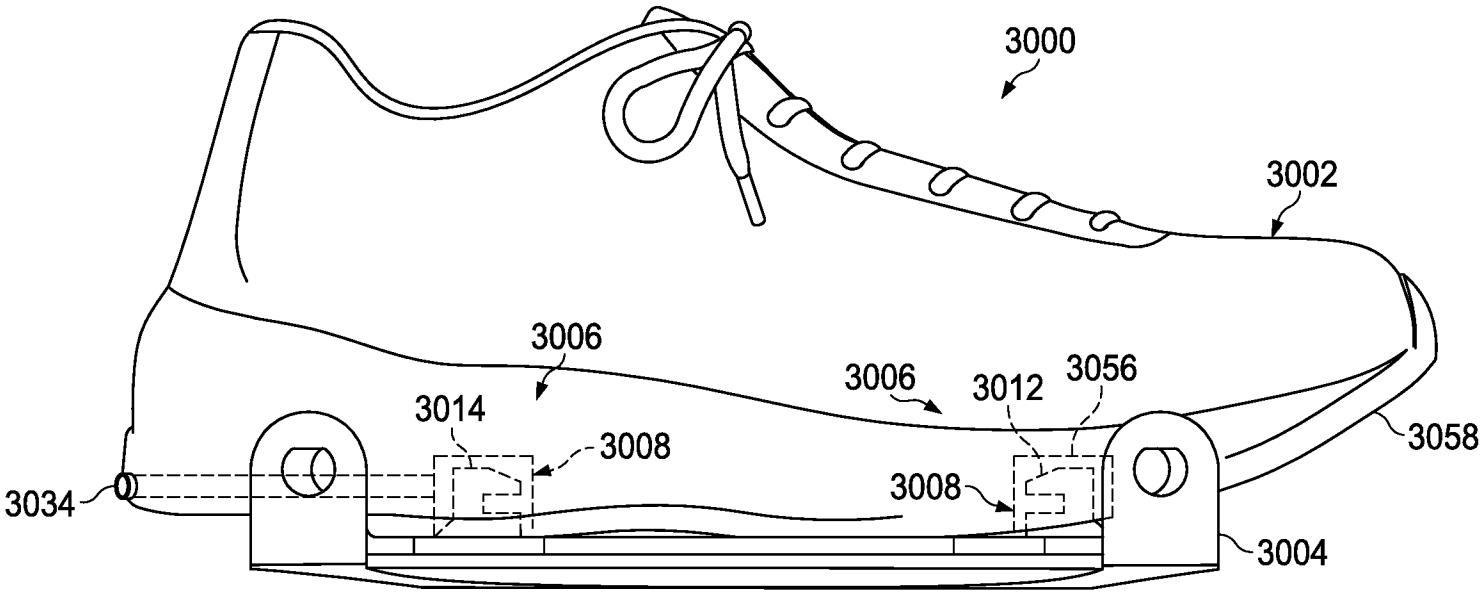
FIG. 4 is a partial orthogonal side view of the wearable device of FIG. 3.

The above described turning and maneuvering in response to a user shifting a center of gravity may, in some embodiments, may be attributable to well known factors of tire contact patch areas, tire slip angles which may contribute to cornering force, and tire camber angles which may contribute to camber thrust. These factors and principles of tires physics may, in some embodiments, contribute to the overall stability and responsiveness of a wearable device 1000. Accordingly, any of the above-described embodiments of wearable devices 1000 may be provided with tires 1804 and/or wheel assemblies 1800 comprising various tire 1804 profiles and/or various tire 1804 camber angles. In some embodiments, the tire 1804 profiles and the tire 1804 camber angles of a wearable device 1000 may be selected to be substantially equal when in a loaded state and/or an unloaded state. However, in alternative embodiments, the tire 1804 profiles and/or camber angles and/or other wheel assembly 1800 physical configurations affecting the tires 1804 and their interaction with the ground 1008 may be unequal amongst the set of tires 1804 of the wearable device 1000. Further, it will be appreciated that due to the wearable device 1000 comprising independent suspensions 1600, the individual characteristics of each tire 1804 of a wearable device 1000 and each tire's response to perturbation may vary from other tires 1804 of the same wearable device in order to provide improved shock absorption and/or improved maneuverability Referring now to FIGS. 3 and 4, an alternative embodiment of a wearable device 3000 is shown. Wearable device 3000 generally comprises a shoe 3002, a frame 3004, and an attachment system 3006. The wearable device 3000, in some embodiments, also comprises suspensions substantially similar to suspensions 1600 and wheel assemblies substantially similar to wheel assemblies 1800. Shoe 3002 is substantially similar to shoe 1200 but may be configured to complement the attachment system 3006 instead of attachment system 2000. Similarly, frame 3004 is substantially similar to frame 1400 but may be configured to complement the attachment system 3006 instead of attachment system 2000. Attachment system 3006 generally comprises a forward connection portion 3008 and a rear connection portion 3010. FIG. 4 shows the shoe 3002 connected to the frame 3004 via both the forward connection portion 3008 and the rear connection portion 3010. FIG. 3 shows the shoe 3002 connected to the frame 3004 via only the front connection portion 3010.

Figure 5:
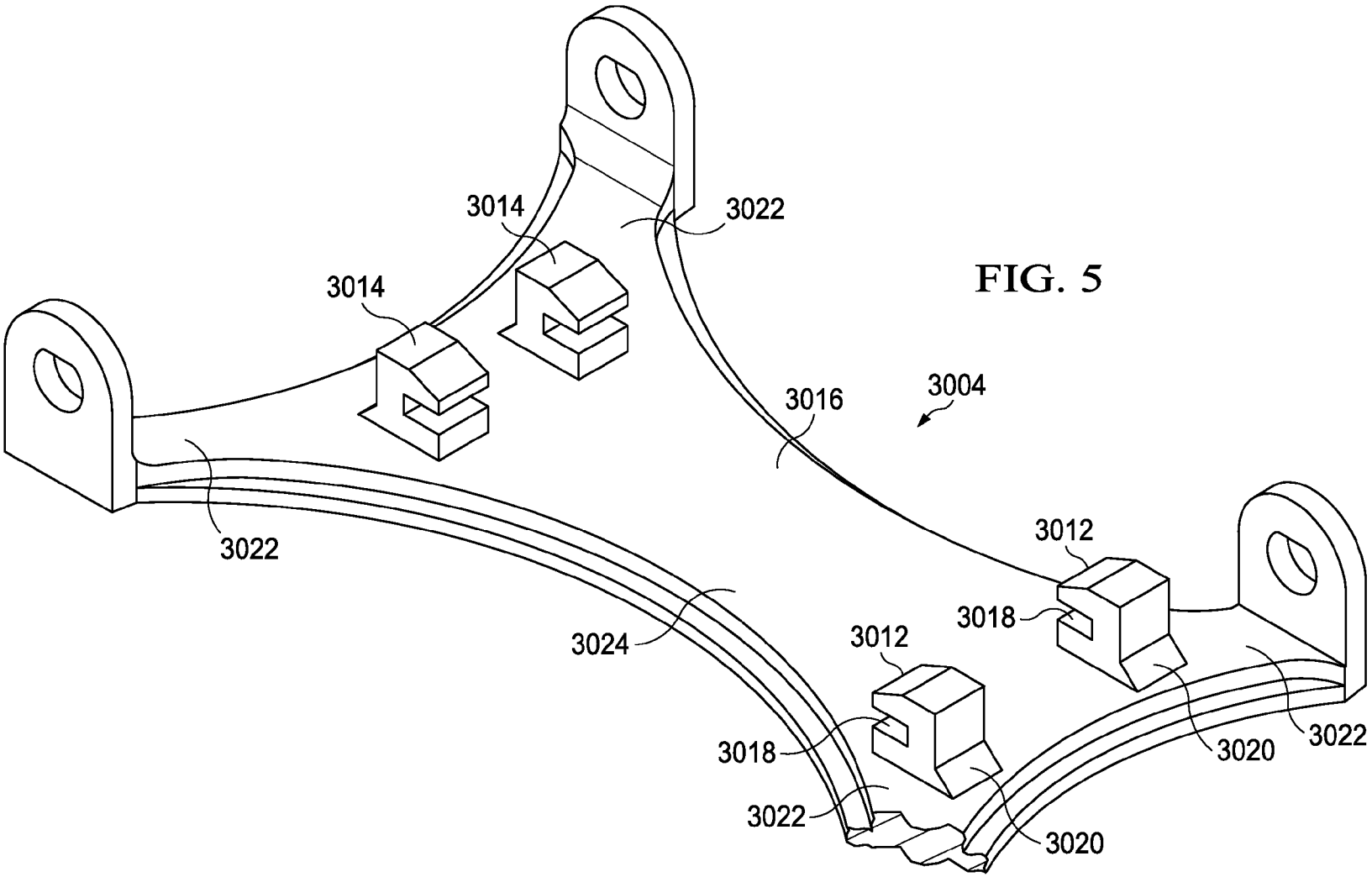
FIG. 5 is a partial oblique top view of a frame of the wearable device of FIG. 3.

Referring now to FIG. 5, an oblique top view of the frame 3004 is shown. The frame 3004 comprises a plurality of front lock blocks 3012 and a plurality of rear lock blocks 3014. In this embodiment, the front lock blocks 3012 extend generally vertically upward from upper interface surface 3016 of frame 3004. Each front lock block 3012 generally comprises a rectangular box-like structure comprising a recessed slot 3018 that is open to the rear, right, and left extents of the front lock blocks 3012. In other words, as viewed from the left or right sides, the front lock blocks 3012 may generally comprise a C-shaped structure open toward the rear of the frame 3004. In this embodiment, each front lock block 3012 further comprises a fortified base extension 3020 that is generally shaped as a sloped wall extending slightly further forward as compared to a remainder of the front lock blocks 3012. In this embodiment, the front lock blocks 3012 may be formed integrally with the frame 3004 by milling and/or machining the frame 3004 and the front lock blocks 3012 from a unitary piece of metal. However, in other embodiments, front lock blocks 3012 may comprise material different than the frame 3004 and may be attached to the frame 3004 using mechanical fasteners, adhesives, welding, soldering, brazing and/or any other suitable manner of joining the front of lock blocks 3012 to the frame 3004. In this embodiment, one of the front lock blocks 3012 is generally positioned to be associated with a front right branch 3022 of the frame 3004 while the other front lock block 3012 is generally positioned to be associated with a front left branch 3022 of the frame 3004. In alternative embodiments, one or more of the front lock blocks 3012 may be positioned at least partially on the trunk 3024 of the frame 3004. Still further, in some embodiments, front lock blocks 3012 may be selectively removable and/or conveniently replaceable.

In this embodiment, the rear lock blocks 3014 extend generally vertically upward from upper interface surface 3016 of frame 3004. Each rear lock block 3014 generally comprises a rectangular box-like structure comprising a recessed slot 3018 that is open to the front, right, and left extents of the rear lock blocks 3014. In other words, as viewed from the left or right sides, the rear lock blocks 3014 may generally comprise a C-shaped structure open toward the front of the frame 3004. In this embodiment, each rear lock block 3014 further comprises a fortified base extension 3020 that is generally shaped as a sloped wall extending slightly further rearward as compared to a remainder of the rear lock blocks 3014. In this embodiment, the rear lock blocks 3014 may be formed integrally with the frame 3004 by milling and/or machining the frame 3004 and the rear lock blocks 3014 from a unitary piece of metal. However, in other embodiments, rear lock blocks 3014 may comprise material different than the frame 3004 and may be attached to the frame 3004 using mechanical fasteners, adhesives, welding, soldering, brazing and/or any other suitable manner of joining the rear lock blocks 3014 to the frame 3004. In this embodiment, the rear lock blocks 3014 are generally offset from each other by less distance than the distance by which the front lock blocks 3012 are offset from each other. In this embodiment, rear lock blocks 3014 are located substantially at a rear end of the trunk 3024. In alternative embodiments, one or more of the rear lock blocks 3014 may be positioned at least partially on a rear left and/or rear right branch 3022 of the frame 3004. Still further, in some embodiments, rear lock blocks 3014 may be selectively removable and/or conveniently replaceable. While this embodiment comprises only two front lock blocks 3012 and two rear lock blocks 3014, alternative embodiments may comprise more or fewer front lock blocks 3012 and rear lock blocks 3014 and the locations of the lock blocks 3012, 3014 may be different.

Figure 6:
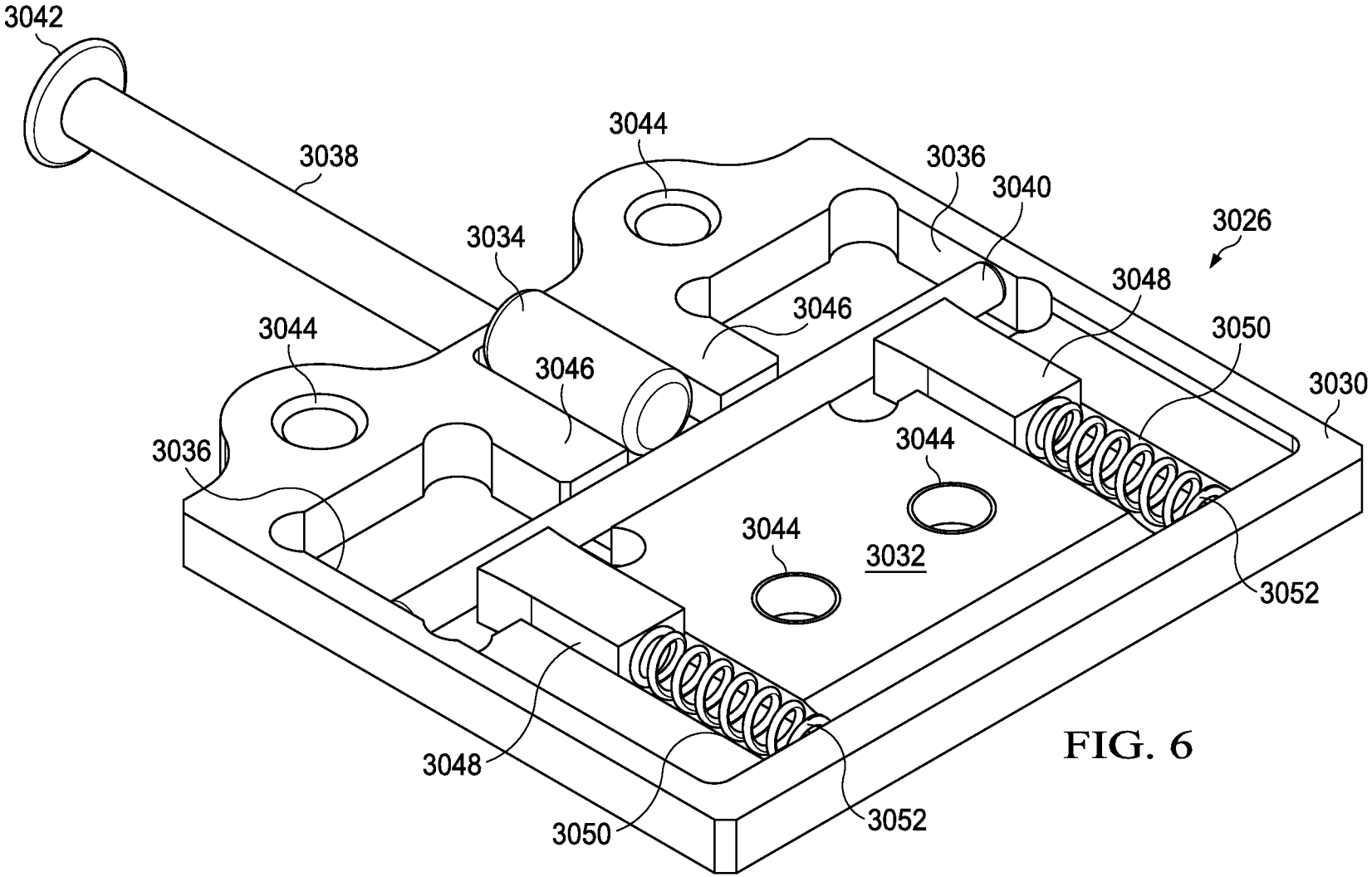
FIG. 6 is a partial oblique top view of an attachment system of the wearable device of FIG. 3.
Figure 7:
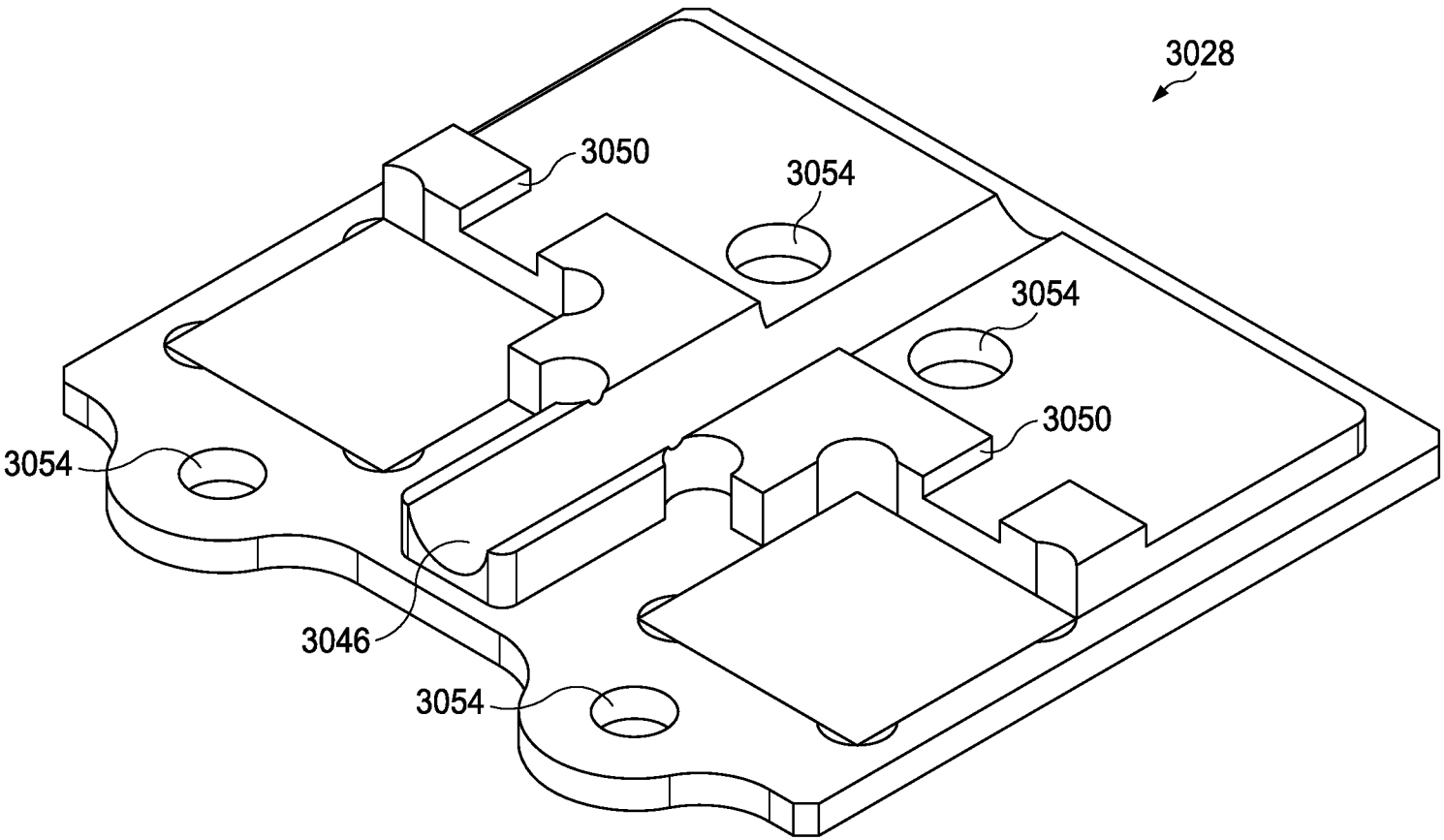
FIG. 7 is a another partial oblique view of an attachment system of the wearable device of FIG. 3.

Referring now to FIGS. 6 and 7, a lock box assembly 3026 of the rear connection portion 3010 of attachment system 3006 is shown. FIG. 6 is an orthogonal top view of the lock box assembly 3026 in a partially unassembled state with a lock box lid 3028 removed. The lock box assembly 3026 generally comprises a substantially rectangular box 3030 comprising an inner box space 3032. The inner box space 3032 is accessible from outside the box 3030 via a guided channel port 3034 and via one or both of block apertures 3036. As shown in FIGS. 3 and 4, the guided channel port 3034 is generally open toward the rear of the wearable device 3000 while the block apertures 3036 are generally open toward a bottom side of the wearable device 3000. The block apertures 3036 are generally sized and shaped to complement the rear lock blocks 3014 in manner that allows selective entry of at least a portion of the rear lock blocks 3014 into the inner box space 3032. A guide tube 3038 is connected to box 3030 so that guided channel port 3034 opens into an interior of the guide tube 3038. The lock box assembly 3026 further comprises a spring biased crossbar 3040 that may be selectively received within the recessed slots 3018 of rear lock blocks 3014 as described in greater detail below.

The lock box assembly 3026 comprises a plurality of features configured to allow selective movement of the crossbar 3040. The guide tube 3038 is configured to allow insertion of a rod, stick, or other appropriately sized and sufficiently rigid member into an entry 3042 of the guide tube 3038. The rigid member may be extended through the interior of the guide tube 3038 and through the guided channel port 3034. In some embodiments, a cylindrical spacer 3044 that is generally captured between walls 3046 may abut a rearward portion of the crossbar 3040. A forward portion of the crossbar 3040 may be abutted by spring sliders 3048. Spring sliders 3048 may be captured in slider channels 3050 that generally extend in forward-rearward directions. Slider springs 3052 may also be disposed in slider channels 3050 to provide biasing forces to the spring sliders 3048, crossbar 3040, and a cylindrical spacer 3044. The box 3030 further comprises fastener apertures 3054 for receiving fasteners configured to connect lock box lid 3028 to box 3030. The lock box lid 3028 also comprises fastener apertures 3054.

Figure 8:
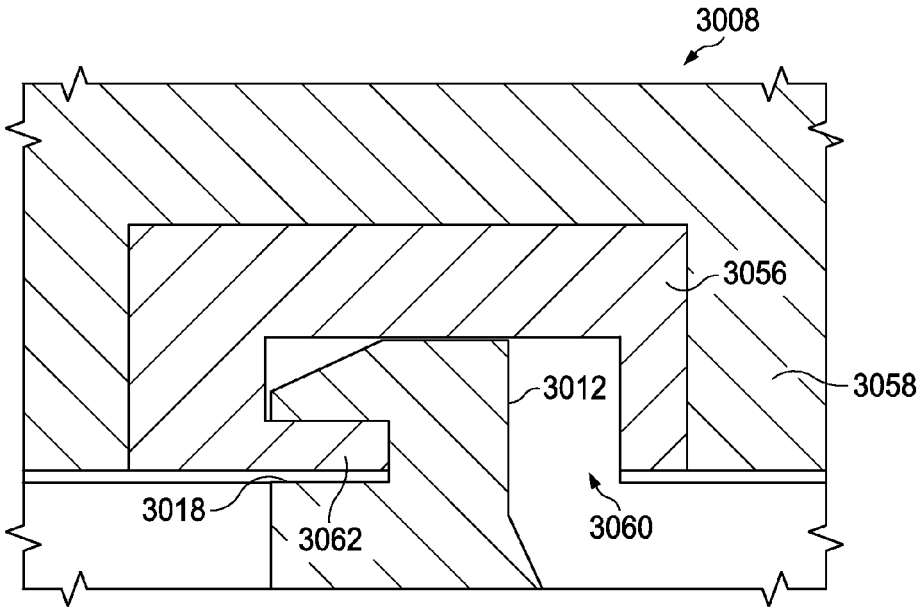
FIG. 8 is a partial orthogonal cross-sectional side view showing a portion of the frame of FIG. 5 connected to the attachment system of the wearable device of FIG. 3.

Referring now to FIG. 8, an orthogonal side view of a cross-section of a catch block 3056 of the forward connection portion 3008 of attachment system 3006 is shown. As shown in FIGS. 3 and 4, the forward connection portion 3008 is at least partially disposed in the sole 3058 of the shoe 3002. In this embodiment, the catch block 3056 comprises a substantially rigid rectangular block and/or beam configured to have downward facing block entrances 3060 sized, shaped, and otherwise configured to receive at least a portion of front lock blocks 3012. In this embodiment, each block entrance 3060 is further associated with a block shelf 3062 that extends forward and is sized complementary to the recessed slot 3018 of the front lock block 3012. While the catch block 3056 comprises two block entrances 3060 that are arranged for interfacing with front lock blocks 3012, in alternative embodiments, the attachment system 3006 may comprise, for example, two separate catch blocks 3056, each catch block 3056 comprising only one block entrance 3060. In this embodiment, a portion of the outsole 3064 is shown as being received within the recessed slot 3018. However, in alternative embodiments, the outsole 3064 may not extend below the block shelf 3062, and therefore, the block shelf 3062 may be vertically thicker to more fully fill the recessed slot 3018.

Referring now to FIGS. 3-8, the wearable device 3000 may be selectively operated to attach the shoe 3002 to the frame 3004. In some embodiments, a method of attaching the shoe 3002 to the frame 3004 may comprise orienting the bottom of the shoe 3002 toward the upper interface surface 3016 of the frame 3004. Next, the block entrances 3060 may be oriented directly above front lock blocks 3012. With the shoe 3002 slightly flexed as shown in FIG. 3, an offset distance between the shoe 3002 and the frame 3004 may be reduced until the front lock blocks 3012 have entered sufficiently into the catch block 3056 so that the block shelf 3062 is vertically lower than an uppermost wall defining the recessed slots 3018 of the front lock blocks 3012. Next, the shoe 3002 may be moved forward relative to the frame 3004 so that the block shelves 3062 of the catch blocks 3056 are received within the recessed slots 3018. Next, without moving the shoe 3002 forward or rearward relative to the frame 3004, the shoe 3002 may be straightened. As the shoe 3002 is straightened, the rear lock blocks 3014 may be partially received within the inner box space 3032 of the lock box assembly 3026. By further straightening the shoe 3002 and/or otherwise lowering the sole 3058 toward the frame 3004, an upper portion of the rear lock blocks 3014 may contact the spring biased crossbar 3040. In some embodiments, the upper portion of the rear lock blocks 3014 may be sloped to encourage forward sliding of the crossbar 3040 as the rear lock blocks 3014 are increasingly received into the lock box assembly 3026. After sufficient introduction of the rear lock blocks 3014 into the inner box space 3032, the rearward spring biased of the crossbar 3040 may cause the crossbar 3040 to enter into the recessed slots 3018 of the rear lock blocks 3014. In some embodiments, such entry of the crossbar 3040 into the recessed slots 3018 may signify that the shoe 3002 is fully attached to the frame 3004. With the shoe 3002 attached to the frame 3004, a user may begin roller transportation using the wearable device 3000.

In some embodiments, the wearable device 3000 may be operable to selectively remove the shoe 3002 from the frame 3004. A first step in removing the shoe 3002 from the frame 3004 may comprise inserting a sufficiently rigid rod, in some embodiments, the rod being a portion of a so-called T-tool 3037 (see FIG. 3), into the guide tube 3038 via the entry 3042. In some embodiments, a tip of the T-tool 3037 may comprise a hex tool or hex wrench. After sufficient introduction of the sufficiently rigid rod into the guide tube 3038, the rod may contact the cylindrical spacer 3044. By applying a forward force to the rod, the cylindrical spacer 3044 may be displaced forward relative to the walls 3046, thereby contacting and forwardly displacing the crossbar 3040. After sufficient displacement of the crossbar 3040, the crossbar 3040 may become fully removed from the recessed slots 3018 of the rear lock blocks 3014. With the crossbar 3040 removed from the recessed slots 3018, the shoe 3002 may be flexed from a position shown in FIG. 4 to a position shown in FIG. 3. With the shoe 3002 flexed as shown in FIG. 3, the shoe 3002 may be moved rearward relative to the frame 3004. With sufficient rearward movement of the shoe 3002 relative to the frame 3004, the block shelves 3062 may become fully removed from the recessed slots 3018 of the front lock blocks 3012. With the block shelves 3062 fully removed from the recessed slots 3018, shoe 3002 may be fully removed from the frame 3004 by increasing a vertical offset distance at least until the rear lock blocks 3014 are no longer received within the catch block 3056.

In some embodiments, a tip of the T-tool 3037 may comprise a hex tool or hex wrench. In some embodiments, the T-tool 3037 may be used to effectuate connection and/or removal of a shoe to a frame as well as to attach and/or remove a wheel assembly and/or a suspension to a frame. Further, in some embodiments, with appropriate configuration of bolt heads and/or attachment system actuation mechanisms, a single tool, such as, but not limited to, the T-tool 3037, may be configured to be the only tool necessary to fully or nearly fully disassemble and/or reassemble the wearable devices.

Figure 9:
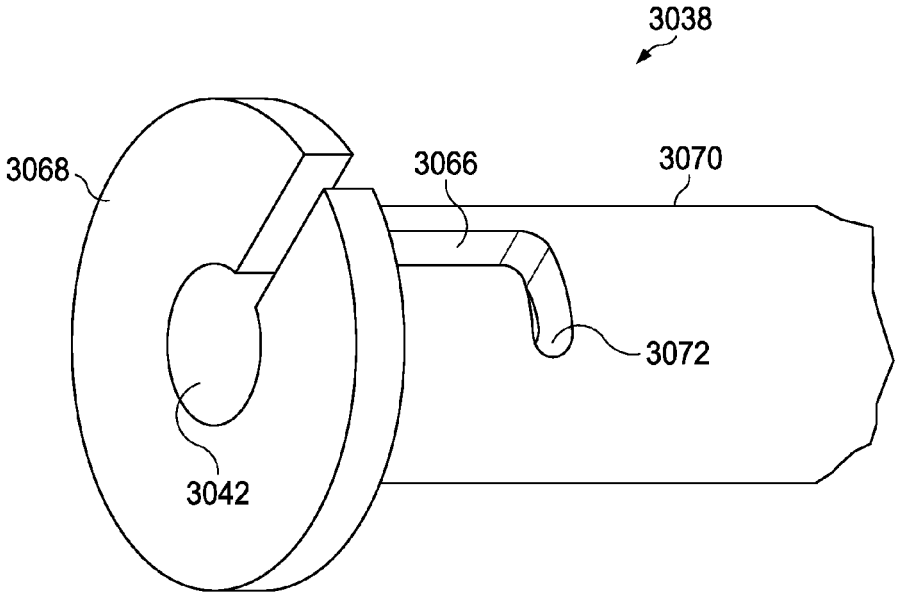
FIG. 9 is a partial oblique side view of a guide tube.

Referring now to FIG. 9, an oblique side view of an alternative embodiment of a guide tube 3038 is shown. In this embodiment, the guide tube 3038 further comprises an L-shaped slot 3066 extending through an end collar 3068 and the tube wall 3070. In some embodiments, the above-described long rod may comprise a radially extending pin configured to travel along the L-shaped path of the L-shaped slot 3066 by passing forward through the pin and along the tube wall 3070 until the pin is obstructed by the tube wall 3070. Once the pin is obstructed by the tube wall 3070, the rod may be rotated so that the pin rotates angularly through the slot until the pin reaches the slot end 3072. In some embodiments, with the pin at the slot end 3072, the rod is retained within the guide tube 3038 until the pin is caused to travel a reverse path through the L-shaped slot 3066 starting from the slot end 3072. By selectively engaging a pin of a rod in the L-Shaped slot 3066 in the manner described above, the rod may be conveniently carried within the guide tube 3038 when not in use and selectively removed and used to selectively operate the attachment system 3006. In some embodiments, the T-tool 3037 may comprise a radially extending pin for use in slot 3066.

Figure 10:
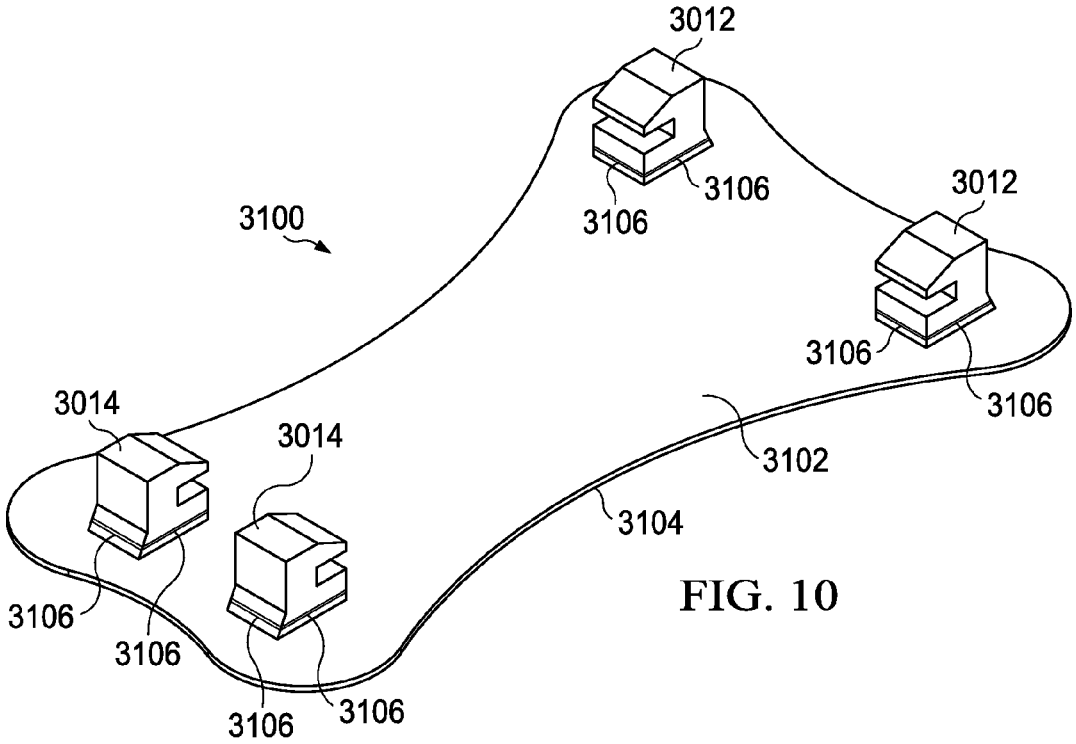
FIG. 10 is an oblique top view of a cover plate according to an embodiment of the disclosure.

Referring now to FIG. 10, an oblique top view of a cover plate 3100 is shown. The cover plate 3100, in some embodiments, may be attached to the shoe 3002 when the shoe 3002 is not attached to the frame 3004. In some embodiments, the cover plate 3100 may reduce and/or prevent introduction of contaminants such as, for example, but not limited to, dirt and water from entering into the attachment system 3006 via the block apertures 3036 and/or block entrances 3060. In some embodiments, the cover plate 3100 may comprise plastic, resin, metal, rubber, and/or any other suitable material. In this embodiment, the cover plate 3100 comprises a substantially flat shield 3102 having front lock blocks 3012 and rear lock blocks 3014 connected thereto in a physical arrangement substantially similar to the physical arrangement of the front lock blocks 3012 and rear lock blocks 3014 of frame 3004. Attachment and detachment of the cover plate 3100, in some embodiments, may be substantially similar to the above-described methods of attaching and detaching the frame 3004 relative to the shoe 3002. In some embodiments, an outer profile 3104 of the cover plate 3100 may at least partially share the same shape and/or dimensions of an outer profile of the frame 3004. In some embodiments, the cover plate 3100 may comprise sealing elements 3106 along a periphery of the outer profile 3104 and/or a long a periphery of one or more of the front lock blocks 3012 and rear lock blocks 3014. In some embodiments, the cover plate 3100 may comprise a material, pattern, and/or lower surface configured to complement the outsole 3064 of the shoe 3002. For example, a cover plate 3100 may be provided that, when installed on a shoe 3002, causes the shoe 3002 to appear to have a consistent outsole 3064 with little or no indication that the shoe 3002 may optionally be attached to the frame 3004.

Figure 11:
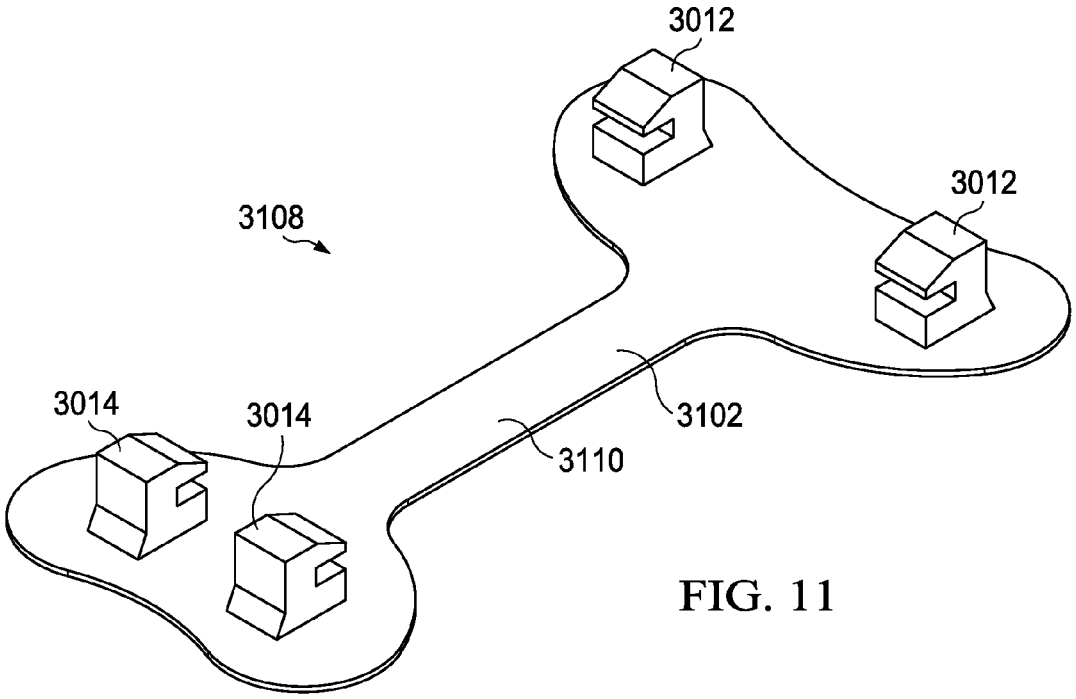
FIG. 11 is an oblique top view of an alternative cover plate according to an embodiment of the disclosure.

Referring now to FIG. 11, an oblique top view of a cover plate 3108 is shown. Cover plate 3108 is substantially similar to cover plate 3100, however, the outer profile 3104 of the shield 3102 is not substantially the same as the outer profile of the frame 3004. Instead, the shield 3102 comprises a narrow band 3110 of material joining the forward and rearward ends of the shield 3102. Providing such a narrow band 3110 may allow the cover plate 3108 to bend or otherwise require less space for storage when not in use. Further, in alternative embodiments, the narrow band 3110 may comprise a material different than the remainder of the shield 3102.

Figure 13:
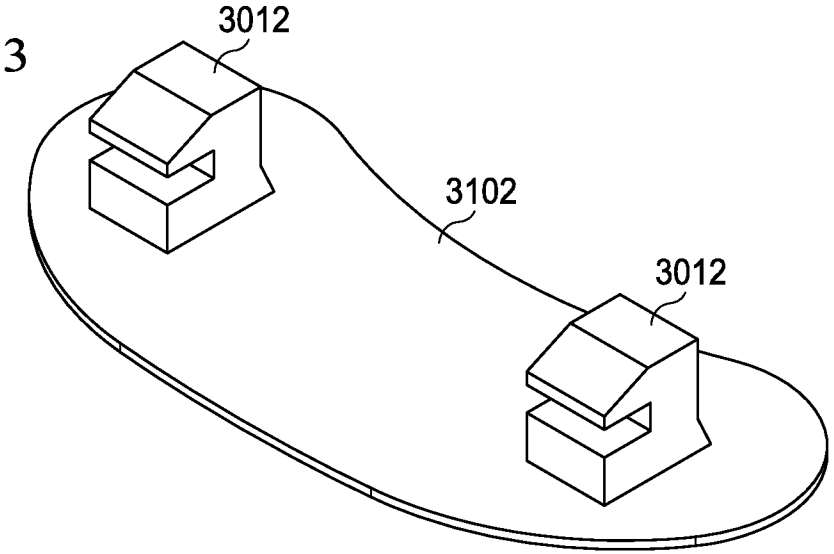
FIG. 13 is an oblique top view of another alternative cover plate according to an embodiment of the disclosure.
Figure 12:
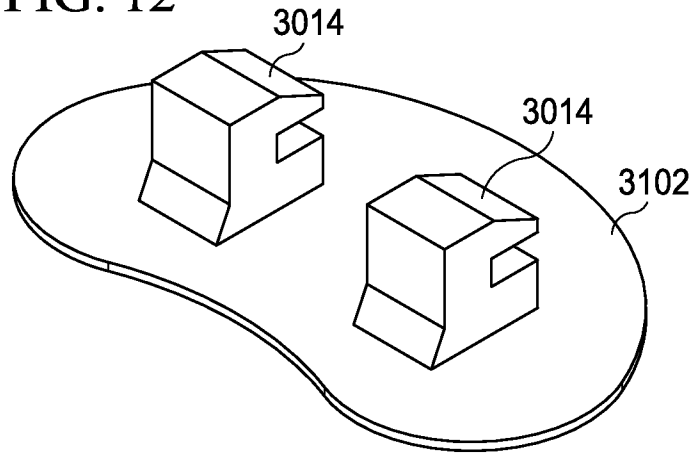
FIG. 12 is an oblique top view of another alternative cover plate according to an embodiment of the disclosure.
Figure 14:
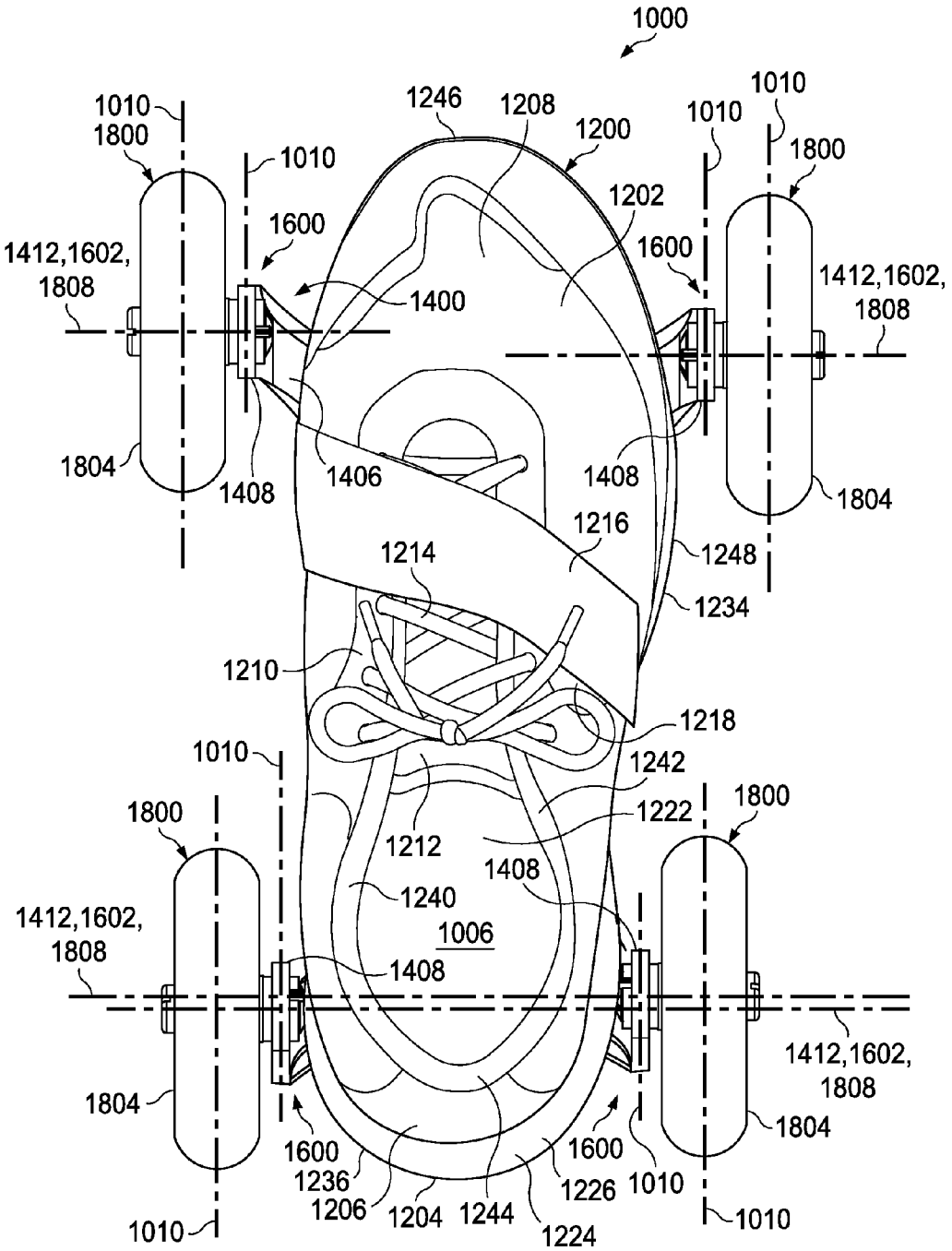
FIG. 14 is an orthogonal top view of the wearable device of FIG. 1.
Figure 15:
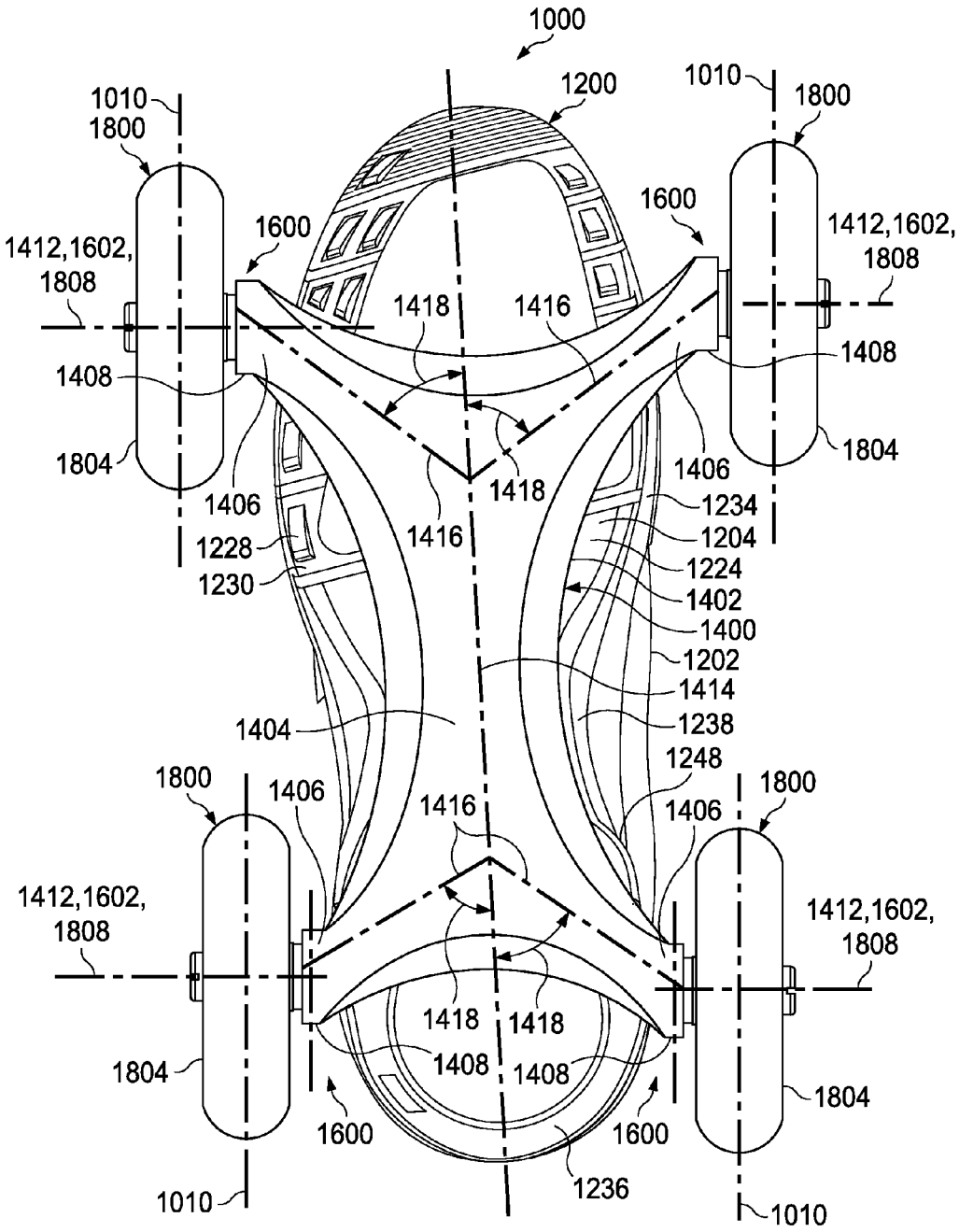
FIG. 15 is an orthogonal bottom view of the wearable device of FIG. 1.
Figure 16:
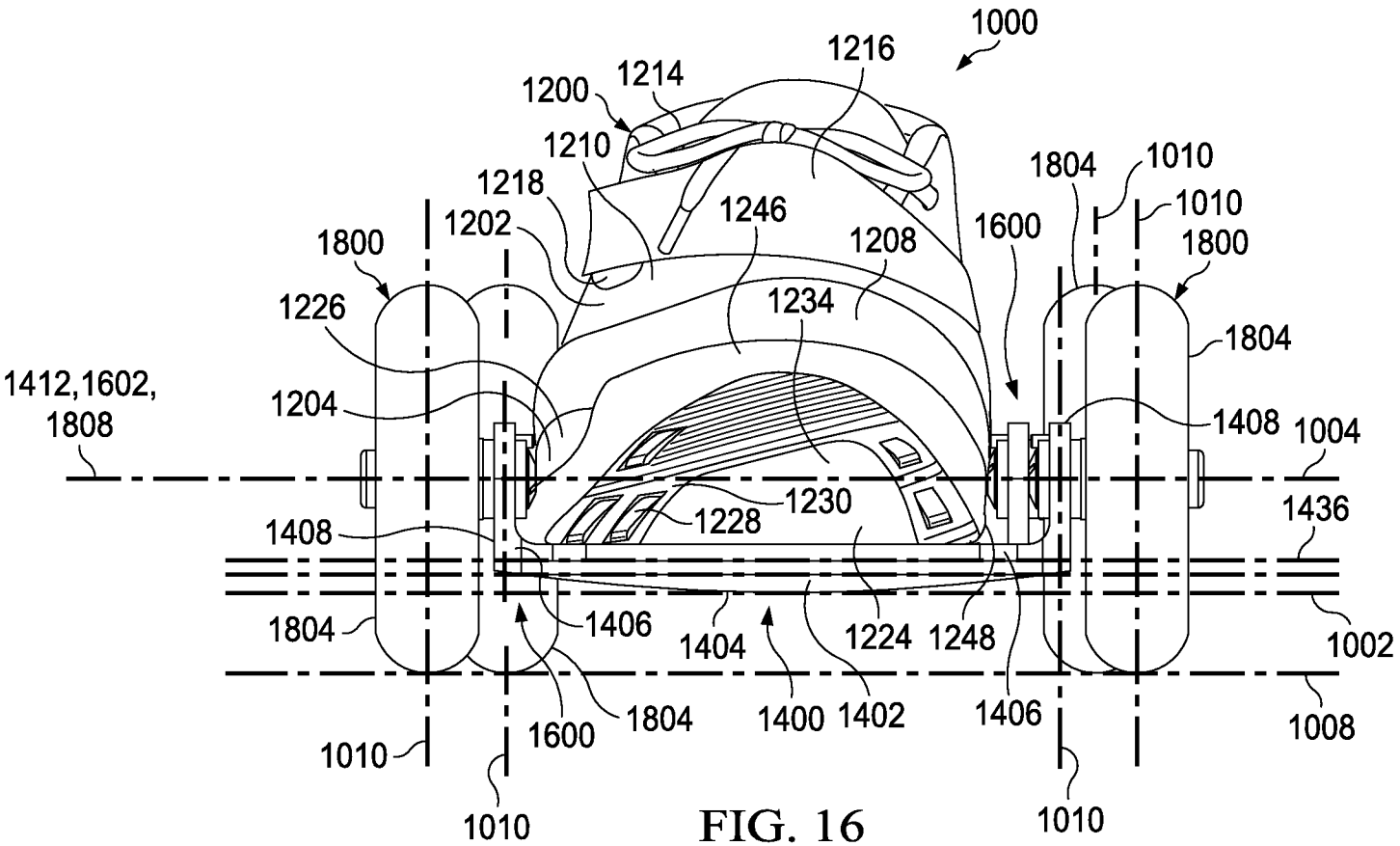
FIG. 16 is an orthogonal front view of the wearable device of FIG. 1.
Figure 17:
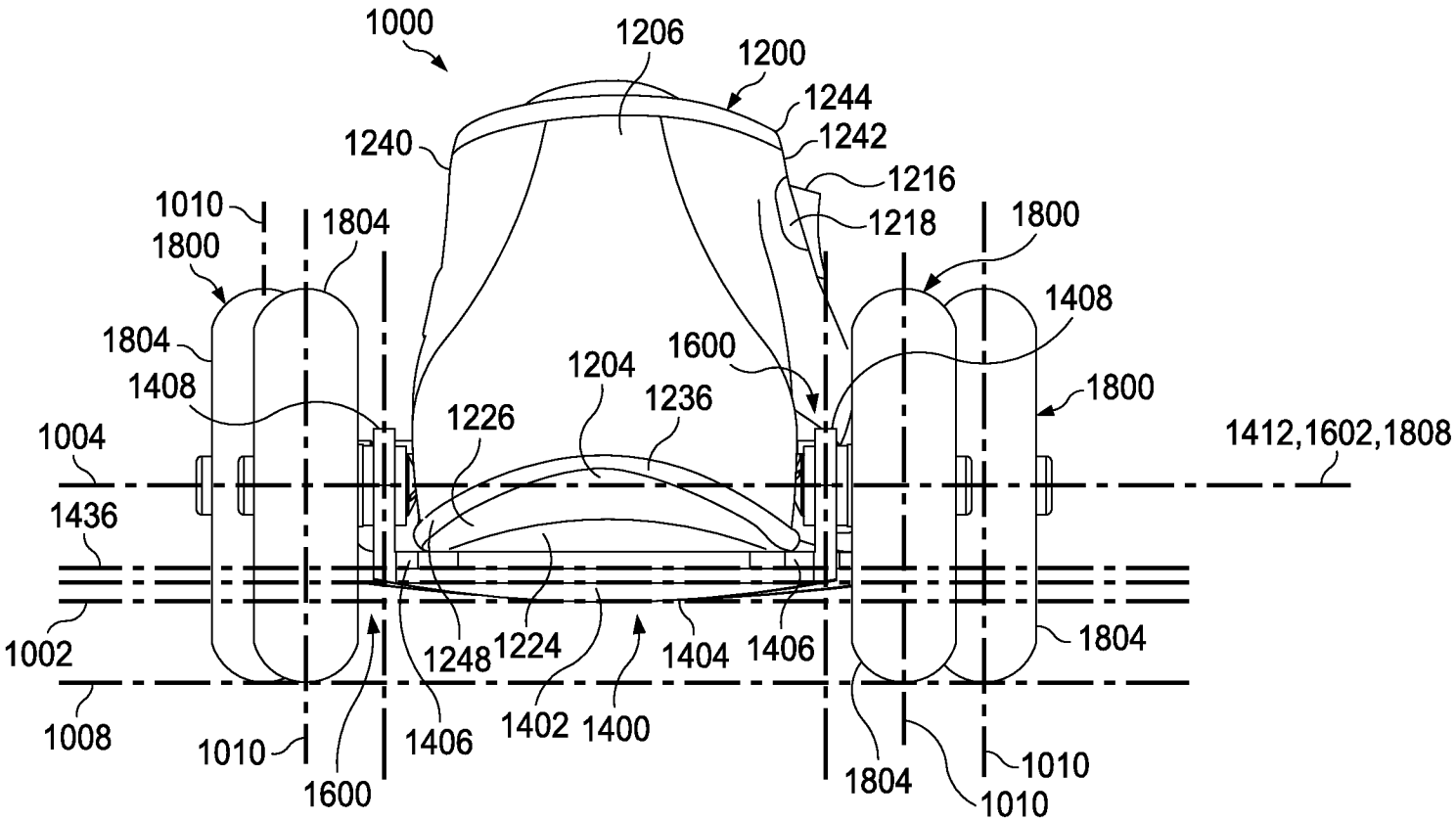
FIG. 17 is an orthogonal rear view of the wearable device of FIG. 1.
Figure 18:
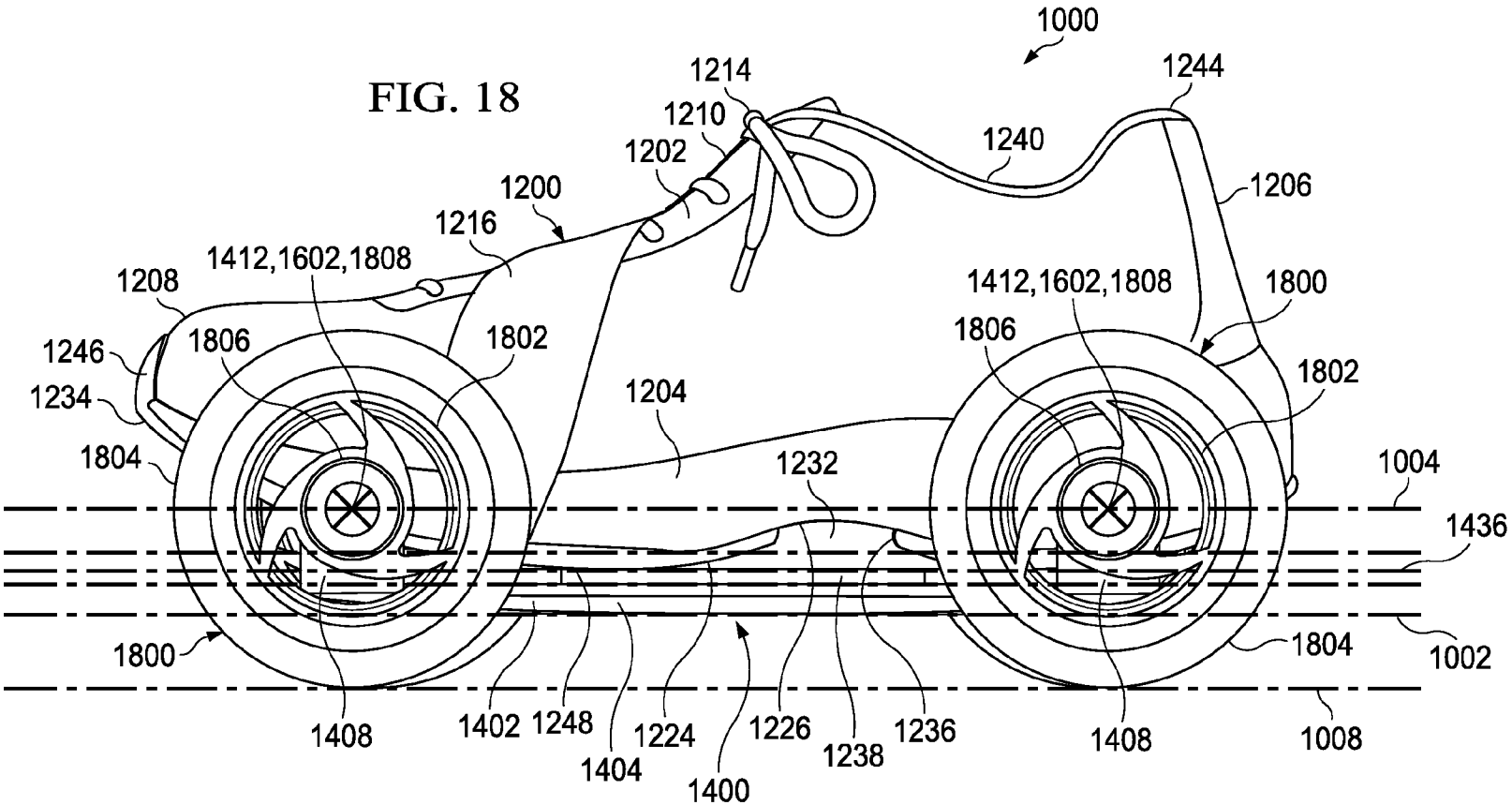
FIG. 18 is an orthogonal left view of the wearable device of FIG. 1.
Figure 19:
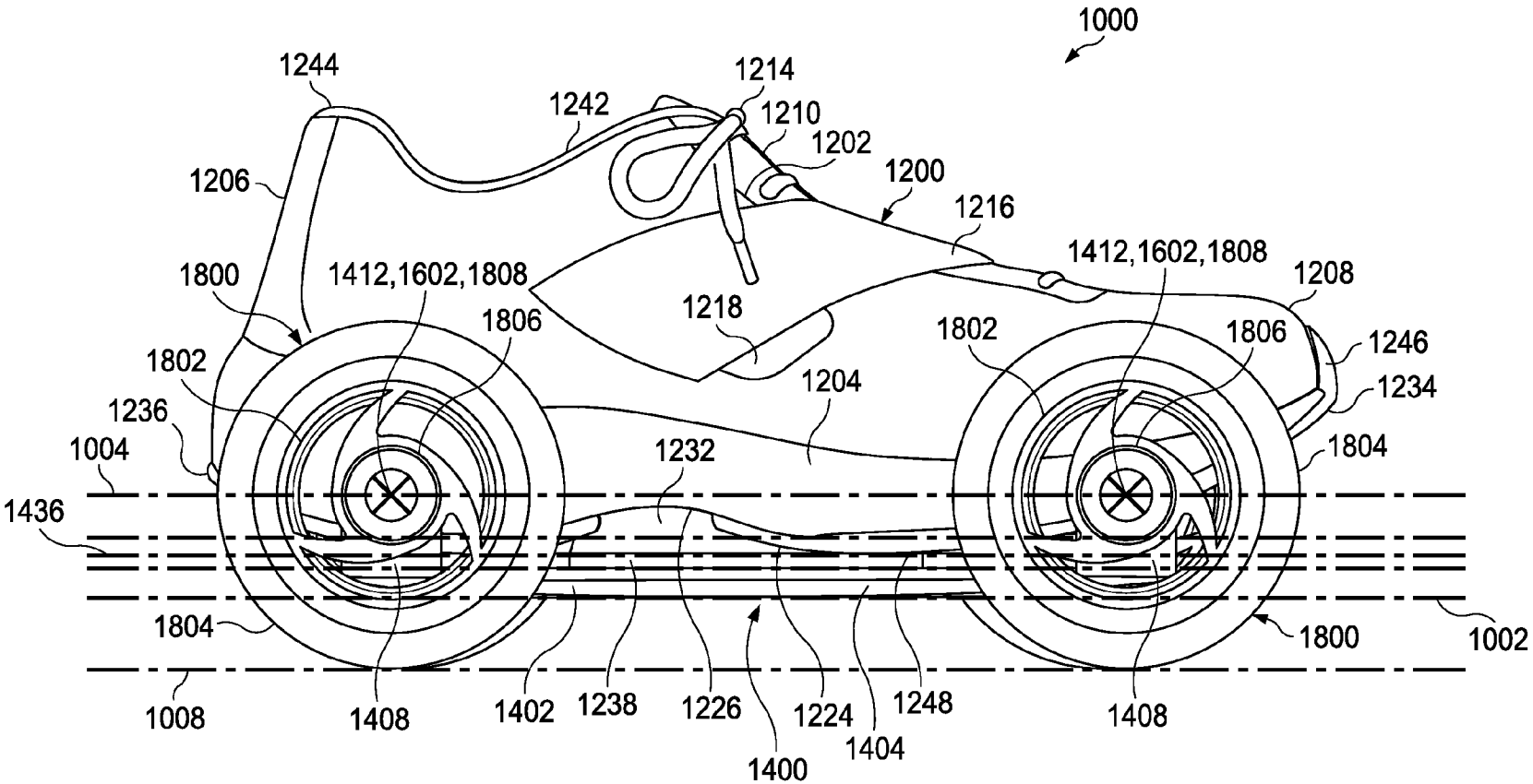
FIG. 19 is an orthogonal right view of the wearable device of FIG. 1.
Figure 20:
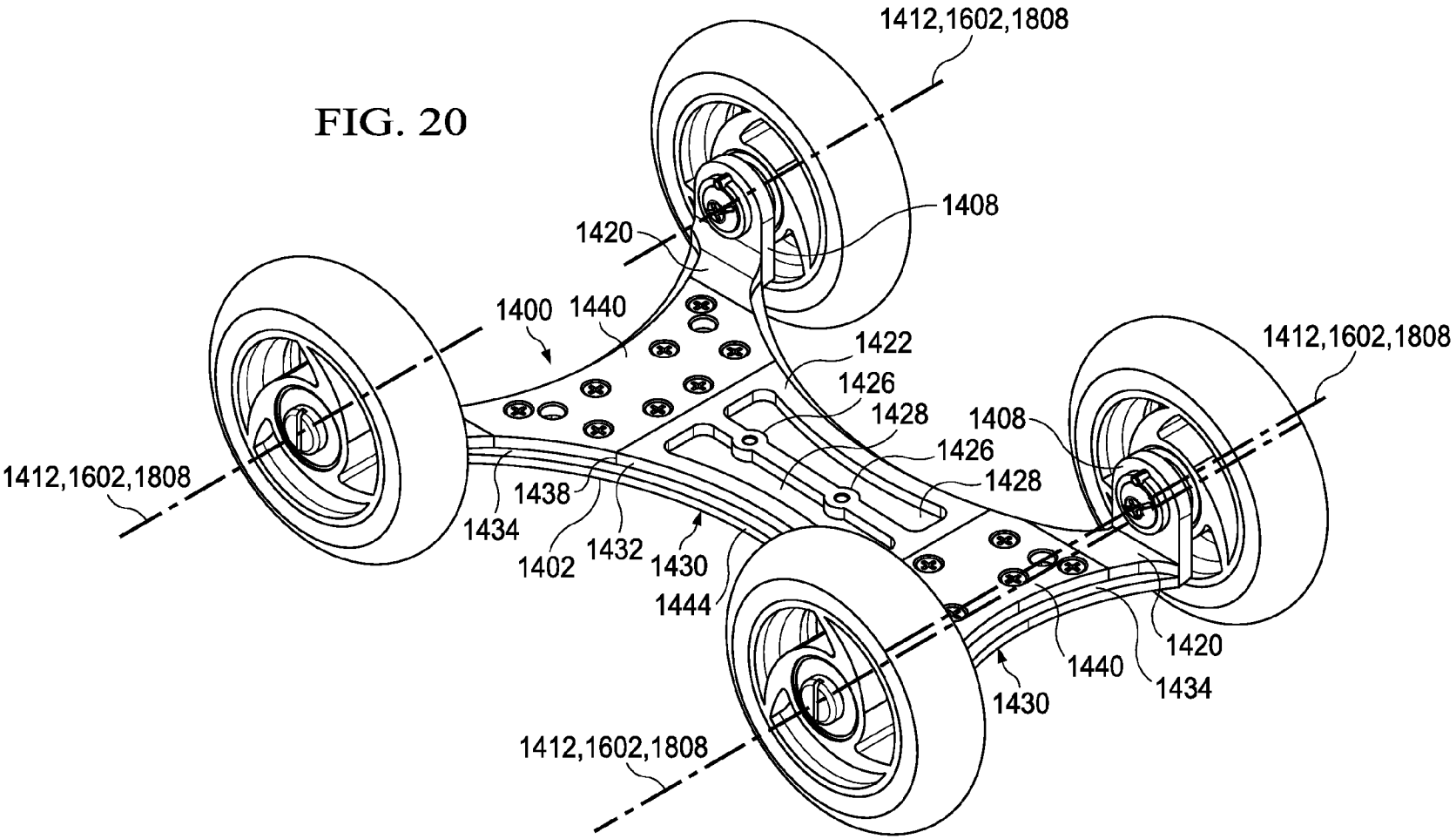
FIG. 20 is an oblique view of a frame of the wearable device of FIG. 1.

Referring now to FIGS. 12 and 13, oblique top views of rear and front cover plates 3112, 3114 are shown, respectively. Rear cover plate 3112 is substantially the same as the rear portion of cover plate 3100 while front cover plate 3114 is substantially the same as the front portion of cover plate 3100. In some embodiments, providing separate cover plates may be desirable, for example, in a case where a front or rear portion of a cover plate 3100 would otherwise wear out faster than the other. Further, storage of the two cover plates 3112, 3114 may require less space. In alternative embodiments, the cover plates may be reduced to mere plugs comprising front lock blocks 3012 and/or rear lock blocks 3014.

Figure 48:
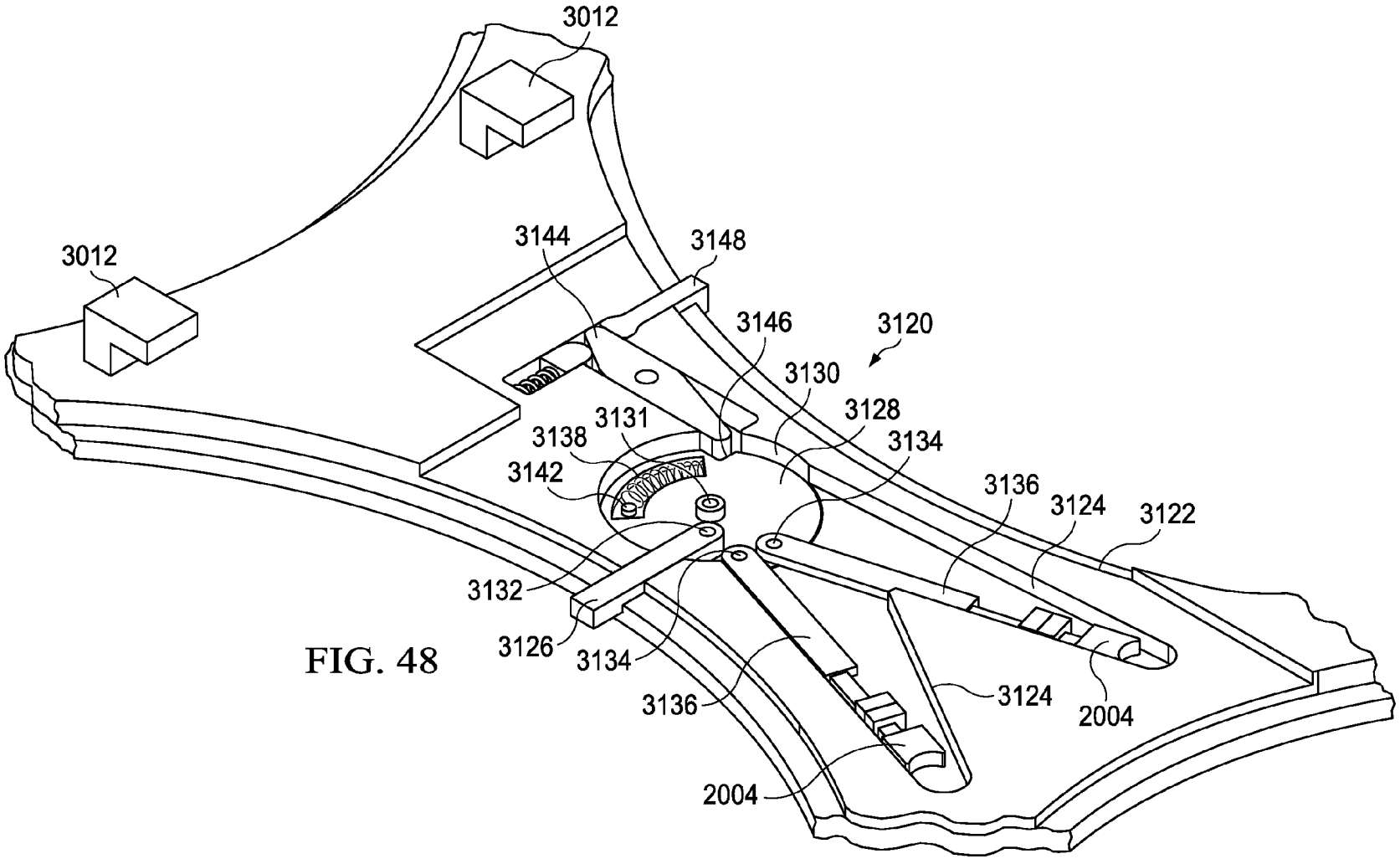
FIG. 48 is an oblique top view of another alternative attachment system according to an embodiment of the disclosure.

Referring now to FIG. 48, an oblique top view of another alternative embodiment of an attachment system 3120 is shown. Attachment system 3120 comprises features of both attachment system 2000 and attachment system 3006. Attachment system 3120 comprises front lock blocks 3012 for use in attaching a front portion of the frame 3122 to a shoe. Attachment system 3120 further comprises retainers 2004 for use in attaching a rear portion of the frame 3122 to a shoe. The actuating mechanism for the retainers 2004 is described here in detail. In this embodiment, the retainers 2004 are selectively actuated along recessed paths 3124 of the frame 3122 by the press of a button 3126 and via the movement of a rotary disc 3128. Most generally, the rotary disc 3128 is carried within a generally cylindrical recess 3130 of the frame 3122. Two recessed paths 3124 extend away from the cylindrical recess 3130. One recessed path 3124 extends generally toward the left rear branch of the frame 3122 while the other recessed path 3124 extends generally toward the right rear branch of the frame 3122. A rotary pin 3131 is located substantially centrally within the cylindrical recess 3130 and the rotary disc 3128 receives the rotary pin 3130 so that the rotary disc 3128 may be rotated about the rotary pin 3131. In this embodiment, the button 3126 is an elongate bar having an aperture for receiving button pin 3132 that extends vertically upward from the rotary disc 3128. The button pin 3132 is located a first radial distance away from the center of the rotary disc 3128. Two retainer arm pins 3134 extend vertically upward from the rotary disc 3128 and each of the retainer arm pins 3134 are located a second radial distance away from the center of the rotary disc 3128. In this embodiment, the second radial distance is greater than the first radial distance. In this embodiment, retainers 2004 are linked to the rotary disc 3128 by retainer arms 3136 which receive retainer arm pins 3134 into apertures of the retainer arms 3136.

Still further, the rotary disc 3128 is rotationally biased by rotation spring 3138 captured in a radially swept slot 3140 of the rotary disc 3128. One end of the compressed rotation spring 3138 biases the rotary disc 3128 to rotate clockwise as viewed from above while the other end of the spring 3138 acts against a rigid spring pin 3142 that extends upward from the frame 3122 and into the slot 3140. Additionally, the attachment system 3120 comprises a lock lever 3144 that is spring biased to engage a notch 3146 formed along the outer periphery of the rotary disc 3128. Such engagement between the lock lever 3144 and a notch 3146 prevents inadvertent counterclockwise rotation of the rotary disc 3128. To discontinue contact between the lock lever 3144 and the rotary disc 3128, a spring biased release button 3148 is pressed inward toward the frame 3122 to rotate the lock lever 3144 to a position that releases the rotary disc 3128.

In operation, a shoe may be joined to the frame 3122 by first attaching a front portion of the shoe to the frame 3122 using a catch block substantially similar to catch block 3056. Next, studs substantially similar to studs 2002 may be used to attach a rear portion of the shoe to the frame 3122. The attachment system 3120 is spring biased so that upon sufficient entry of the studs into the recessed paths 3124 relative to the retainers 2004, the shoe may be considered fully joined to the frame 3122. A shoe may be released from the frame 3122 by first passing and holding the release button 3148 to unlock movement of the rotary disc 3128. With the movement unlocked, the button 3126 may be pressed to rotate the rotary disc 3128 thereby pulling the retainers 2004 away from the studs 2002. With the retainers 2004 moved away from the studs 2002, the rear portion of the shoe may be lifted away from the frame 3122. Next, the shoe may be moved rearward relative to the frame to disconnect the front lock blocks 3012 from the catch block 3056. Finally, the front of the shoe may be moved vertically away from the frame 3122 until the front lock blocks 3012 are fully removed from the block entrances 3060.

Figure 49:
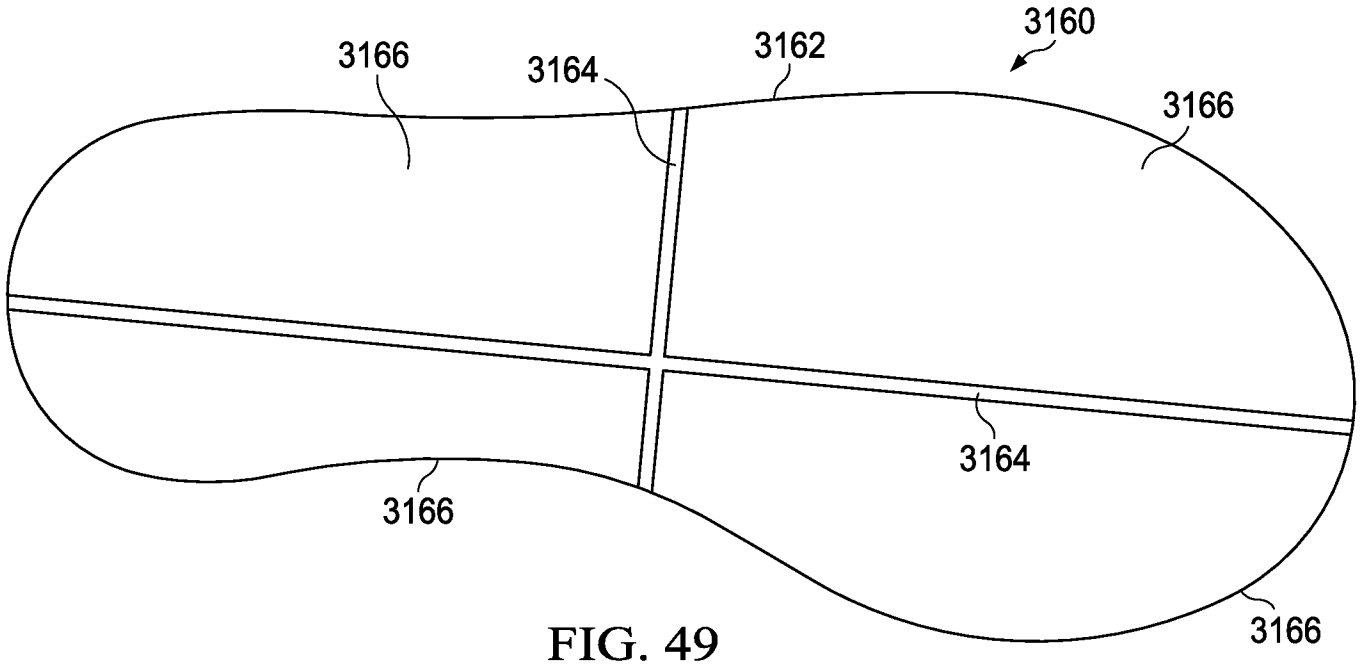
FIG. 49 is an orthogonal top view of a segmented foot bed according to an embodiment of the disclosure.

Referring now to FIG. 49, an orthogonal top view of a segmented foot bed 3160 is shown. In some embodiments, segmented foot bed 3160 may form a portion of one or more of the sole 1204, insole 1222, and midsole 1226. Segmented foot bed 3160 generally comprises substantially the same outer profile 3162 as one or more of the sole 1204, insole 1222, and midsole 1226. However, segmented foot bed 3160 is divided into a plurality of disparate pieces separated by polytetrafluoroethylene (PTFE) barriers 3164. The segmented foot bed 3160, in some embodiments, allows vertical movement of the various foot bed constituents 3166 in a less restrictive manner so that any one of the foot bed constituents 3166 is free for vertical movement relative to adjacent foot bed constituents 3166. In some embodiments, one or more of the foot bed constituents 3166 may be formed integrally, but with features configured to allow relative vertical displacement between the foot bed constituents 3166. Segmented foot bed 3160 decouples vertical movement between adjacent foot bed constituents 3166, thereby allowing each foot bed constituent 3166 to move vertically up or down without respect to vertical locations of other foot bed constituents 3166. In alternative embodiments, a segmented foot bed may comprise more or fewer than four foot bed constituent parts and the foot bed constituents 3166 and associated barriers 3164 may be shaped differently and/or may comprise barriers 3164 that comprise walls that are other than substantially vertical walls. For example, in an alternative embodiment, the two rear foot bed constituents 3166 shown in FIG. 49 may be combined as a single foot bed constituent, thereby providing three foot bed constituents. Alternatively, one or more of the foot bed constituents of FIG. 49 may be differently shaped and/or divided into multiple foot bed constituents that are similarly separated by barriers such as barriers 3164. Further, while relative vertical displacement of foot bed constituents 3166 is described above, in some embodiments, the foot bed In this embodiment, the foot bed constituents 3166 may also move relative to each other and/or relative to one or more barriers in forward, rearward, left, and/or right directions. The foot bed constituents 3166 may comprise Acrylonitrile Butadiene Styrene (ABS) plastic, however, in other embodiments, the foot bed constituents 3166 may comprise any other suitable material. In operation, a user of the segmented foot bed 3160 may more efficiently transfer forces to the various wheel assemblies by altering weight distribution amongst the various foot bed constituents 3166. As such, a user may increase weight placed on left side constituents 3166 to increase force applied to the left side wheel assemblies as compared to the right side wheel assemblies. Accordingly, the segmented foot bed 3160 provides for a mechanism that is less restrictive with regard to selectively transferring forces to selected wheel assemblies as compared to transferring forces through a conventional foot bed.

Figure 50:
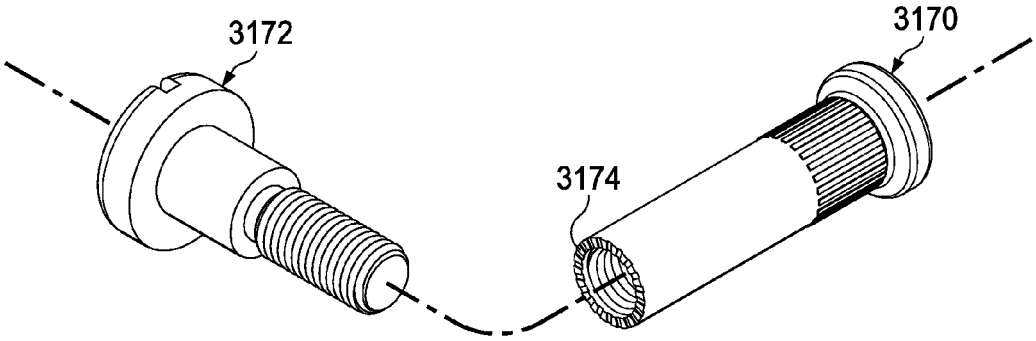
FIG. 50 is an exploded orthogonal side view of an axle assembly according to an embodiment of the disclosure.

Referring now to FIG. 50, oblique side views of a female axle bolt 3170 and a male axle bolt 3172 are shown. Female axle bolt 3170 differs from female axle bolt 1604 in several ways, including, but not limited to, comprising a hex head receptacle rather than a slot receptacle, comprising a shorter length, comprising a knurled end face 3174, and comprising internal threads extending substantially completely to the knurled end face 3174. Male axle bolt 3172 efforts from male axle bolt 1606 at least by comprising a hex head receptacle rather than a slot receptacle and by comprising no shoulder between the bolt head and the threads. In some cases, one or more of the above-described features of bolts 3170, 3172 may, upon mating of the bolts 3170, 3172, increase the force required to decouple the bolts 3170, 3172. In some embodiments, a length of one or both of female axle bolt 3170 and male axle bolt 3172 may be adjusted to soften the action or play in a suspension 1600.

Figure 51:
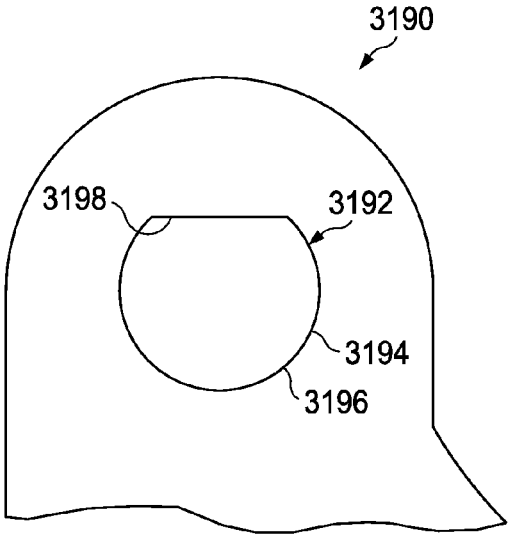
FIG. 51 is a partial orthogonal side view of an alternative suspension block according to an embodiment of the disclosure.

Referring now to FIG. 51, an orthogonal side view an alternative embodiment of a suspension block 3190 is shown. In this embodiment, the suspension cavity 3192 comprises a profile 3194 comprising a circular portion 3196 having free ends joined by a chord 3198 to form a so-called "D hole." In some embodiments, the use of the profile 3194 may reduce instances of tophat 1608, 1610 rotation within the suspension cavity 3192. In some embodiments, tophats 1608, 1610 may be configured to complement the D hole suspension block 3190. For example, in some embodiments, tophats 1608, 1610 may comprise outer profiles that are shaped substantially similar to the D hole of suspension block 3190.

In some embodiments, metal components may comprise one or more of 303 stainless steel, 1018 CR steel, 6061 aluminum, spring steel, 7075 aluminum, and/or nickel plated steel. In some embodiments, components may comprise about 20 A to about 120 A durometer polyurethane, about 75 D polyurethane, acrylonitrile butadiene styrene (ABS) plastic, resin, polytetrafluoroethylene (PTFE), one or more types of rubber, polyamides such as Nylon, a polyoxymethylene (POM), acetal, polyacetal, or polyformaldehydedelrin such as Delrin, polypropylene HD, and/or molded plastic.

In some embodiments, a wearable device configured to selectively provide roller transportation may comprise: a shoe configured to at least partially accept a foot of a user of the wearable device, the shoe comprising a foot interface surface configured for selective contact with a bottom of the foot; a wheel assembly configured to selectively roll relative to a ground surface in response to rotation of at least a portion of the wheel assembly about an axle that is substantially coincident with an axis of rotation; and a frame connected between the shoe and the wheel assembly, the frame being configured to selectively transfer forces between the shoe and the wheel assembly and the frame comprising a clearance plane vertically offset from the ground surface. In some embodiments, at least one of a distance between the ground surface and the foot interface surface and a space between the ground surface and the foot interface surface is selected to provide a low center of gravity for at least one of the wearable device and the user when the wheel assembly is in contact with the ground surface and positioned to selectively roll relative to the ground surface. In some embodiments, the wearable device is configured so that at least one of a portion of the wheel assembly is located vertically higher than the foot interface surface, the clearance plane is at least partially coincident with the foot interface surface, the clearance plane is located vertically lower than the foot interface surface, at least a portion of the axle is located vertically higher than the clearance plane, at least a portion of the axle is located vertically higher than the foot interface surface, and the distance by which the clearance plane is vertically offset from the ground surface is less than an overall diameter of the wheel assembly. The wearable device may further comprise a plurality of wheel assemblies and a plurality of axles, the plurality of axles being substantially coincident with different axes of rotation so that none of the axles share an axis of rotation. The wearable device may further comprise four wheel assemblies. In some embodiments, the axis of rotation is substantially parallel to the ground surface when the ground surface is substantially planar and when the wearable device is substantially in an unloaded state. In some embodiments, the axis of rotation is movable with respect to the frame. In some embodiments, the axis of rotation is movable relative to the shoe. In some embodiments, the axis of rotation is movable with respect to the frame. In some embodiments, the wheel assembly is configured to selectively orbit about a center of rotation. In some embodiments, the center of rotation is coincident with the axis of rotation. In some embodiments, the center of rotation is vertically higher than the clearance plane. In some embodiments, the center of rotation is located along an inner one-half length of the axle. In some embodiments, the center of rotation is located along an outer one-half length of the axle. In some embodiments, the center of rotation is located along the axle at substantially a midpoint of a length of the axle. In some embodiments, the center of rotation is substantially fixed relative to the frame. In some embodiments, the frame may comprise a suspension cavity configured to receive a portion of a suspension wherein the center of rotation is located within the suspension cavity. In some embodiments, the suspension cavity comprises a through hole having a cavity axis. In some embodiments, the cavity axis located vertically higher relative to the clearance plane. In some embodiments, the cavity axis is substantially fixed relative to the clearance plane. In some embodiments, at least a portion of the foot interface surface is vertically movable relative to the cavity axis in response to a force being at least partially vertically applied to wearable device. In some embodiments, the cavity axis is substantially parallel to the clearance plane. In some embodiments, the cavity axis is substantially orthogonal relative to a forward-rearward direction of the wearable device. In some embodiments, the forward-rearward direction of the wearable device is substantially parallel to a translation plane of the wearable device. In some embodiments, the translation plane is substantially orthogonal to the clearance plane and wherein the translation plane generally extends in the forward-rearward direction of the wearable device. In some embodiments, the wheel assembly is configured to selectively rotate substantially in a partial spherical sweep relative to the center of rotation. In some embodiments, the partial spherical sweep comprises a sweep radius that extends from the center of rotation. In some embodiments, the partial spherical sweep does not envelope the center of rotation. In some embodiments, the partial spherical sweep at least partially defines a range of motion of the wheel assembly relative to the frame. In some embodiments, the partial spherical sweep is sized to prevent the wheel assembly from directly contacting the shoe. In some embodiments, a resistance to moving the wheel assembly along the partial spherical sweep is substantially linear. In some embodiments a resistance to moving the wheel assembly along the partial spherical sweep is non-linear. In some embodiments, the frame may comprise a suspension cavity configured to receive a portion of a suspension wherein at least a portion of the axle is received within the suspension cavity. In some embodiments, the axle is a component of the suspension. In some embodiments, an elastically deformable material of the suspension is disposed between the portion of the axle received within the suspension cavity and a wall that at least partially defines the suspension cavity. In some embodiments, a portion of an elastically deformable tophat of the suspension is at least partially disposed between the axle and a wall that at least partially defines the suspension cavity. In some embodiments, at least a portion of each of at least two elastically deformable tophats of the suspension are received within the suspension cavity. In some embodiments the wearable device may comprise a plurality of wheel assemblies and a plurality of suspensions, each suspension being associated with only one wheel assembly and only one suspension. In some embodiments, each suspension comprises at least one elastically deformable tophat. In some embodiments, at least one of the elastically deformable tophats comprises urethane. In some embodiments, each suspension is at least partially circumferentially constrained by different ones of a plurality of suspension cavities. In some embodiments, the suspension is located substantially above the clearance plane. In some embodiments, the clearance plane is selectively movable with respect to the ground in response to a deformation of the suspension. In some embodiments the frame may comprise a trunk extending generally in a forward-rearward direction of the wearable device. In some embodiments, the trunk generally comprises a trunk midline plane substantially orthogonal to the clearance plane and askew relative to the forward-rearward direction of the wearable device. In some embodiments, the frame comprises a substantially central trunk and a plurality of branches extending from the trunk. In some embodiments, the frame is substantially X-shaped. In some embodiments, the trunk generally comprises a trunk midline plane substantially orthogonal to the clearance plane and askew relative to the forward-rearward direction of the wearable device and at least one of the branches comprises a branch midline plane substantially orthogonal to the clearance plane and which generally intersects the trunk midline plane at an outer angle. In some embodiments, at least two branches each comprise branch midline planes and wherein the branch midline planes intersect the trunk at unequal outer angles. In some embodiments, the at least two branches are unequal in overall length. In some embodiments, at least one of the trunk and the branches are adjustable in length. In some embodiments, at least a portion of the frame is embedded within the shoe. In some embodiments, at least a portion of the frame is formed integral with the shoe.

In some embodiments, a wearable device configured to selectively provide roller transportation may comprise: a shoe; a plurality of wheel assemblies, each wheel assembly being configured to selectively roll relative to a ground surface about an associated axis of rotation; and a frame connected between the wheel assemblies and the frame, the frame comprising a trunk and a plurality of branches extending from the trunk, each of the branches being configured for connection to at least one of the plurality of wheel assemblies. In some embodiments, at least a portion of the shoe is located vertically higher than at least a portion of the frame when at least one of the wheel assemblies is in contact with the ground surface and the at least one of the wheel assemblies is positioned to selectively roll relative to the ground surface. In some embodiments, at least a portion of the shoe is located vertically lower than a clearance plane of the frame. In some embodiments, at least a portion of the frame is embedded within the shoe. In some embodiments, the trunk comprises a trunk midline plane that is substantially orthogonal to the ground surface and that extends generally along a forward-rearward direction of the wearable device. In some embodiments, at least one of the plurality of wheel assemblies is generally leftward of the trunk midline plane and at least one of the plurality of wheel assemblies is generally located rightward of the trunk midline plane. In some embodiments, at least one of the plurality of branches is generally leftward of the trunk midline plane and at least one of the plurality of branches is generally located rightward of the trunk midline plane. In some embodiments, the location of each of the branches at least partially defines a location of an axis of rotation. In some embodiments, each branch comprises a branch midline plane that intersects the trunk midline plane at an outer angle. In some embodiments, the outer angles associated with at least two of the branches are unequal in value. In some embodiments, the wearable device may further comprise four branches and four associated wheel assemblies. In some embodiments, the wearable device may further comprise four branches and four associated outer angles, each of the outer angles comprising different values. In some embodiments, the wearable device may further comprise four branches, each of the four branches comprising a different overall length. In some embodiments, the wearable device may further comprise four branches, each of the four branches comprising a different overall length and each of the branches comprising a branch midline plane intersecting the trunk midline plane with different outer angle values. In some embodiments, the trunk vertically extends between a clearance plane coincident with a lowest portion of the frame and an upper interface surface of the frame that contacts the shoe in a vertically highest location. In some embodiments, the trunk comprises the lowest portion of the frame. In some embodiments, a branch comprises the lowest portion of the frame. In some embodiments, the trunk comprises the upper interface surface. In some embodiments, a branch comprises the upper interface surface. In some embodiments, the upper interface surface is at least partially received within the shoe. In some embodiments, the upper interface surface is at least partially received within a sole cutout profile of the shoe. In some embodiments, the upper interface surface is substantially abutted against an outsole of the shoe. In some embodiments, each of the wheel assemblies is substantially offset from a sole outer profile of the shoe by an equal offset distance. In some embodiments, each of the branches comprises a suspension block extending in a substantially vertical direction from the associated branch. In some embodiments, each of the suspension blocks comprises a suspension cavity for receiving at least a portion of a suspension. In some embodiments, each of the suspension cavities comprises a cavity axis that extends in a generally leftward-rightward direction of the wearable device. In some embodiments, each of the cavity axes is substantially coplanar when the wearable device is in an unloaded state. In some embodiments, each of the cavity axes is substantially fixed relative to the frame. In some embodiments, at least two branches and at least two associated cavity axes are associated with a front sole of the shoe. In some embodiments, at least two branches and at least two associated cavity axes are associated with a rear sole of the shoe. In some embodiments, at least two branches and at least two associated cavity axes are associated with a front sole of the shoe and wherein at least two branches and at least two associated cavity axes are associated with a rear sole of the shoe. In some embodiments, the two branches associated with the rear sole of the shoe are each shorter in length than the two branches associated with the front sole of the shoe. In some embodiments, the wheel assemblies associated with the two branches associated with the rear sole of the shoe are separated in a leftward-rightward direction of the wearable device by a distance less than a distance that that the wheel assemblies associated with the two branches associated with the front sole of the shoe are separated in the leftward-rightward direction of the wearable device. In some embodiments, the wheel assembly associated with a front-left branch is offset in a frontward-rearward direction of the wearable device relative to the wheel assembly associated with a front-right branch. In some embodiments, the wheel assembly associated with a rear-left branch is offset in a frontward-rearward direction of the wearable device relative to the wheel assembly associated with a rear-right branch. In some embodiments, the wheel assembly associated with a front-left branch is offset in a leftward-rightward direction of the wearable device relative to the wheel assembly associated with a rear-left branch. In some embodiments, the wheel assembly associated with a front-right branch is offset in a leftward-rightward direction of the wearable device relative to the wheel assembly associated with a rear-right branch. In some embodiments, the wheel assembly associated with a front-left branch is offset in a frontward-rearward direction of the wearable device relative to the wheel assembly associated with a front-right branch; the wheel assembly associated with a rear-left branch is offset in the frontward-rearward direction of the wearable device relative to the wheel assembly associated with a rear-right branch; the wheel assembly associated with the front-left branch is offset in a leftward-rightward direction of the wearable device relative to the wheel assembly associated with the rear-left branch; and the wheel assembly associated with a front-right branch is offset in the leftward-rightward direction of the wearable device relative to the wheel assembly associated with the rear-right branch. In some embodiments, the wearable device is configured for use with a right foot of a human user. In some embodiments, the front-left wheel assembly is located leftward of the rear-left wheel assembly and is located forward of the front-right wheel assembly. In some embodiments, the front-right wheel assembly is located rightward of the rear-right wheel assembly and is located rearward of the front-left wheel assembly. In some embodiments, the rear-left wheel assembly is located rightward of the front-right wheel assembly and is located rearward of the rear-right wheel assembly. In some embodiments, the rear-right wheel assembly is located leftward of the front-right wheel assembly and is located frontward of the rear-left wheel assembly. In some embodiments, the wearable device is configured for use with a left foot of a human user. In some embodiments, the front-left wheel assembly is located leftward of the rear-left wheel assembly and is located rearward of the front-right wheel assembly. In some embodiments, the front-right wheel assembly is located rightward of the rear-right wheel assembly and is located forward of the front-left wheel assembly. In some embodiments, the rear-left wheel assembly is located rightward of the front-left wheel assembly and is located forward of the rear-right wheel assembly. In some embodiments, the rear-right wheel assembly is located leftward of the front-right wheel assembly and is located rearward of the rear-left wheel assembly. In some embodiments, the rear-left wheel assembly and the rear-right wheel assembly are associated with a heel of a user. In some embodiments, the front-left wheel assembly and the front-right wheel assembly are associated with a ball of a foot of a user. In some embodiments, the frame may comprise an outer profile step. In some embodiments, the frame may comprise a piece mount. In some embodiments, the frame may comprise a transition surface. In some embodiments, the frame may comprise a mass reduction cavity. In some embodiments, the frame may comprise a retainer channel. In some embodiments the frame may comprise, a plate indention configured to receive a cover plate. In some embodiments, the cover plate may comprise a stud aperture. In some embodiments, the wearable device may comprise four wheel assemblies, each wheel assembly comprising a separate and distinct axis of rotation. In some embodiments, each branch connects only one wheel assembly to the frame.

In some embodiments, a suspension for a wearable device configured to selectively provide roller transportation may comprise: an axle configured to be at least partially circumferentially restrained along a length of the axle wherein the axle is movable about a center of rotation located along a suspension axis of the suspension that is substantially coincident with an axis of rotation of a wheel assembly carried by the axle. In some embodiments, at least a portion of the axle is received within a through hole. In some embodiments, the suspension may further comprise at least one elastically deformable tophat. In some embodiments, the at least one tophat is at least partially received within the through hole. In some embodiments, the at least one tophat comprises urethane. In some embodiments, at least a portion of the tophat is located circumferentially around the axle and within the through hole. In some embodiments, the axle comprises a bolt head. In some embodiments, the bolt head is offset from the through hole and at least a portion of the tophat is located between the bolt head and the through hole. In some embodiments, the axle comprises ridges at least partially located within the through hole. In some embodiments, the bolt head comprises a diameter greater than a diameter of the through hole. In some embodiments, at least a portion of the tophat is located between the through hole and the wheel assembly. In some embodiments, a suspension spacer is located between the tophat and the wheel assembly. In some embodiments, the wheel assembly comprises a friction reducing coating adjacent the suspension spacer. In some embodiments, the axle comprises a female axle bolt and a complementary male axle bolt. In some embodiments, at least one of the female axle bolt and the male axle bolt comprise an integral relative position retainer feature. In some embodiments, the integral relative position retainer feature comprises a knurled face of at least one of the female axle bolt and the complementary male axle bolt. In some embodiments, the suspension may further comprise an inner tophat at least partially received within the through hole and at least partially extending from an inner end of the through hole and an outer tophat at least partially received within the through hole and at least partially extending from an outer end of the through hole. In some embodiments, the portion of the inner tophat extending from the inner end of the through hole is restrained by a bolt head of the axle. In some embodiments, the portion of the outer tophat extending from the outer end of the through hole is restrained by a suspension spacer. In some embodiments, the axle comprises two complementary components. In some embodiments, at least a portion of each of the two complementary components is received within the wheel assembly. In some embodiments, the center of rotation is substantially coincident with the axis of rotation and wherein each of the suspension axis, the axis of rotation, and the center of rotation remain coincident during rotation of the wheel assembly about the axis of rotation and during perturbations of the suspension.

In some embodiments, a wearable device configured to selectively provide roller transportation may comprise: a shoe configured to at least partially accept a foot of a user of the wearable device, the shoe comprising a foot interface surface configured for selective contact with a bottom of the foot; a wheel assembly configured to selectively roll relative to a ground surface in response to rotation of at least a portion of the wheel assembly about an axle that is substantially coincident with an axis of rotation; a frame connected between the shoe and the wheel assembly, the frame being configured to selectively transfer forces between the shoe and the wheel assembly and the frame comprising a clearance plane vertically offset from the ground surface; and an attachment system for selectively attachment of the shoe to the frame. In some embodiments, the attachment system comprises a biased retainer. In some embodiments, at least a portion of the biased retainer is carried within the frame. In some embodiments, the attachment system comprises at least one stud aperture formed through a sole of the shoe. In some embodiments, the attachment system comprises at least one stud configured for selective insertion into the at least one stud aperture. In some embodiments, the attachment system further comprises a spring configured to bias the biased retainer. In some embodiments, at least a portion of the spring is carried within the frame. In some embodiments, the stud comprises a cam indention for rotation relative to the biased aperture. In some embodiments, the stud comprises a hook for selective interaction with the biased retainer. In some embodiments, the hook is configured for selective interaction with a crenellated projection of the biased retainer. In some embodiments, the stud is movable between an attached position relative to the biased retainer and a detached position relative to the retainer in response to a rotation of the stud by less than 360 degrees. In some embodiments, at least one attachment system is associated with each of a plurality of branches of the frame. In some embodiments, at least one attachment system is associated with each of a plurality of wheel assemblies.

In some embodiments, a method of roller transportation may comprise: attaching a wearable device configured to selectively provide roller transportation to a user; increasing a velocity of the user in response to ambulatory movement generated substantially to the exclusion of roller elements of the wearable device; and engaging a roller element with a ground surface after increasing the velocity of the user. In some embodiments, the ambulatory movement is generated at least partially by running using primarily a front sole of a shoe of the wearable device. In some embodiments, the ambulatory movement is generated at least partially by walking using primarily a front sole of a shoe of the wearable device. In some embodiments, the ambulatory movement is repeated after engaging the roller element with the ground surface. In some embodiments, the method may further comprise decreasing a velocity of the user by dragging a portion of the wearable device against the ground surface. In some embodiments, a wheel assembly of the wearable device is dragged against the ground surface. In some embodiments, a portion of a shoe of the wearable device is dragged against the ground surface.

In some embodiments, a wearable device configured to selectively provide roller transportation may comprise: a shoe configured to at least partially accept a foot of a user of the wearable device, the shoe comprising a foot interface surface configured for selective contact with a bottom of the foot; a wheel assembly configured to selectively roll relative to a ground surface in response to rotation of at least a portion of the wheel assembly about an axle that is substantially coincident with an axis of rotation; and a frame connected between the shoe and the wheel assembly, the frame being configured to selectively transfer forces between the shoe and the wheel assembly and the frame comprising a clearance plane vertically offset from the ground surface. In some embodiments, at least one of (1) a distance between the ground surface and the foot interface surface and (2) a space between the ground surface and the foot interface surface is selected to provide a low center of gravity for at least one of the wearable device and the user when the wheel assembly is in contact with the ground surface and positioned to selectively roll relative to the ground surface. In some embodiments the wearable device is configured so that at least one of (1) a portion of the wheel assembly is located vertically higher than the foot interface surface, (2) the clearance plane is at least partially coincident with the foot interface surface, (3) the clearance plane is located vertically lower than the foot interface surface, (4) at least a portion of the axle is located vertically higher than the clearance plane, (5) at least a portion of the axle is located vertically higher than the foot interface surface, and (6) the distance by which the clearance plane is vertically offset from the ground surface is less than an overall diameter of the wheel assembly. In some embodiments the wearable device may further comprise a plurality of wheel assemblies wherein at least a portion of the foot interface surface is lower than at least a portion of at least one of the wheel assemblies. In some embodiments, the wearable device may further comprise a plurality of axles, the plurality of axles being substantially coincident with different axes of rotation so that none of the axles share an axis of rotation wherein at least a portion of the foot interface surface is lower than at least a portion of at least one of the axles. In some embodiments, at least one of the axles comprises an end that selectively orbits about a center of rotation of the axle. In some embodiments, the end of the axle is rotatable between a first position higher than the foot interface surface and a second position lower than the foot interface surface. In some embodiments, the center of rotation is higher than at least a portion of the foot interface surface. In some embodiments, the frame may comprise a suspension cavity configured to receive a portion of a suspension. In some embodiments, the center of rotation is located within the suspension cavity. In some embodiments, the center of rotation is located lower than the foot interface surface. In some embodiments, the center of rotation is located higher than the foot interface surface. In some embodiments, at least a portion of the foot interface surface is vertically movable relative to the suspension cavity. In some embodiments, both ends of at least one of the axles are rotatable about the center of rotation in a partially spherical sweep relative to the center of rotation. In some embodiments, each wheel assembly is associated with at least one suspension. In some embodiments, each of the suspensions is independently operable to allow movement of the associated wheel assemblies relative to the foot interface surface. In some embodiments, the frame is substantially X-shaped as viewed from above. In some embodiments, at least a portion of the frame is embedded within the shoe. In some embodiments, at least one of the suspensions comprises a urethane tophat at least partially carried within the suspension cavity. In some embodiments, at least a portion of the frame is formed integral with the shoe. In some embodiments, the frame comprises a trunk and four branches extending from the trunk, each of the four branches being associated with one suspension and one wheel assembly. In some embodiments, at least one of (1) each of the four branches comprises a different length and (2) each of the four branches extends from the trunk at a different angle as viewed from above.

In some embodiments, a wearable device configured to selectively provide roller transportation may comprise: a shoe; a plurality of wheel assemblies, each wheel assembly being configured to selectively roll relative to a ground surface about an associated axis of rotation; and a frame connected between the wheel assemblies, the frame comprising a trunk and a plurality of branches extending from the trunk, each of the branches being configured for connection to at least one of the plurality of wheel assemblies. In some embodiments, at least a portion of the shoe is located vertically higher than at least a portion of the frame when at least one of the wheel assemblies is in contact with the ground surface and the at least one of the wheel assemblies is positioned to selectively roll relative to the ground surface. In some embodiments, at least a portion of the frame is embedded within the shoe. In some embodiments, the trunk comprises a trunk midline plane that is substantially orthogonal to the ground surface and that extends generally along a forward-rearward direction of the wearable device. In some embodiments, at least one of the plurality of branches is generally leftward of the trunk midline plane and at least one of the plurality of branches is generally located rightward of the trunk midline plane. In some embodiments, each branch comprises a branch midline plane that intersects the trunk midline plane at an outer angle. In some embodiments, the outer angles associated with at least two of the branches are unequal in value. In some embodiments, the wearable device may further comprise four branches, each of the four branches comprising a different overall length and each of the branches comprising a branch midline plane intersecting the trunk midline plane with different outer angle values. In some embodiments, the trunk vertically extends between a clearance plane coincident with a lowest portion of the frame and an upper interface surface of the frame that contacts the shoe in a vertically highest location. In some embodiments, the trunk comprises the lowest portion of the frame. In some embodiments, a branch comprises the lowest portion of the frame. In some embodiments, the trunk comprises the upper interface surface. In some embodiments, the upper interface surface is at least partially received within the shoe. In some embodiments, the upper interface surface is at least partially received within a sole cutout profile of the shoe. In some embodiments, each of the branches comprises a suspension block extending in a substantially vertical direction from the associated branch. In some embodiments, each of the suspension blocks comprises a suspension cavity for receiving at least a portion of a suspension. In some embodiments, each of the suspension cavities comprises a cavity axis that extends in a generally leftward-rightward direction of the wearable device. In some embodiments, at least two branches and at least two associated cavity axes are associated with a front sole of the shoe and wherein at least two branches and at least two associated cavity axes are associated with a rear sole of the shoe. In some embodiments, the wheel assemblies associated with the two branches associated with the rear sole of the shoe are separated in a leftward-rightward direction of the wearable device by a distance less than a distance that that the wheel assemblies associated with the two branches associated with the front sole of the shoe are separated in the leftward-rightward direction of the wearable device. In some embodiments, the wheel assembly associated with a front-left branch is offset in a frontward-rearward direction of the wearable device relative to the wheel assembly associated with a front-right branch, the wheel assembly associated with a rear-left branch is offset in the frontward-rearward direction of the wearable device relative to the wheel assembly associated with a rear-right branch, the wheel assembly associated with the front-left branch is offset in a leftward-rightward direction of the wearable device relative to the wheel assembly associated with the rear-left branch, and the wheel assembly associated with a front-right branch is offset in the leftward-rightward direction of the wearable device relative to the wheel assembly associated with the rear-right branch. In some embodiments, at least one of the trunk and the branches are adjustable in length.

In some embodiments, a suspension for a wearable device configured to selectively provide roller transportation may comprise: an axle configured to be at least partially circumferentially restrained along a length of the axle wherein the axle is movable about a center of rotation located along a suspension axis of the suspension that is substantially coincident with an axis of rotation of a wheel assembly carried by the axle. In some embodiments, at least a portion of the axle is received within a through hole. In some embodiments the suspension may further comprise at least one elastically deformable tophat. In some embodiments, the at least one tophat is at least partially received within the through hole. In some embodiments, the at least one tophat comprises urethane. In some embodiments, at least a portion of the tophat is located circumferentially around the axle and within the through hole. In some embodiments, the axle comprises a bolt head. In some embodiments, the bolt head is offset from the through hole and at least a portion of the tophat is located between the bolt head and the through hole. In some embodiments, the axle comprises ridges at least partially located within the through hole. In some embodiments, the bolt head comprises a diameter greater than a diameter of the through hole. In some embodiments, at least a portion of the tophat is located between the through hole and the wheel assembly. In some embodiments, a suspension spacer is located between the tophat and the wheel assembly. In some embodiments, the wheel assembly comprises a friction reducing coating adjacent the suspension spacer. In some embodiments, the axle comprises a female axle bolt and a complementary male axle bolt. In some embodiments, at least one of the female axle bolt and the male axle bolt comprise an integral relative position retainer feature. In some embodiments, the integral relative position retainer feature comprises a knurled face of at least one of the female axle bolt and the complementary male axle bolt. In some embodiments, the suspension may further comprise: an inner tophat at least partially received within the through hole and at least partially extending from an inner end of the through hole; and an outer tophat at least partially received within the through hole and at least partially extending from an outer end of the through hole. In some embodiments, the portion of the inner tophat extending from the inner end of the through hole is restrained by a bolt head of the axle. In some embodiments, the center of rotation is substantially coincident with the axis of rotation and wherein each of the suspension axis, the axis of rotation, and the center of rotation remain coincident during rotation of the wheel assembly about the axis of rotation and during perturbations of the suspension. In some embodiments, an end of the axle is configured to selectively rotate substantially in a partial spherical sweep relative to the center of rotation.

In some embodiments, a wearable device configured to selectively provide roller transportation may comprise: a shoe configured to at least partially accept a foot of a user of the wearable device, the shoe comprising a foot interface surface configured for selective contact with a bottom of the foot; a wheel assembly configured to selectively roll relative to a ground surface in response to rotation of at least a portion of the wheel assembly about an axle that is substantially coincident with an axis of rotation; a frame connected between the shoe and the wheel assembly, the frame being configured to selectively transfer forces between the shoe and the wheel assembly and the frame comprising a clearance plane vertically offset from the ground surface; and an attachment system for selective attachment of the shoe to the frame. In some embodiments, the attachment system comprises a biased retainer. In some embodiments, at least a portion of the biased retainer is carried within the frame. In some embodiments, the attachment system comprises at least one stud aperture formed through a sole of the shoe. In some embodiments, the attachment system comprises at least one stud configured for selective insertion into the at least one stud aperture. In some embodiments, the attachment system further comprises a spring configured to bias the biased retainer. In some embodiments, at least a portion of the spring is carried within the frame. In some embodiments, the stud comprises a cam indention for rotation relative to the biased aperture. In some embodiments, the stud comprises a hook for selective interaction with the biased retainer. In some embodiments, the hook is configured for selective interaction with a crenellated projection of the biased retainer. In some embodiments, the stud is movable between an attached position relative to the biased retainer and a detached position relative to the retainer in response to a rotation of the stud by less than 360 degrees. in some embodiments, the attachment system is associated with a central trunk of the frame. In some embodiments, a portion of the attachment system is carried within an interior cavity of the trunk. In some embodiments, an attachment system for a wearable device configured to selectively provide roller transportation may comprise: a first feature carried by a shoe; and a second feature carried by a frame. In some embodiments, the first feature and the second feature are complementarily shaped and wherein at least one of the first feature and the second feature are biased to selectively engage the other of the first feature and the second feature. In some embodiments, the first feature comprises an aperture formed in a sole of the shoe and wherein at least a portion of the second feature is configured to be received within the sole by at least partial insertion through the aperture. In some embodiments, a biasing mechanism configured to selectively engage the first feature and the second feature is carried by the shoe. In some embodiments, a biasing mechanism configured to selectively engage the first feature and the second feature is carried by the frame. In some embodiments, the attachment system may further comprise a component that selectively extends through a sole of the shoe and into an interior of the frame. In some embodiments, the attachment system may further comprise a passage formed in a sole of the shoe through which a tool may be passed to affect the selective engagement of the first feature and the second feature. In some embodiments, the first feature is a static structure and the second feature is a dynamic mechanism.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Further, while the claims herein are provided as comprising specific dependencies, it is contemplated that any claims may depend from any other claims and that to the extent that any alternative embodiments may result from combining, integrating, and/or omitting features of the various claims and/or changing dependencies of claims, any such alternative embodiments and their equivalents are also within the scope of the disclosure.

What is claimed is:

1. A suspension for a wearable device configured to selectively provide roller transportation, comprising:

an axle at least partially circumferentially restrained along a length of the axle;

wherein the axle comprises a center of rotation located along a central axis of the axle; and wherein an end of the axle that is coincident with the central axis of the axle is selectively rotatable about the center of rotation along a partial spherical sweep in both a forward-rearward direction and an upward-downward direction while maintaining a location of the center of rotation.

2. The suspension according to claim 1, further comprising:

wherein at least a portion of the axle is received within a through hole.

3. The suspension according to claim 2, further comprising:

at least one elastically deformable tophat.

4. The suspension according to claim 3, wherein the at least one tophat is at least partially received within the through hole.

5. The suspension according to claim 4, wherein the at least one tophat comprises urethane.

6. The suspension according to claim 4, wherein at least a portion of the tophat is located circumferentially around the axle and within the through hole.

7. The suspension according to claim 6, wherein the axle comprises a bolt head.

8. The suspension according to claim 7, wherein the bolt head is offset from the through hole and at least a portion of the tophat is located between the bolt head and the through hole.

9. The suspension according to claim 8, wherein the axle comprises ridges at least partially located within the through hole.

10. The suspension according to claim 8, wherein the bolt head comprises a diameter greater than a diameter of the through hole.

11. The suspension according to claim 4, wherein at least a portion of the tophat is located between the through hole and a wheel assembly carried by the axle.

12. The suspension according to claim 11, wherein a suspension spacer is located between the tophat and the wheel assembly.

13. The suspension according to claim 12, wherein the wheel assembly comprises a friction reducing coating adjacent the suspension spacer.

14. The suspension according to claim 1, wherein the axle comprises a female axle bolt and a complementary male axle bolt.

15. The suspension according to claim 14, wherein at least one of the female axle bolt and the male axle bolt comprise an integral relative position retainer feature.

16. The suspension according to claim 15, wherein the integral relative position retainer feature comprises a knurled face of at least one of the female axle bolt and the complementary male axle bolt.

17. The suspension according to claim 2, further comprising:

an inner tophat at least partially received within the through hole and at least partially extending from an inner end of the through hole; and an outer tophat at least partially received within the through hole and at least partially extending from an outer end of the through hole.

18. The suspension according to claim 17, wherein the portion of the inner tophat extending from the inner end of the through hole is restrained by a bolt head of the axle.

19. The suspension according to claim 1, wherein the center of rotation is substantially coincident with the axis of rotation and wherein each of the suspension axis, the axis of rotation, and the center of rotation remain coincident during rotation of a wheel assembly that is carried by the axle about the axis of rotation and during perturbations of the suspension.

20. A suspension for a wearable device configured to selectively provide roller transportation, comprising:

an axle comprising an axle axis, the axle being at least partially circumferentially restrained along a length of the axle so that rotation of the axle about the axle axis is restricted;

wherein the axle is rotatable about a center of rotation that is coincident with the axle and located along the axle axis; and wherein, while maintaining a location of the center of rotation, an end of the axle that is coincident with the axle axis is movable to substantially all points coincident with a circular perimeter of a spherical section having a spherical section center coincident with the center of rotation.

21. A suspension for a wearable device configured to selectively provide roller transportation, comprising:

an axle comprising an axle central axis, the axle being at least partially circumferentially restrained along a length of the axle;

wherein, while maintaining a location of the center of rotation, an end of the axle that is coincident with the axle axis is selectively orbitally movable about a center of rotation that is coincident with the axle and the axle axis; and wherein the selective orbital movement comprises a first orbital path and a second orbital path that intersects the first orbital path.

* * * * *

UNITED STATES PATENT AND TRADEMARK OFFICE

CERTIFICATE OF CORRECTION

PATENT NO. : 8,801,002 B2
APPLICATION NO. : 13/184409
DATED : August 12, 2014
INVENTOR(S) : Roger R. Adams It is certified that error appears in the above-identified patent and that said Letters Patent is hereby corrected as shown below:

In the Specification

Column 1, Line 60 should read: "FIG. 7 is another partial oblique view of an attachment"
Column 6, Line 15 should read: "the axes of rotation 1808 may be higher than the foot interface"
Column 6, Line 40 should read: "other embodiments, wearable devices 1000, 3000 may be"
Column 7, Line 50 should read: "a suspension. It will be appreciated that the inventive aspects of"
Column 7, Line 51 should read: "the systems and methods disclosed herein are not limited to" Column 9, Line 5 should read: "sole 1204 additionally comprises a midsole 1226 generally"
Column 9, Line 29 should read: "outsole 1224, in other embodiments, a sole 1204 may be the"
Column 11, Line 21 should read: "substantially parallel to the ground and coincident with one or"
Column 12, Line 18 should read: "more of the above-listed substantially minimalized example"
Column 13, Line 17 should read: "1404 may comprise a hypothetical trunk midline plane 1414 that is"
Column 13, Line 38 should read: "outer angle 1418 values and considering that each branch 1406 may"
Column 15, Line 51 should read: "of the frame 1400 relative to a user's foot that are inserted into"
Column 17, Line 12 should read: "the effect of such increases in a wheel assembly's 1800 overall"
Column 18, Line 17 should read: "shoe 1200 substantially dimensioned as a so called "US wom-"
Column 18, Line 22 should read: "sional standard. Accordingly, it will be appreciated that a frame"
Column 19, Line 30 should read: "The pin 1624 may be received by and/or into a pinhole 1628 formed"
Column 19, Line 36 should read: "fully through the suspension block 1408 while nonetheless"
Column 19, Line 67 should read: "1632 extending from male shaft 1630. Once the"
Column 20, Line 50 should read: "inner side of the suspension spacer 1612 is substantially flat"
Column 21, Line 21 should read: "inner tophat 1608 is shown. The inner tophat 1608 and is shaped"
Column 21, Line 42 should read: "to the inner tophat 1608 being forced into the sus-"
Column 21, Line 56 should read: "the base 1648. FIG 32 also clearly shows that the pin hole"
Column 22, Line 11 should read: "sion axis 1602 and the axis of rotation 1808 to deviate from"
Column 22, Line 35 should read: "sion block 1408, suspension spacer 1612, and floating"

Signed and Sealed this
Tenth Day of February, 2015

Michelle K. Lee

Michelle K. Lee
*Deputy Director of the United States Patent and Trademark Office*

Column 22, Line 37 should read: “compression zones 1656 and/or extrusion”
Column 25, Line 26 should read: “from a frame 1400, one or more sole plugs may be used to plug”
Column 25, Line 50 should read: “one or more of the trunks 1404 of the frame, the intermediate”
Column 30, Line 33 should read: “ments, be attributable to well known factors of tire con-”
Column 30, Line 36 should read: “to camber thrust. These factors and principles of tire physics”
Column 32, Line 23 should read: “the rear lock blocks 3014 in a manner that allows selective entry”
Column 36, Lines 61-62 should read: “above, in some embodiments, the foot bed constituents 3166 may also move relative”
Column 37, Line 19 should read: “knurled end face 3174. Male axle bolt 3172 differs from male”
Column 37, Line 29 should read: “Referring now to FIG. 51, an orthogonal side view of an”
Column 38, Line 43 should read: “axis is located vertically higher relative to the clearance plane.”
Column 41, Line 9 should read: “device by a distance less than a distance between the wheel”
Column 43, Line 17 should read: “tem for selective attachment of the shoe to the frame. In”
Column 45, Line 61 should read: “wearable device by a distance less than a distance between the”
Column 47, Line 29 should read: “In some embodiments, the attachment system is associated”